US007009101B1

(12) United States Patent
Setoguchi et al.

(10) Patent No.: US 7,009,101 B1
(45) Date of Patent: Mar. 7, 2006

(54) TONE GENERATING APPARATUS AND METHOD FOR CONTROLLING TONE GENERATING APPARATUS

(75) Inventors: Masaru Setoguchi, Mizuhomachi (JP); Hiroyuki Sasaki, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 1254 days.

(21) Appl. No.: 09/619,688

(22) Filed: Jul. 19, 2000

(30) Foreign Application Priority Data

Jul. 26, 1999 (JP) ..... 11/211203

(51) Int. Cl.
*G10H 1/18* (2006.01)
*G10H 7/00* (2006.01)

(52) U.S. Cl. ..... 84/615; 84/602; 84/653

(58) Field of Classification Search ..... 84/600–602, 84/609–610, 615, 622, 649–650, 653, 659
See application file for complete search history.

(56) References Cited

U.S. PATENT DOCUMENTS 4,930,390 A * 6/1990 Kellogg et al. ..... 84/611
5,225,617 A 7/1993 Hotta
5,300,723 A 4/1994 Ito
5,361,672 A 11/1994 Koyama
5,399,800 A * 3/1995 Morita et al. ..... 84/609
5,478,967 A * 12/1995 Saito et al. ..... 84/612
5,578,778 A 11/1996 Imaizumi
6,031,174 A * 2/2000 Takabayashi ..... 84/609

FOREIGN PATENT DOCUMENTS

JP 60-149089 8/1985
JP 2534012 2/1997

* cited by examiner

*Primary Examiner*—Marlon Fletcher
(74) *Attorney, Agent, or Firm*—Frishauf, Holtz, Goodman & Chick, P.C.

(57) ABSTRACT

A tone generating apparatus has an internal storage in which defining information (taking the form of table information, for instance) on relationship between operation conditions of the apparatus and applications of operation members, such as slider, switch and encoder, is stored in advance. CPU of the apparatus controls the apparatus in such a manner that applications of operation members in a current operation condition of the apparatus are effected according to the defining information. With this arrangement, the work for changing specifications of the apparatus is simplified since it is done primarily by changing contents of the defining information.

5 Claims, 61 Drawing Sheets

FIG.3A

INITIAL SCREEN

| | |
|---|---|
| STOP | WRITE |
| START | READ |
| WAIT | |
| TONE | |
| PLAY | |

FIG.3B

STOP AUTO PERFORMANCE SCREEN

| | |
|---|---|
| STOP | WRITE |
| START | READ |
| WAIT | |
| TONE | |
| PLAY | return |

FIG.3C

RUN AUTO PERFORMANCE SCREEN

| | |
|---|---|
| STOP | |
| WAIT | |
| | return |

FIG.3D

WAIT FOR AUTO PERFORMANCE SCREEN

| | |
|---|---|
| STOP | |
| START | |
| | return |

FIG.3E

CHANGE TG PARAMETER SCREEN

| | | |
|---|---|---|
| Tone | 10 | return |
| Pitch | 100 | |
| Filter | 50 | |
| Envelop | 3 | |
| Modulation | 89 | |

FIG.3F

CHANGE PERFORMANCE PARAMETER SCREEN

| | | |
|---|---|---|
| return | 2 | song |
| | 0 | transpose |
| | 10 | acomp |
| | 120 | tempo |
| | 65 | volume |

FIG.3G

WRITE EXTERNAL STORAGE SCREEN

| | |
|---|---|
| song select | WRITE |
| tone select | |
| | return |

FIG.3H

READ EXTERNAL SCREEN

| | |
|---|---|
| song select | READ |
| tone select | |
| | return |

FIG.4A

| | SWITCHES LEFT OF LCD | | | | |
|---|---|---|---|---|---|
| INSTRUMENT STATE | SW LEFT1 | SW LEFT2 | SW LEFT3 | SW LEFT4 | SW LEFT5 |
| INITIAL SCREEN | INST(STATE, STOP PERFORMANCE) | INST(STATE, RUN PERFORMANCE) | INST(STATE, WAIT FOR PERFORMANCE) | INST(STATE, CHANGE TG) | INST(STATE, CHANGE PERFORMANCE) |
| STOP AUTO PERFORMANCE | INST(STATE, STOP PERFORMANCE) | INST(STATE, RUN PERFORMANCE) | INST(STATE, WAIT FOR PERFORMANCE) | INST(STATE, CHANGE TG) | INST(STATE, CHANGE PERFORMANCE) |
| RUN AUTO PERFORMANCE | INST(STATE, STOP PERFORMANCE) | NOP | INST(STATE, WAIT FOR PERFORMANCE) | NOP | NOP |
| WAIT FOR AUTO PERFORMANCE | INST(STATE, STOP PERFORMANCE) | INST(STATE, RUN PERFORMANCE) | NOP | NOP | NOP |
| CHANGE TG PARAMETER | TG(SELECT, TONE) | TG(SELECT, PITCH) | TG(SELECT, FILTER) | TG(SELECT, ENVELOPE) | TG(SELECT, MODULATION) |
| CHANGE PERFORMANCE PARAMETER | INST(STATE, INITIAL SCREEN) | NOP | NOP | NOP | NOP |
| WRITE EXTERNAL STORAGE | FDD(SELECT, SONG) | FDD(SELECT, TONE) | NOP | NOP | NOP |
| READ EXTERNAL STORAGE | FDD(SELECT, SONG) | FDD(SELECT, TONE) | NOP | NOP | NOP |

FIG.4B

| | SWITCHES RIGHT OF LCD | | | | |
|---|---|---|---|---|---|
| INSTRUMENT STATE | SW RIGHT1 | SW RIGHT2 | SW RIGHT3 | SW RIGHT4 | SW RIGHT5 |
| INITIAL SCREEN | INST(STATE, WRITE) | INST(STATE, READ) | NOP | NOP | NOP |
| STOP AUTO PERFORMANCE | INST(STATE, WRITE) | INST(STATE, READ) | NOP | NOP | INST(STATE, INITIAL SCREEN) |
| RUN AUTO PERFORMANCE | NOP | NOP | NOP | NOP | INST(STATE, INITIAL SCREEN) |
| WAIT FOR AUTO PERFORMANCE | NOP | NOP | NOP | NOP | INST(STATE, INITIAL SCREEN) |
| CHANGE TG PARAMETER | INST(STATE, INITIAL SCREEN) | NOP | NOP | NOP | NOP |
| CHANGE PERFORMANCE PARAMETER | INST(SELECT, SONG) | INST(SELECT, TRANSPOSE) | INST(SELECT, ACCOMP) | INST(SELECT, TEMPO) | INST(SELECT, VOL) |
| WRITE EXTERNAL STORAGE | FDD(SELECT, WRITE) | NOP | NOP | NOP | INST(STATE, INITIAL SCREEN) |
| READ EXTERNAL STORAGE | FDD(SELECT, READ) | NOP | NOP | NOP | INST(STATE, INITIAL SCREEN) |

FIG.4C

| | UPPER SWITCHES BELOW LCD | | | LOWER SWITCHES BELOW LCD | | |
|---|---|---|---|---|---|---|
| INSTRUMENT STATE | SWENC1 U | SWENC2 U | SWENC3 U | SWENC1 D | SWENC2 D | SWENC3 D |
| INITIAL SCREEN | NOP | NOP | NOP | NOP | NOP | NOP |
| STOP AUTO PERFORMANCE | NOP | TG(ENVELOPE, ADD) | NOP | NOP | TG(ENVELOPE, SUBTRACT) | NOP |
| RUN AUTO PERFORMANCE | INST(TEMPO, ADD) | TG(VOL, ADD) | TG(EFFECT, ADD) | INST(TEMPO, SUBTRACT) | TG(VOL, SUBTRACT) | TG(EFFECT, SUBTRACT) |
| WAIT FOR AUTO PERFORMANCE | NOP | NOP | NOP | NOP | NOP | NOP |
| CHANGE TG PARAMETER | TG(TONE, ADD) | TG(PITCH, ADD) | TG(FILTER, ADD) | TG(TONE, SUBTRACT) | TG(PITCH, SUBTRACT) | TG(FILTER, SUBTRACT) |
| CHANGE PERFORMANCE PARAMETER | INST(SONG, ADD) | INST (TRANSPOSE, ADD) | INST(ACCOMP, ADD) | INST(SONG, SUBTRACT) | INST (TRANSPOSE, SUBTRACT) | INST(ACCOMP, SUBTRACT) |
| WRITE EXTERNAL STORAGE | FDD(SELECT, NEXT SONG TONE) | NOP | NOP | FDD(SELECT, PREVIOUS SONG, TONE) | NOP | NOP |
| READ EXTERNAL STORAGE | FDD(SELECT, NEXT SONG TONE) | NOP | NOP | FDD(SELECT, PREVIOUS SONG, TONE) | NOP | NOP |

FIG.4D

| | SLIDER1 BELOW LCD | SLIDER2 BELOW LCD | SLIDER3 BELOW LCD | ROTARY ENCODER | KEYBOARD |
|---|---|---|---|---|---|
| INSTRUMENT STATE | SLIDER1 | SLIDER2 | SLIDER3 | ROTENC | KEYBOARD |
| INITIAL SCREEN | NOP | NOP | NOP | NOP | TG (KEYBOARD) |
| STOP AUTO PERFORMANCE | NOP | TG(ENVELOPE, VALUE) | NOP | NOP | TG (KEYBOARD) |
| RUN AUTO PERFORMANCE | INST(TEMPO, VALUE) | INST (VOL, VALUE) | INST(EFFECT, VALUE) | INST(TEMPO, ROTATION VALUE) | TG(STATE, RUN PERFORMANCE) |
| WAIT FOR AUTO PERFORMANCE | NOP | NOP | NOP | NOP | INST(STATE, RUN PERFORMANCE) |
| CHANGE TG PARAMETER | TG(TONE, VALUE) | TG(PITCH, VALUE) | TG(FILTER, VALUE) | TG(SELECT, ROTAITON VALUE) | TG (KEYBOARD) |
| CHANGE PERFORMANCE PARAMETER | INST(SONG, VALUE) | INST (TRANSPOSE, VALUE) | INST(ACCOMP, VALUE) | INST(SELECT, ROTATION VALUE) | TG (KEYBOARD) |
| WRITE EXTERNAL STORAGE | NOP | NOP | NOP | FDD(SELECT, ROTATION VALUE) | NOP |
| READ EXTERNAL STORAGE | NOP | NOP | NOP | FDD(SELECT, ROTATION VALUE) | NOP |

FIG.7A

| OPERATION MEMBER | NUMBER |
|---|---|
| SWLEFT 1 | 0 |
| SWLEFT 2 | 1 |
| SWLEFT 3 | 2 |
| SWLEFT 4 | 3 |
| SWLEFT 5 | 4 |
| SWRIGHT 1 | 5 |
| SWRIGHT 2 | 6 |
| SWRIGHT 3 | 7 |
| SWRIGHT 4 | 8 |
| SWRIGHT 5 | 9 |
| SWENC 1U | 10 |
| SWENC 2U | 11 |
| SWENC 3U | 12 |
| SWENC 1D | 13 |
| SWENC 2D | 14 |
| SWENC 3D | 15 |
| SLIDER 1 | 16 |
| SLIDER 2 | 17 |
| SLIDER 3 | 18 |
| ROTENC | 19 |
| KEYBOD | 20 |

FIG.7B

| INSTRUMENT STATE | NUMBER |
|---|---|
| INITIAL SCREEN | 0 |
| STOP AUTO PERFORMANCE | 1 |
| RUN AUTO PERFORMANCE | 2 |
| WAIT FOR AUTO PERFORMANCE | 3 |
| CHANGE TG PARAMETER | 4 |
| CHANGE PERFORMANCE PARAMETER | 5 |
| WRITE EXTERNAL STORAGE | 6 |
| READ EXTERNAL STORAGE | 7 |

TONE GENERATING APPARATUS AND METHOD FOR CONTROLLING TONE GENERATING APPARATUS

BACKGROUND OF THE INVENTION

The present invention relates to technology which can flexibly expand, change or delete functions of tone generating apparatus.

Digital technology advance makes it possible to reduce the cost of realizing many of diversified functions developed in the prior art for electronic musical instruments.

To provide electronic musical instruments with such functions, the cost of operation members for selecting or setting instrument functions is often more expensive than the cost of realizing the functions per se. As a result, some electronic musical instruments employ a reduced number of operation members by assigning functions to simultaneous operation of a plurality of operation members. This, however, sacrifices the instrument operability.

A critical work in designing products is to determine specifications of products, or determine functions of products (here, electronic musical instruments). If change (addition, deletion) of product specifications happens to be required after the product design work started, an additional work of changing the design is inevitable. It is desired to minimize the additional work for change of product specifications since the working hours assigned to designing products are limited.

In the prior art electronic musical instruments, a control program which is run by CPU to control the entire system is written so as to describe and arrange control contents executed by CPU in response to event occurrences, such as operations of operation members.

As a result, even slightest change of the product design, such as changing applications of operation members requires a great amount of work to change the control program.

SUMMARY OF THE INVENTION

It is, therefore, an object of the invention to provide technology which can flexibly add, change or delete functions of a tone generating apparatus.

In accordance with an aspect of the invention, there is provided an apparatus for generating tones which comprises:

- operation members which are externally operated to operate functions of the apparatus;
- storage means for storing defining information on relationship between operation conditions of the apparatus and applications of said operation members; and
- control means for controlling the apparatus in such a manner that applications of said operation members in operation conditions of the apparatus are effected in response to operation of the operation members according to said defining information.

A further aspect of the invention is to provide a method for controlling a tone generating apparatus which comprises the steps of:

- looking up defining information on relationship between operation conditions of the apparatus and applications of operation members which are externally operated to operate functions of the apparatus; and
- controlling the apparatus in such a manner that applications of said operation members in a current operation condition of the apparatus are effected in response to operation of said operation members according to the looked up defining information.

With this arrangement, applications of operation members can be changed depending on a current operation condition of the tone generating apparatus. Further, the work required for adding, changing or deleting functions of the tone generating apparatus is simplified.

BRIEF DESCRIPTION OF THE DRAWINGS

FIGS. 3A–H are views of screens displayed on LCD for respective operation conditions (states) of the instrument;

FIGS. 4A–D show an example of a specification data table;

FIG. 7A is a table showing correspondence between operation members and assigned numbers;

FIG. 7B is a table showing correspondence between instrument states and assigned numbers;

DETAILED DESCRIPTION OF PREFERRED EMBODIMENT

The invention is now described in more detail with respect to a preferred embodiment taken in conjunction with the drawings. In the embodiment, the invention is applied to an electronic keyboard instrument which can automatically perform songs and accompaniments.

Figure 1:
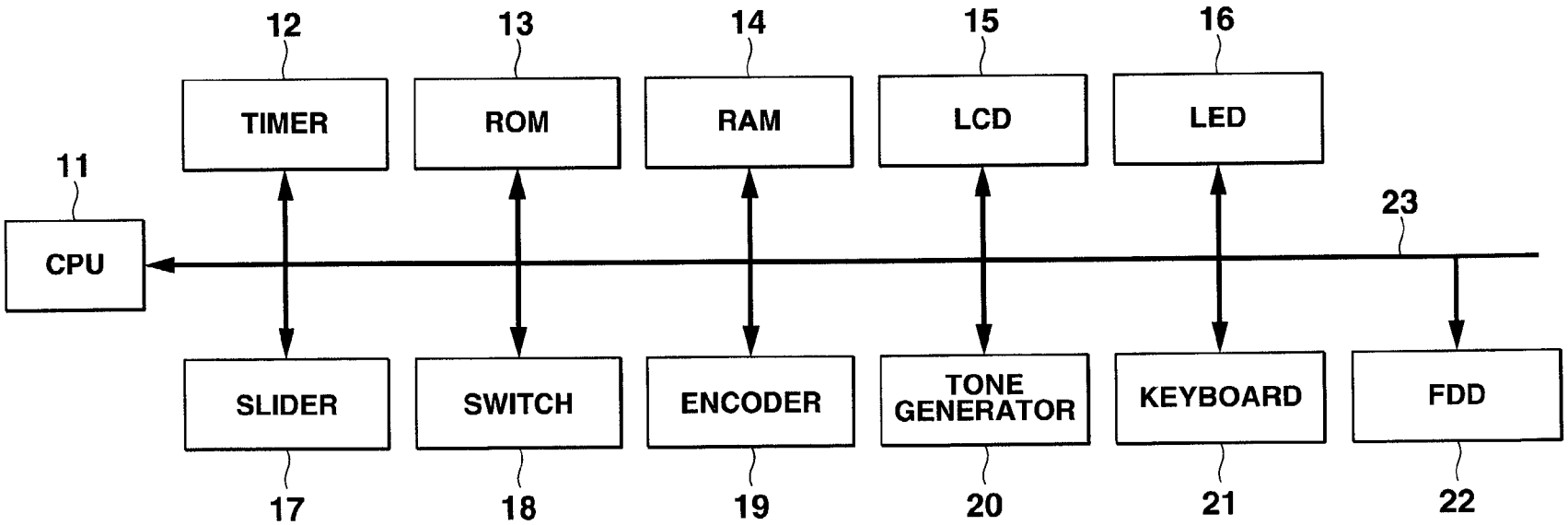
FIG. 1 is a block diagram showing an overall arrangement of an electronic keyboard instrument in accordance with an embodiment of the invention.
Figure 2:
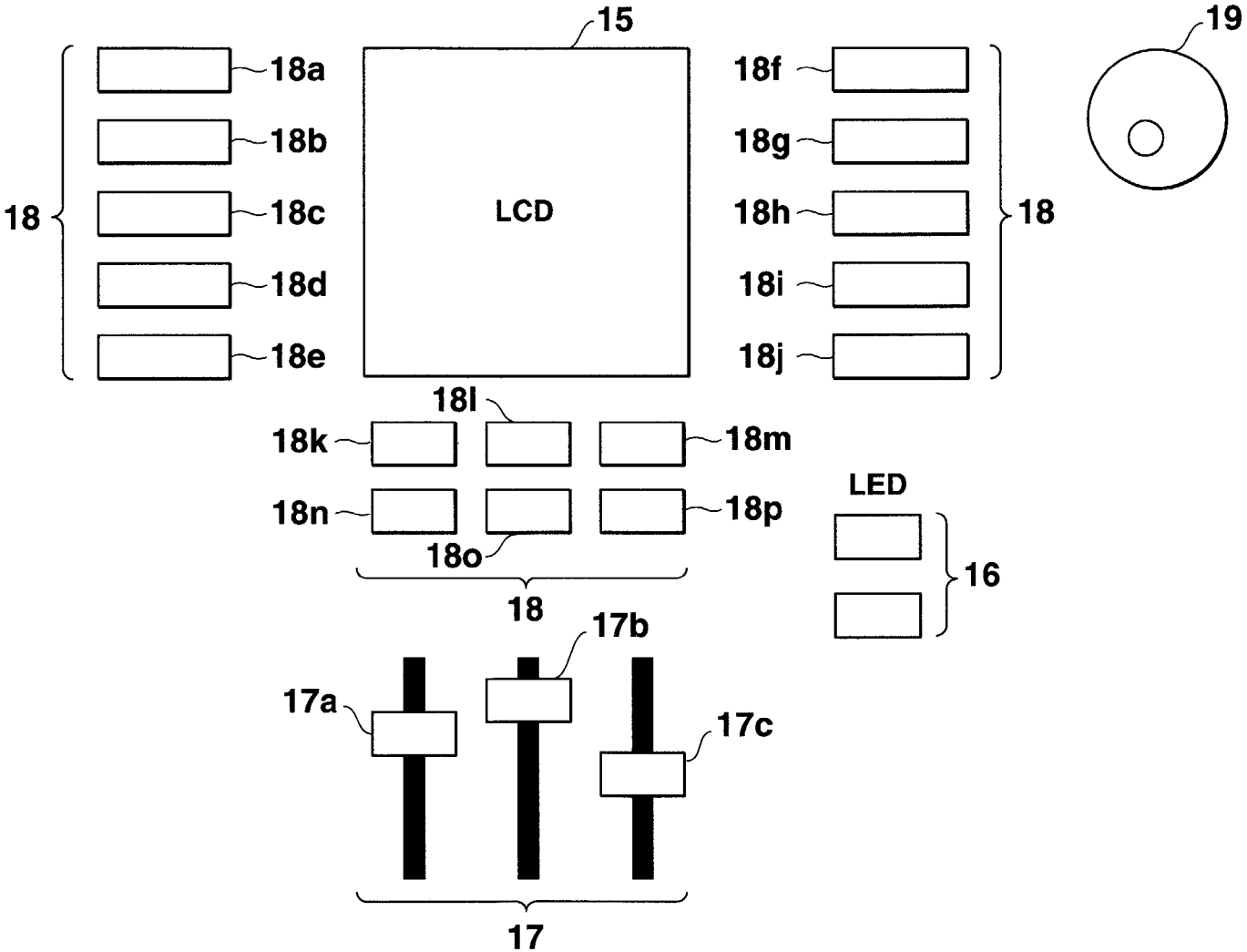
FIG. 2 is a view of a lay-out of a control console of the instrument.

FIG. 1 is a block diagram of an overall arrangement of an electronic keyboard instrument (referred to as instrument hereinafter) in accordance with the embodiment of the invention. FIG. 2 shows a layout of operation members arranged on the console of the instrument.

In FIG. 1, CPU11, timer 12, ROM 13, RAM 14, LCD 15, LED 16, slider 17, switch 18, encoder 19, tone generator (TG) 20, keyboard 21 and FDD 22 are interconnected via bus 23. In FIGS. 1 and 2, corresponding components are designated by like numerals.

CPU 11 runs a control program stored in ROM 13 to control the entire system while using RAM 14 as work memory.

Timer 12 counts elapse of time. ROM 13 stores the control program to be run by CPU 11 and data such as tone data and song data. In accordance with the invention, ROM 13 further stores specification data table which indicates definition of relationship between applications of operation members and operation conditions of the instrument. In the embodiment, a flash memory is used as ROM 13. Thus, CPU 11 can write ROM 13 or flash memory.

RAM 14 is used as a work memory of CPU 11 and stores parameters used in the operation of the instrument.

LCD (liquid crystal display) 15 displays applications of operation members.

LED (light emitting diode) 15 is turned on or off to indicate operation conditions of the instrument.

Slider (slide volume) 17 is an operation member which signals a control input corresponding to sliding operation by a user. Slider 17 comprises three sliders 17*a*, 17*b* and 17*c*, as shown in FIG. 2.

Switch 18 is an operation member which signals an on input in response to depressing operation by a user. As shown in FIG. 2, switch 18 comprises sixteen switches 18*a*–18*p*. Five switches 18*a*–18*e* are disposed on the left of LCD 15. Five switches 18*f*–18*j* are disposed on the right of LCD 15. Switches (upper) 18*k*–18*m* and switches (lower) 18*n*–18*p* are disposed below a LCD 15. Applications of the respective switches are not fixed but depend on operation conditions of the instrument.

FIGS. 3A to 3H show visual presentations of screens displayed on LCD 15 for respective operation conditions (eight states) of the instrument. The visual presentations indicate applications of switches 18*a*–18*j* disposed on the right and left of LCD 15.

By way of example, top switch 18*a* on the left of LCD 15 is applied as follows. At the start of the instrument, LCD 15 displays an initial screen shown in FIG. 3A. The initial screen indicates "STOP" for switch 18*a*. This means that the application of switch 18*a* in the operation condition of initial screen is to stop automatic performance. In the operation condition of change TG parameter, LCD displays a change TG parameter screen shown in FIG. 3A. The change TG parameter screen indicates "TONE" for switch 18*a*. Thus, in the operation condition of change TG parameter, the switch 18*a* is applied as determining a tone to be generated.

The initial screen of LCD 15 shown in FIG. 3A does not indicate application of switches 18*h*, 18*i* and 18*j*. Thus, in the operation condition of initial screen, operation of the switches 18*h*, 18*i* and 18*j* is ignored (treated as NOP or no operation).

Turning back to FIG. 1, encoder (rotary encoder) 19 is an operation member which signals a control input corresponding to rotating operation by a user.

TG (tone generator) 20 generates tones under the control of CPU 11.

Keyboard (music keyboard) 21 is an operation member which signals a performance input to CPU 11 in response to depressing or releasing operation by a user.

FDD (floppy disk drive) 22 reads music data from or writes them into a floppy disk.

The specification data table of the invention is now described. FIGS. 4A–4D illustrate a specification data table.

The specification data table provides definition of contents of a process to be performed by CPU 11 based on relationship between operation conditions of the instrument and applications of operation members including slider 17, switch 18, encoder 19 and keyboard 21. In FIGS. 4A–4D, columns of the specification data table indicate operation members. In the columns, SWLEFT1–SWLEFT5 correspond to switches 18*a*–18*e* in FIG. 2, SWRIGHT1–SWRIGHT5 to switches 18*f*–18*j*, SWENC1U–SWENC3U to switches 18*k*–18*m*, SWENC1D–SWENC3D to switches 18*n*–18*p*, SLIDER1–SLIDER3 to sliders 17*a*–17*c*, ROTENC to encoder 19 and KEYBOD to keyboard 21.

Rows of the specification table indicate operation conditions (states) of the instrument. As shown in FIGS. 4A–4D and FIGS. 3A–3H, the instrument has eight operation conditions including initial screen, stop auto performance, run auto performance, wait for auto performance, change TG parameter, change performance parameter, write external storage and read external storage.

Use of the specification data table is described with respect to operation of switch 18*a* at the start of the instrument. In FIG. 4A, a cell at the intersection of the initial screen row and SWLEFT1 (switch 18*a*) column reads INST (STATE, STOP PERFORMANCE). Thus, when the switch 18 is operated at the start of the instrument, CPU 11 performs the process "INST (STATE, STOP PERFORMANCE)."

A cell at the intersection of the initial screen row and SWRIGHT3 (switch 18*h*) reads NOP. For a NOP cell, CPU 11 ignores the operation of the switch.

Applications of operation members depending on operation conditions of the instrument can be changed by changing contents of the specification data table. Contents of a specification table cell may be changed according to specification change of the instrument. However, such change does not require changing a control program portion that has been coded, but may be accomplished by simply adding a subroutine of the changed cell to the control program. In this manner, a process to be performed by CPU 11 in response to operation of an operation member is determined from the specification data table. Thus, the specification table of the invention provides flexibility for specification change of the instrument.

The specification data table reside in ROM 13 which is a flash memory in the embodiment. Thus, CPU 11 can rewrite the specification table.

CPU 11 selects and performs a process according to the specification data table based on the relationship between a current operation condition (state) of the instrument and operation of an operation member, as will be described in more detail.

Figure 5:
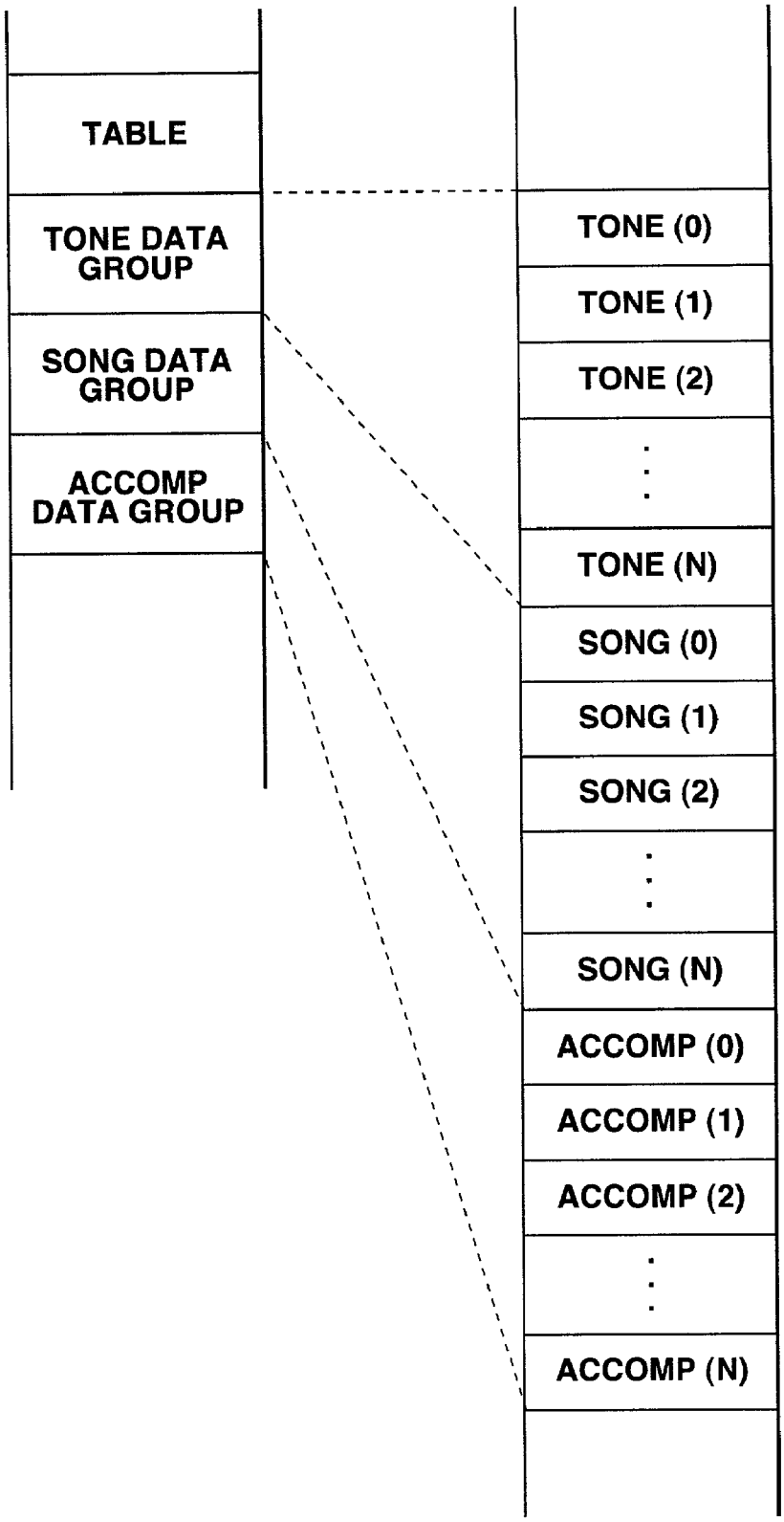
FIG. 5 is a diagram showing contents of ROM.

Data stored in ROM 13 are now described with reference to FIG. 5. ROM 13 stores a control program (not shown) and a specification data table designated TABLE in FIG. 5. Further, ROM 13 stores a tone data group including a plurality of (N) tones for tone generator 20, a song data group including a plurality of (N) songs for automatic performance and an accompaniment data group including a plurality of (N) accompaniments for automatic performance. Since a flash memory is used as ROM 13, data stored in ROM 13 can be changed under the control of CPU 11.

Figure 6:
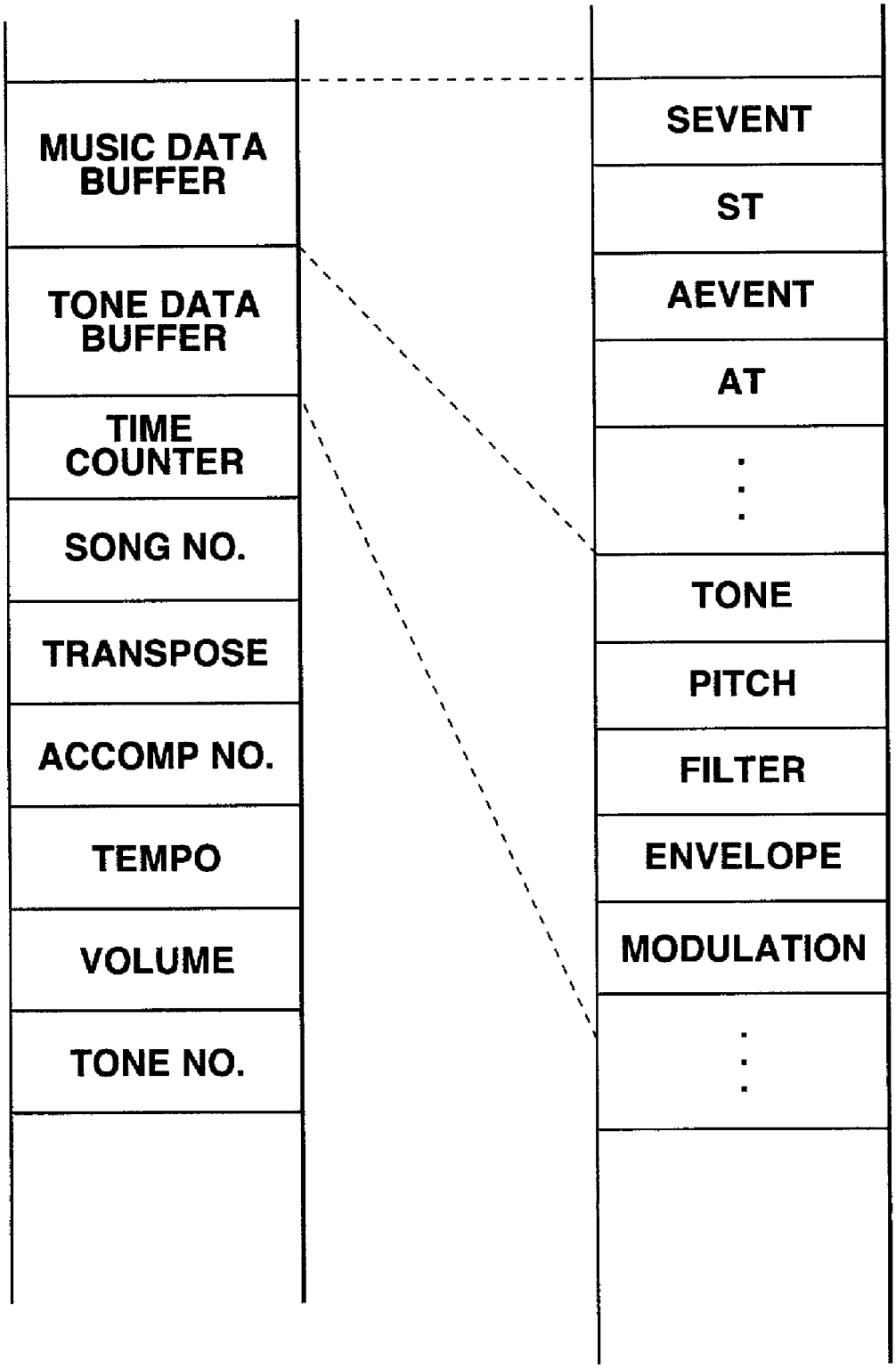
FIG. 6 is a diagram showing contents of RAM.

RAM 14 is used as a work memory by CPU 11 in the manner shown in FIG. 6.

Music data buffer stores music data for automatic performance.

Tone data buffer stores TG parameters to be set in tone generator 20.

Time counter stores a count of timer interrupt request signals generated by the timer 12 at predetermined time intervals.

SONG NO. stores a current song number for a song selected from the song data group in ROM 13.

TRANSPOSE stores a transposition (key change) of the keyboard 21.

ACCOMP NO. stores a current accompaniment number for an accompaniment selected from accompaniment data group in ROM 13.

TEMPO stores a current tempo of the automatic performance.

VOLUME stores a current volume of tones to be generated in the tone generator 20.

TONE NO. stores a current tone number for a tone selected from the tone data group in ROM 13.

Details of the music data buffer and the tone data buffer are also shown in FIG. 6.

Specifically, the music data buffer includes a song or melody note event SEVENT for a current note to be played for automatic performance, song time data ST indicative of a time from the start of the automatic performance, an accompaniment note event AEVENT for a current note to be played for automatic performance and accompaniment time data AT indicative of a time from the start of the automatic performance.

The tone data buffer includes data items of a current tone from the tone data group in ROM 13, pitch, filter, envelope and modulation.

FIG. 7A shows numbers assigned to respective operation members including switches 18*a*–18*p* (SWLEFT1–5, SWRIGHT1–5, SWENC1U–3U, SWENC1D–3D), sliders 17*a*–17*c* (SLIDER1–3), encoder 19 (ROTENC) and keyboard 21 (KEYBOD). FIG. 7B shows numbers assigned to respective operation conditions (states) of the instrument including initial screen, stop auto performance, run auto performance, wait for auto performance, change TG parameter, change performance parameters, write external storage and read external storage.

Operation of the embodiment is now described.

1. Overall Operation

Figure 8:
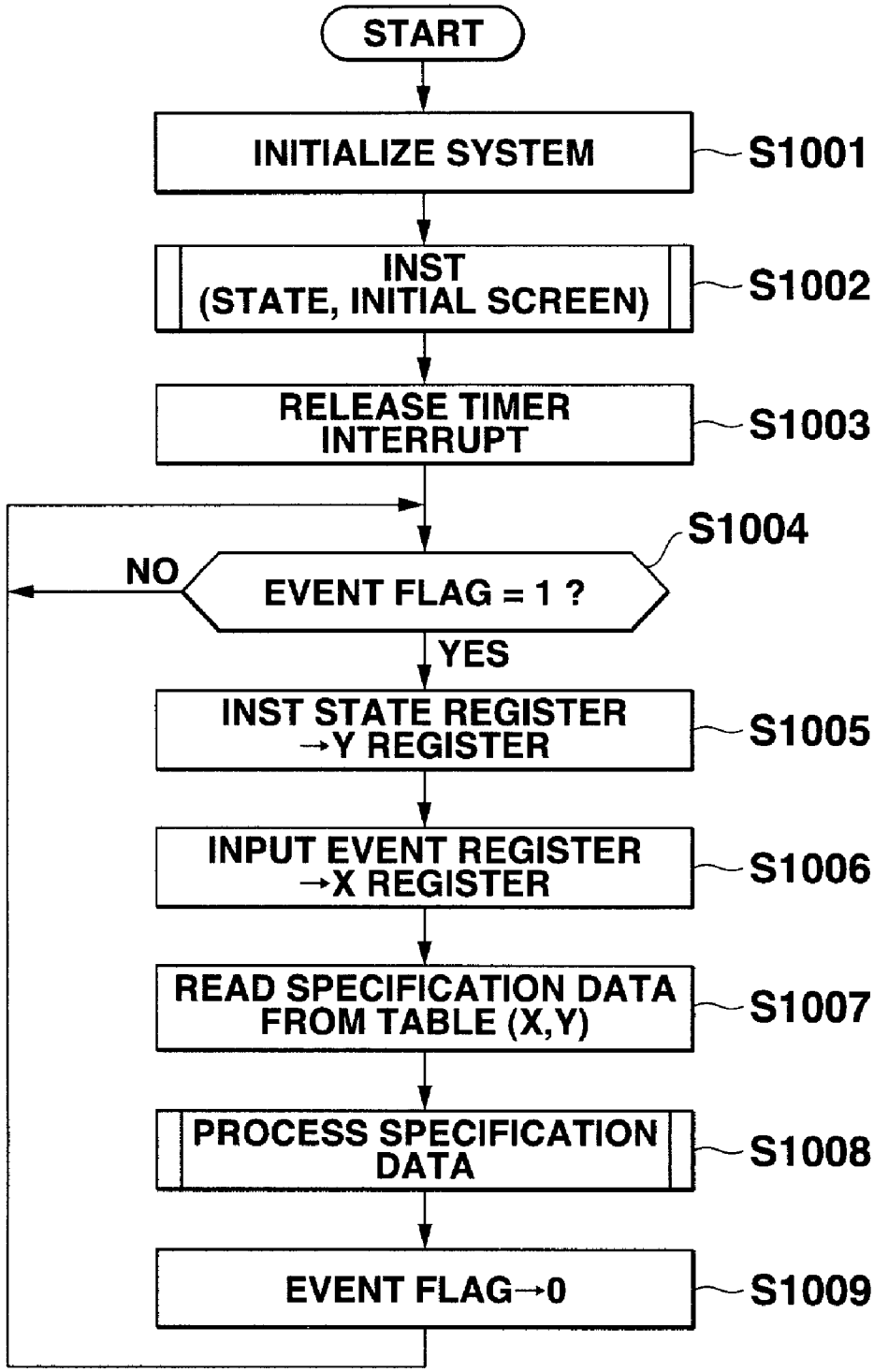
FIG. 8 is a flow chart of a main routine.

FIG. 8 is a flow chart showing an overall operation of the instrument under the control of CPU 11 which runs a control program stored in ROM 13.

Upon power on, block S1001 initializes the system by initializing internal registers of CPU 11, RAM 14, parameters and flags.

Block S1002 executes INST (STATE, INITIAL SCREEN) routine to display the initial screen on LCD15. Details of INST(STATE, INITIAL SCREEN) routine will be described later.

Block S1003 releases a timer interrupt which was inhibited by the initialize system block S1001. Details of the timer interrupt will be described later.

Block S1004 checks if EVENT FLAG is set to "1". In the affirmative, the routine goes to block S1005. In the negative, the routine returns to block S1004, thus waiting for the EVENT FLAG set to "1", indicative of operation of an operation member.

Block S1005 loads INST STATE register indicative of a current state or operation condition of the instrument (see FIG. 7A) into Y register.

Block S1006 loads INPUT EVENT register indicative of the device number (see FIG. 7A) of the operated operation member into X register.

Block S1007 uses X and Y to look up the specification data table TABLE, thus reading specification data TABLE (X, Y) with respect to a current state of the instrument and a current operation member.

Block S1008 processes the specification data TABLE (X, Y), thus performing a required process in response to the operation of the current operation member in the current state of the instrument. Details of the process specification data will be described later.

Block S1009 resets EVENT FLAG to "0" since block S1008 has completed the process for the current event. Then the routine returns to block S1004 and repeats the loop.

2. Timer Interrupt

Figure 9:
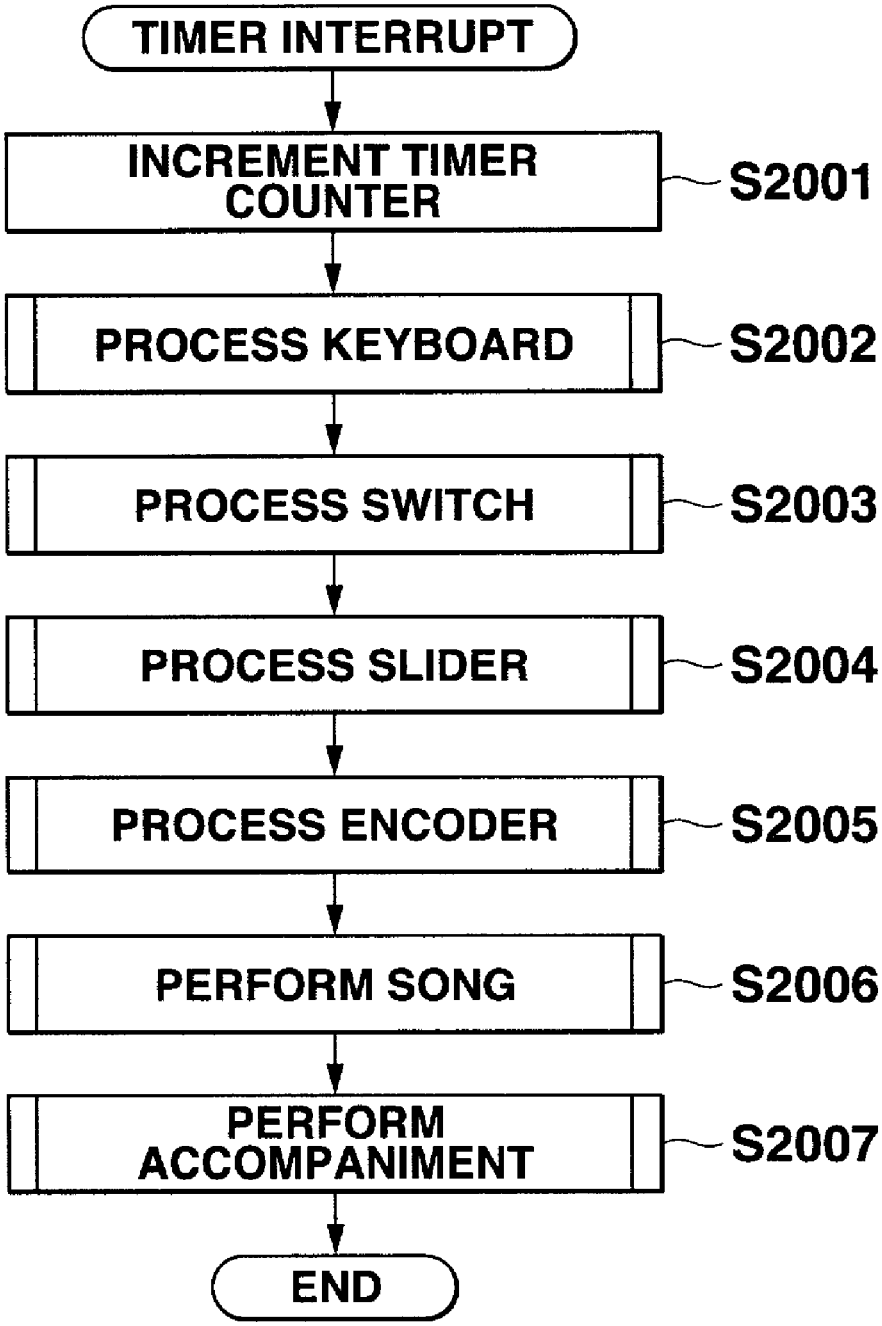
FIG. 9 is a flow chart of a timer interrupt routine.

As stated, the timer interrupt routine is executed by CPU 11 in response to a timer interrupt request signal from the timer 12, generated at predetermined time intervals. FIG. 9 is a flow chart of the timer interrupt routine.

Block S2001 increments the timer counter in RAM 14 work area. Then the timer interrupt routine executes process keyboard (block S2003), process switch (block S2004), process encoder (block S2005), perform song (block S2006) and perform accompaniment (block S2007). Details of them are now described.

2-1. Process Keyboard

Figure 10:
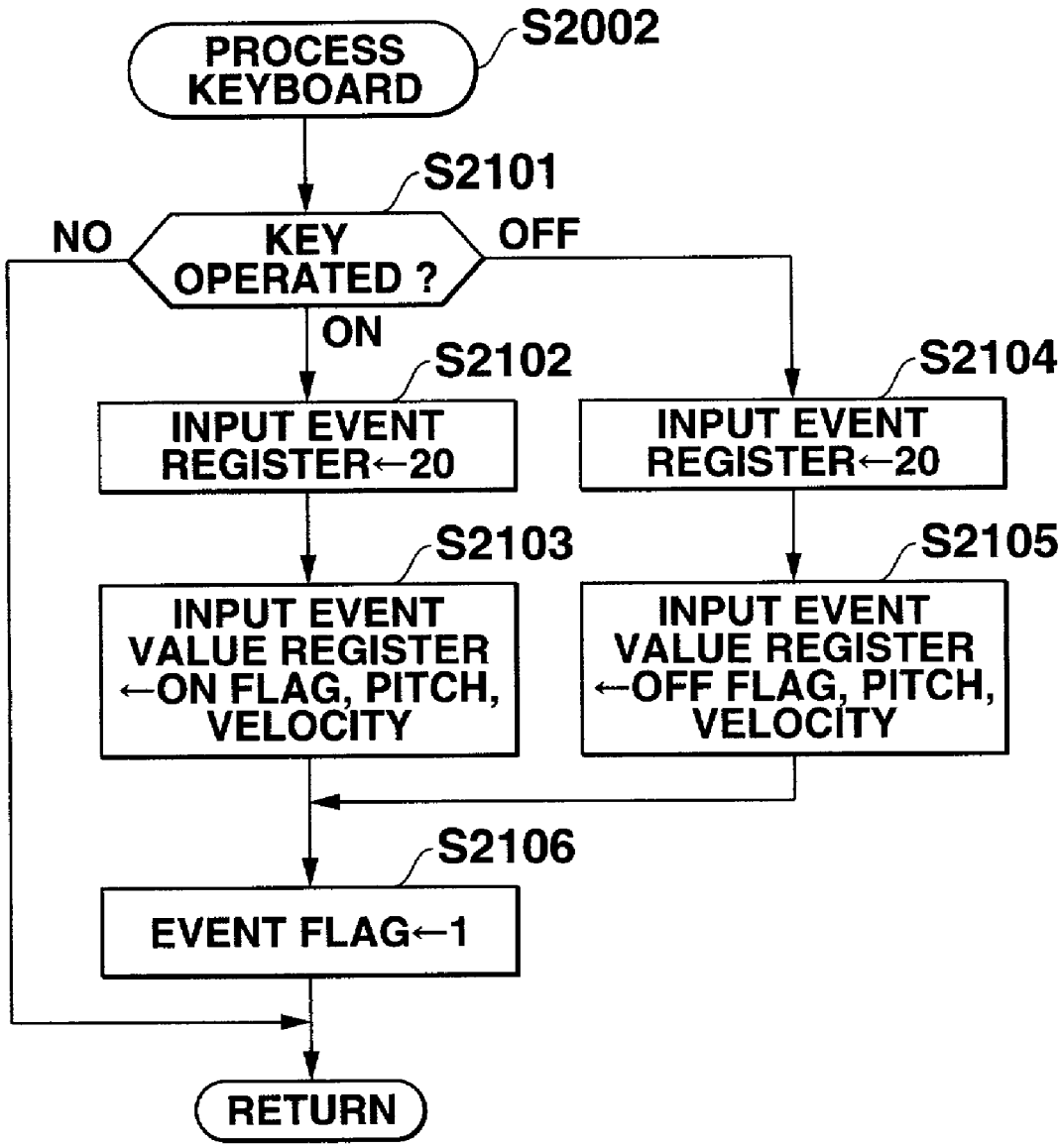
FIG. 10 is a flow chart of a process keyboard routine.

FIG. 10 is a flow chart of the process keyboard routine. The object of the process keyboard routine is to acquire operation information of the keyboard 21.

Block S2101 checks if a key operation (key-on or off) occurs on the keyboard 21. In the negative, the routine returns to the flow of FIG. 9. For a key-on operation, block S2102 is executed whereas for a key-off operation, block S2104 is executed.

Block S2102 sets the INPUT EVENT register to "20" indicative of the keyboard 21.

Block S2103 sets INPUT EVENT VALUE register to ON flag indicative of key-on operation, pitch and velocity (depressing velocity) of the key. Then block S2106 is executed.

Block S2104 sets the INPUT EVENT register to "20" indicative of the keyboard 21 (see FIG. 7A).

Block S2105 sets the INPUT EVENT VALUE register to OFF flag indicative of key-off operation, pitch and velocity (releasing velocity) of the key.

Block S2106 sets the EVENT FLAG to "1", indicative of occurrence of an event. Then, the process keyboard routine returns to the flow of FIG. 9.

2-2. Process Switch

Figure 11:
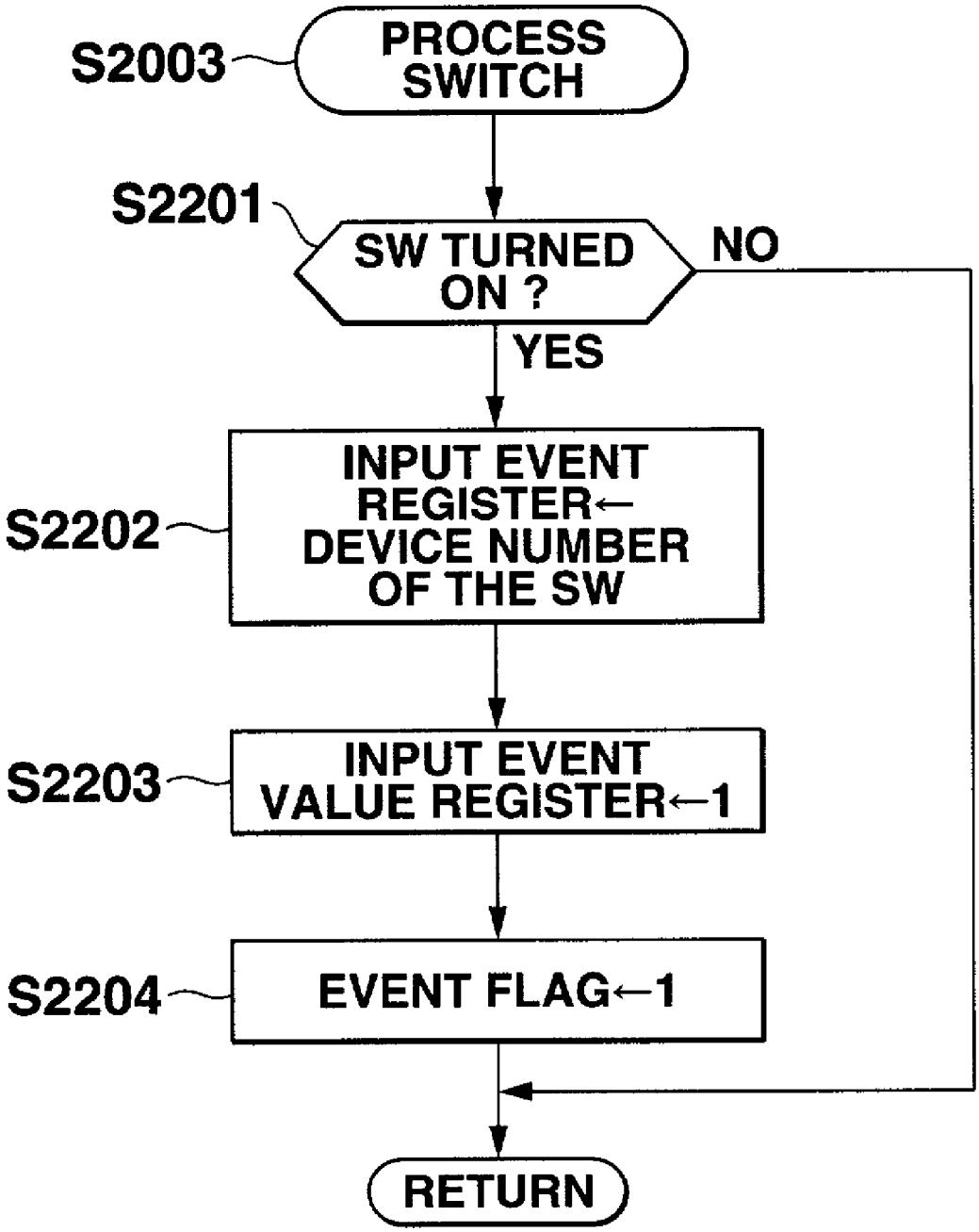
FIG. 11 is a flow chart of a process switch routine.

FIG. 11 is a flow chart of the process switch routine. The object of the process switch routine is to acquire information on operation of the switch 18.

Block S2201 checks if a switch (one of the switches 18*a*–18*p*) is operated. In the affirmative, block S2202 is executed. In the negative, the process switch routine returns to the flow of FIG. 9.

Block S2202 sets the INPUT EVENT register to the device number (see FIG. 7A) of the operated switch.

Block S2203 sets the INPUT EVENT VALUE register to "1", indicative of switch operation. Block S2204 sets the EVENT FLAG to "1", indicative of occurrence of an event. Then the routine returns to the flow of FIG. 9.

2-3. Process Slider

Figure 12:
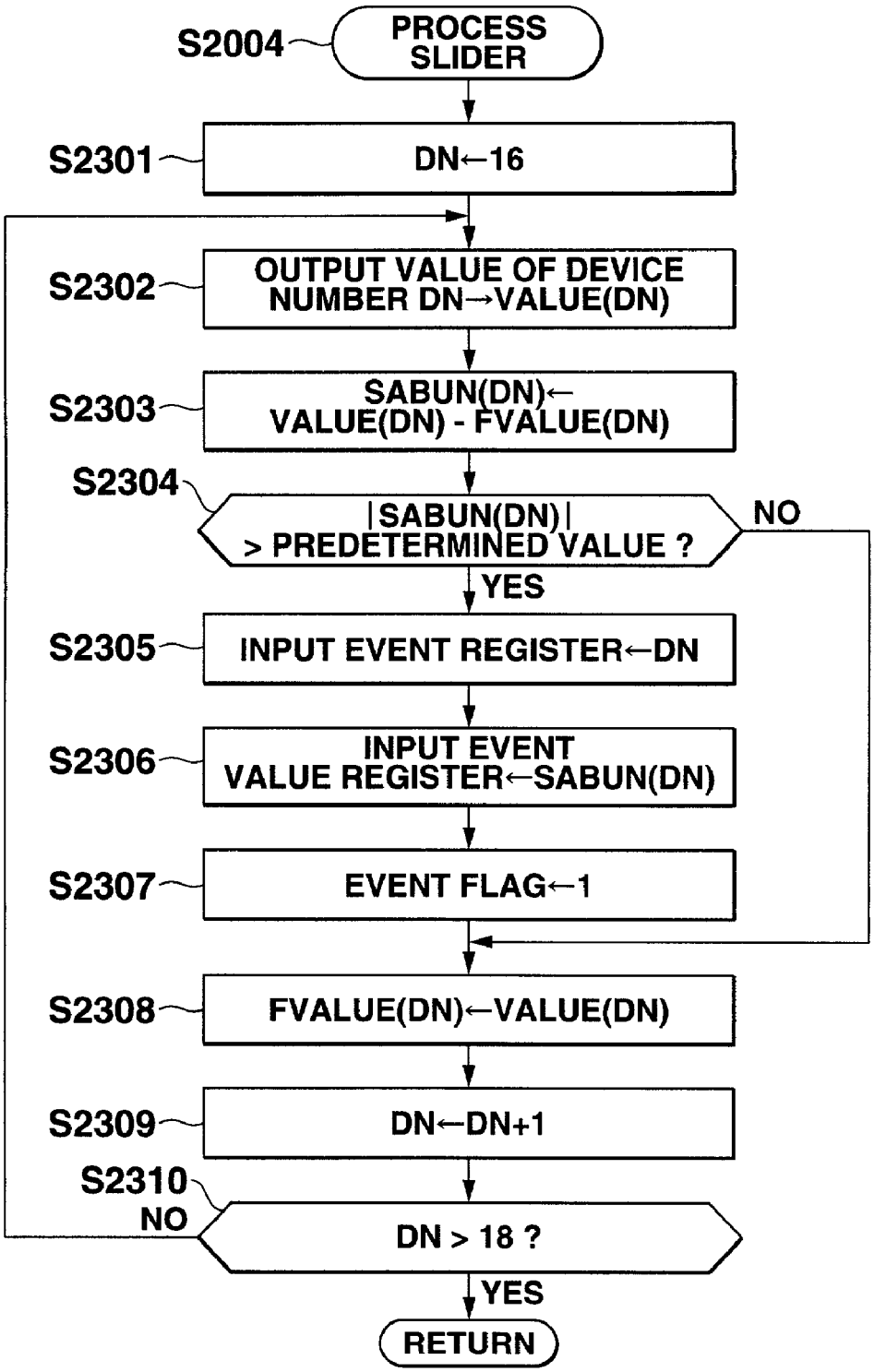
FIG. 12 is a flow chart of a process slider routine.

FIG. 12 is a flow chart of the process slider routine. The object of the process slider routine is to acquire information on operation of the slider 17.

Block S2301 sets the device number DN to "16".

Block S2302 sets VALUE (DN) to the output value of the slider of the device number DN.

Block S2303 sets SABUN(DN) to an differential value obtained by subtracting FVLAU (DN) indicative of the previous output value of the slider from VALUE (DN) indicative of the current output value of the slider.

Block S2304 checks if the absolute value of SABUN(DN) is greater than a predetermined value. This is the case when the slider of DN is operated. In the affirmative, block S2305 is executed. In the negative, block S2308 is executed.

Block S2305 sets the INPUT EVENT register to DN.

Block S2306 sets the INPUT EVENT VALUE register to SABUN(DN).

Block S2307 sets the EVENT FLAG to "1" indicative of occurrence of an event.

Block S2308 transfers VALUE (DN), indicative of the current output value of the slider of DN, to FVALUE (DN).

Block 2309 increments the device number DN.

Block S2310 checks if DN is greater than 18. In the negative, the process slider routine returns to block S2302 to repeat the process for sliders 17*a* to 17*c*. In the affirmative, the routine return to the flow of FIG. 9.

2-4. Process Encoder

Figure 13:
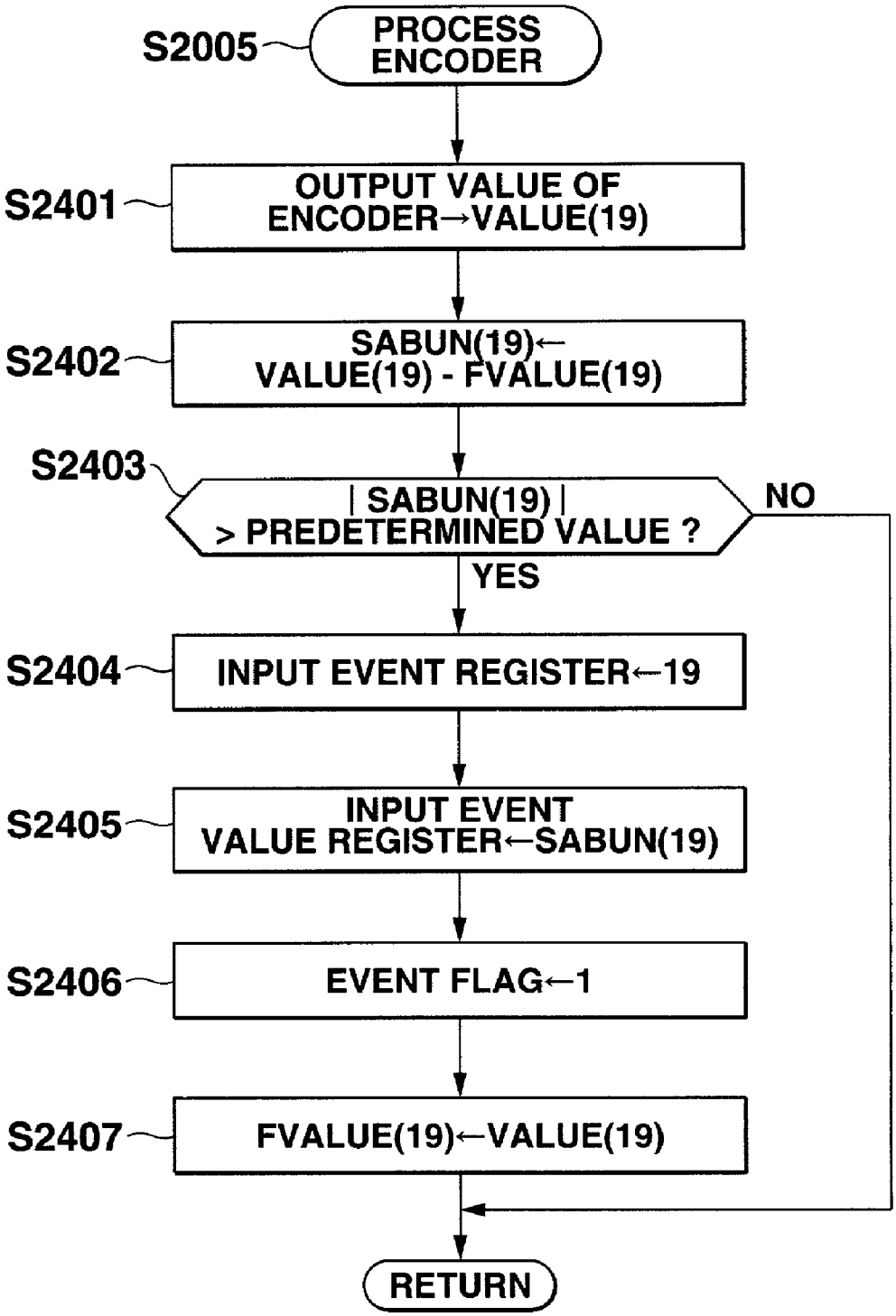
FIG. 13 is a flow chart of a process encoder routine.

FIG. 13 is a flow chart of the process encoder routine. The object of the process encoder routine is to acquire information on operation of the encoder 19. The process encoder routine is similar to the process slider routine.

Block S2401 sets VALUE (19) to the output value of encoder 19.

Block S2402 sets SABUN (19) to a differential value obtained by subtracting FVALUE (19), indicative of the previous output value of the slider, from VALUE (19).

Block S2403 checks if SABUN (19) is greater than a predetermined value. This is the case when the rotary encoder 19 is operated. In the affirmative, block S2404 is executed. In the negative, block S2407 is executed.

Block S2404 sets INPUT EVENT register to "19" i.e., the device number of the encoder 19.

Block S2405 sets INPUT EVENT VALUE register to SABUN (19). Block S2406 sets EVENT FLAG to "1", indicative of occurrence of an event (here, the operation of the encoder 19).

Block S2407 transfers VALUE (19) indicative of the current output value of encoder to FVALUE (19). Then the routine returns to the flow of FIG. 9.

2-5. Perform Song

Figure 14:
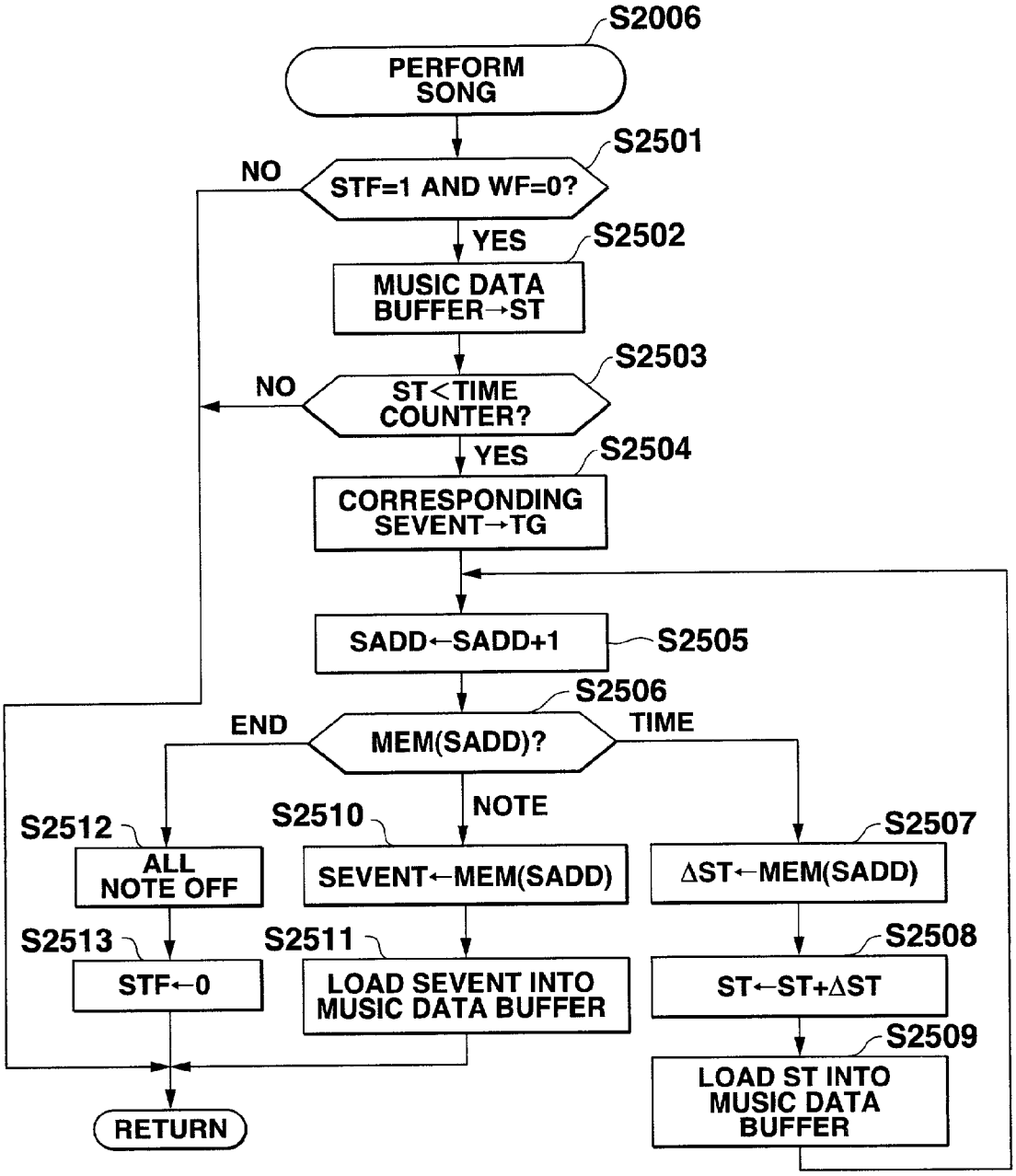
FIG. 14 is a flow chart of a perform song routine.

FIG. 14 is a flow chart of the perform song routine. The object of the perform song routine is to send note data of a song to the tone generator 20, thus performing the song.

Block S2501 checks if music start flag STF is set to "1" or start and if music wait flag WF is reset to "0" or not waiting. In the affirmative, the perform song routine executes block S2502. In the negative, it returns to the flow of FIG. 9. Block S2502 reads ST from the music data buffer, indicative of the timing of the next note event of the song.

Block S2503 checks if the time counter is greater than ST, indicative of the timing of the next note event. In the affirmative, the routine executes block S2504. In the negative, it returns to the flow of FIG. 9.

Block S2504 sends the note event data SEVENT of the song to the tone generator 20, thus generating or releasing the corresponding tone.

Block S2505 increments song address pointer SADD for pointing to song data in ROM 13.

Block S2506 identifies the type of song data at SADD. If it is time data, block S2507 is executed. If it is note event data, block S2510 is executed. If it is an end-of-song code, block S2512 is executed.

Block S2507 sets ΔST to time data MEM (SADD).

Block S2508 adds ΔST to ST.

Block S2509 loads ST into music data buffer. Then the routine returns to block S2505.

Blocks S2510 sets SEVENT to the note event data MEM (SADD).

Block S2511 loads SEVENT into the music data buffer. Then the routine returns to the flow of FIG. 9.

Block S2512 executes all note-off of tones in the tone generator 20.

Block S2513 resets the music start flag STF to "0", indicative of stop music. Then the routine returns to the flow of FIG. 9.

2-6. Perform Accompaniment

Figure 15:
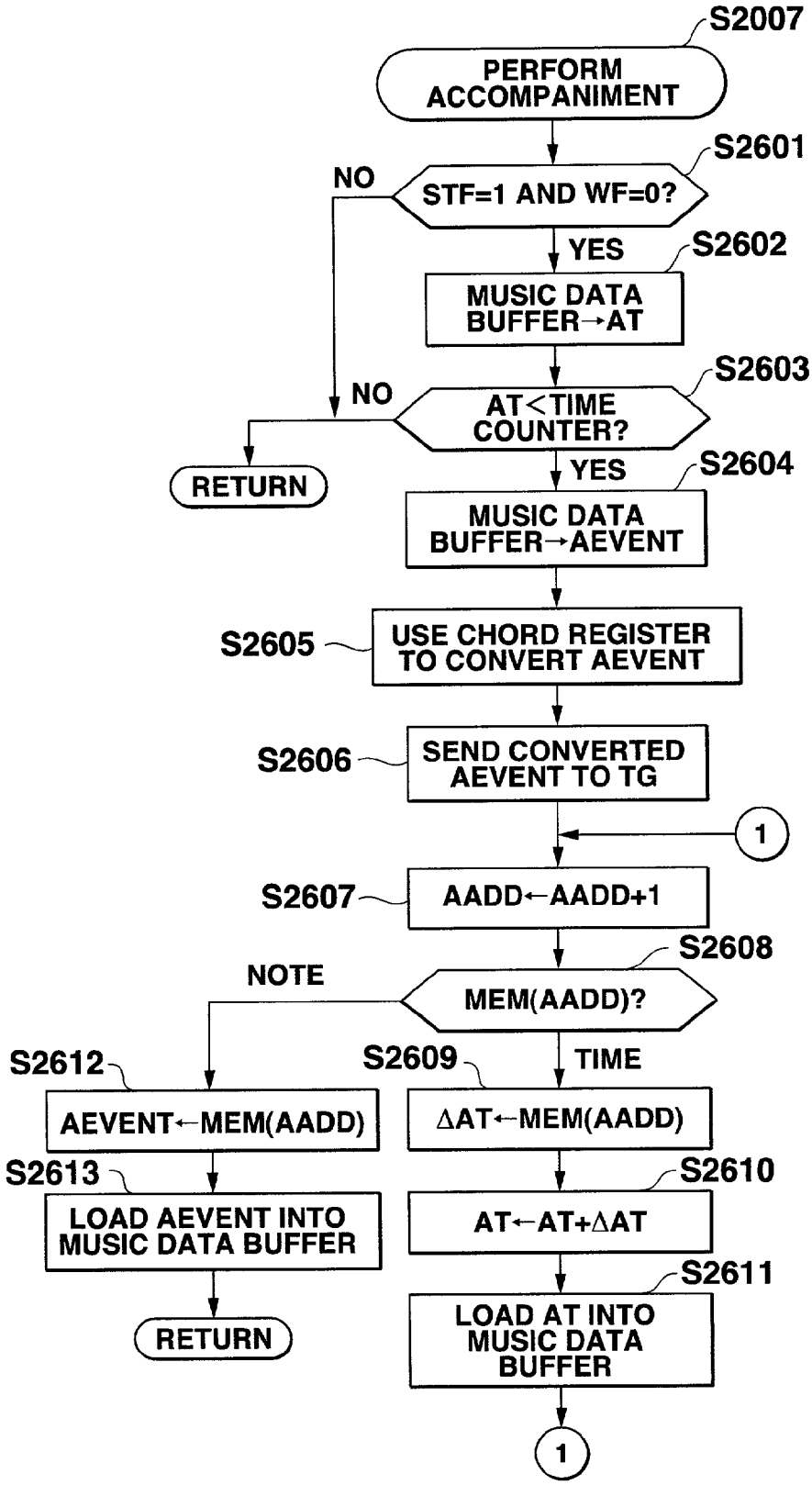
FIG. 15 is a flow chart of a perform accompaniment routine.

FIG. 15 is a flow chart of the perform accompaniment routine. The object of the perform accompaniment routine is to send note data of an accompaniment to the tone generator 20, thus performing the accompaniment. The perform accompaniment routine is similar to the perform song routine.

Block S2601 checks if the music start flag STF is set to "1" indicative of start music, and if the wait flag WF is reset to "0", indicative of not waiting. In the affirmative, the routine executes block S2602. In the negative, it returns to the flow of FIG. 9.

Block S2602 reads AT from the music data buffer, indicative of the timing of the next note event of the accompaniment.

Block S2603 checks if the time counter is greater than AT. In the affirmative, the routine executes block S2604. In the negative, the routine returns to the flow of FIG. 9.

Block S2604 reads note event data AEVENT from the music data buffer.

Block S2605 converts the note event data AEVENT according to CHORD register indicative of a current chord determined in the set tone generator and keyboard routine from the keyboard operation.

Blocks S2606 sends the converted note event data to the tone generator 20, thus generating or releasing the corresponding tone of the accompaniment.

Block S2607 increments the accompaniment data pointer AADD for pointing to accompaniment data in ROM 13.

Block S2608 identifies the type of the accompaniment data MEM (AADD) at AADD. If it is time data, block S2609 is executed. If it is note event data, block S2612 is executed.

Block S2609 sets ΔAT to time data MEM (AADD).

Block S2610 adds ΔAT to AT.

Block S2611 loads the time data AT into the music data buffer. Then, the routine returns to block S2607.

Block S2612 sets AEVENT to note event data MEM (AADD).

Block S2613 loads the note event data AEVENT into the music data buffer. Then, the routine returns to the flow of FIG. 9 thus terminating the timer interrupt routine.

3. Process Specification Data

Figure 16:
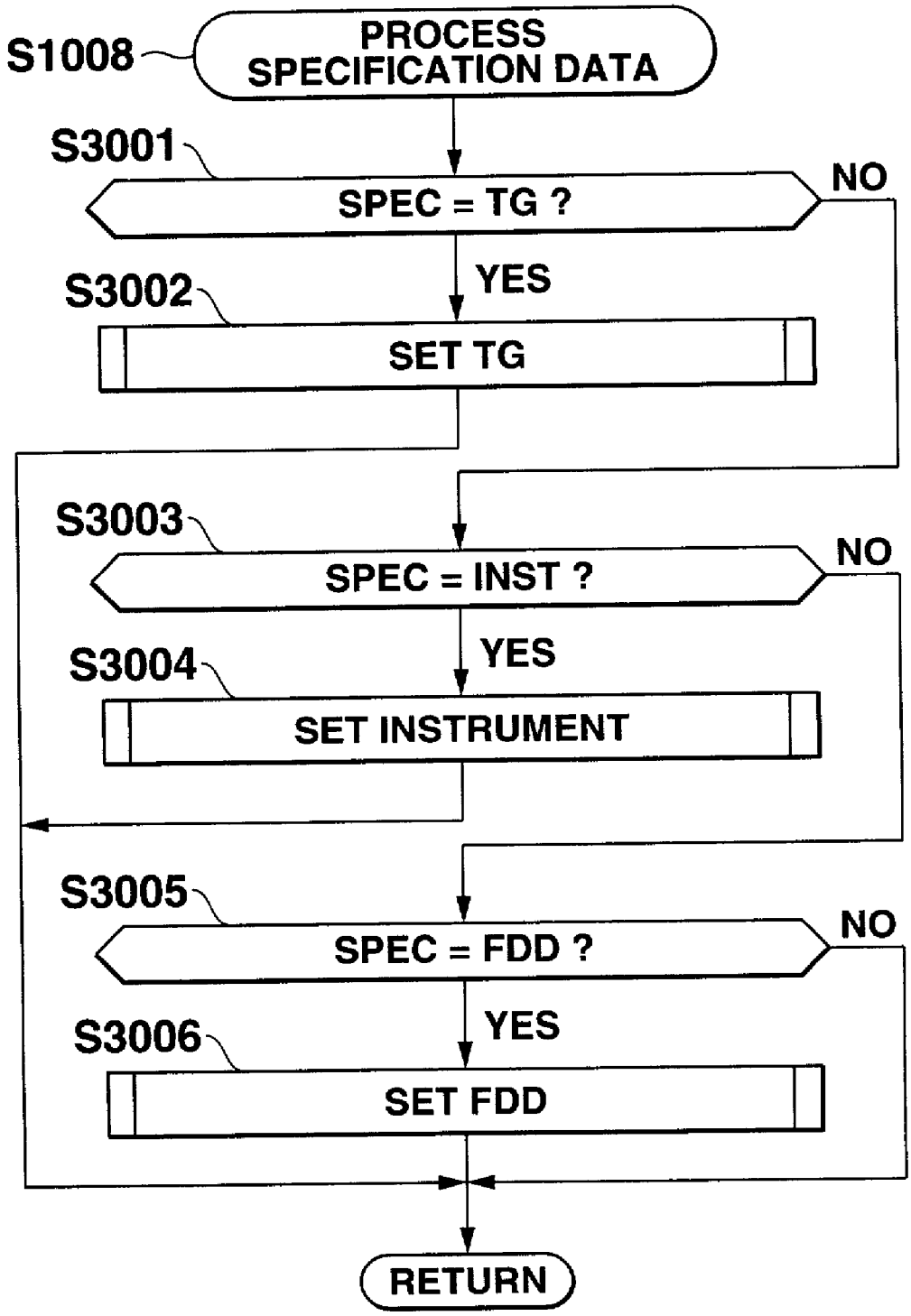
FIG. 16 is a flow chart of a process specification data routine.

The process specification data routine S1008 is now described in more detail. FIG. 16 is a flow chart of the process specification data routine.

As shown in the specification data table in FIGS. 4A–4D, the first item of the specification data in a table cell (except for NOP cell) is one of the three terms of "TG (tone generator)", "INST (instrument)" and "FDD (floppy disk controller)". The process specification data routine S1008 identifies the first item of the specification data in the current table cell read by the block S1007. If the first item of the specification data is TG (YES at block S3001), the routine S1008 calls a set TG routine S3002. If the first item of the specification data is INST (YES at block S3003), the routine S1008 executes a set instrument routine S3004. If the first item of the specification data is FDD (YES at block S3005), the routine S1008 executes a set FDD routine S3006. Then the routine S1008 returns to the flow of FIG. 8.

For a NOP cell, the routine S1008 returns to the flow of FIG. 8 without performing any operation.

The set TG routine S3002, set instrument routine S3004 and set FDD routine S3006 are now described in more detail.

4. Set TG

Figure 17:
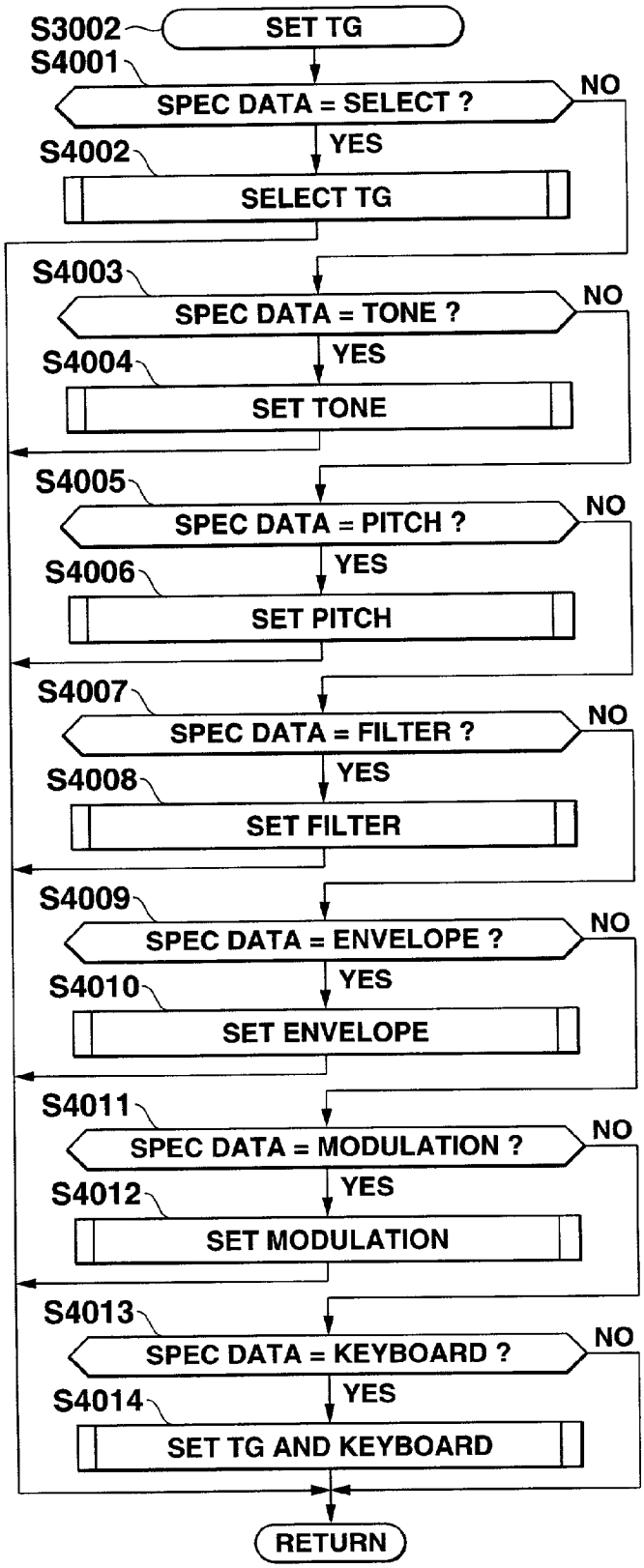
FIG. 17 is a flow chart of a set TG routine.

The object of the set TG routine S3002 is to set parameters of the tone generator 21, such as tone, pitch, and envelope. FIG. 17 is a flow chart of the set TG routine S3002.

According to the specification data table shown in FIGS. 4A–4D, TG specification data (specification data having the first item of TG) has the second item which is one of the seven terms of "SELECT", "TONE", "PITCH", "FILTER", "ENVELOPE", "MODULATION" and "KEYBOARD". The set TG routine S3002 identifies the second item of the TG specification data. Specifically, if the second item of the TG specification data is "SELECT" (YES at block S4001), the set TG routine S3002 calls or executes the select TG routine S4002. If it is "TONE" (YES at block S4003), the routine S3002 executes the set tone routine S4004. If it is "PITCH" (YES at block S4005), the routine S3002 executes the set pitch routine S4006. If it is "FILTER" (YES at block S4007), the routine S3002 executes the set filter routine S4008. If it is "ENVELOPE" (YES at block S4009), the routine S3002 executes the set envelope routine S4010. If it is "MODULTION" (YES at block S4011), the routine S3002 executes the set modulation routine S4012. If it is "KEYBOARD" (YES at block S4013), the routine S3002 executes the set TG and keyboard routine S4014.

Details of the select TG routine S4002, the set tone routine S4004, the set pitch routine S4006, the set filter routine S4008, the set envelope routine S4010, the set modulation routine S4012 and the set TG and keyboard routine S4014 are now described in more detail.

4-1. Select TG

The object of the select TG routine S4002 is to select a parameter of the tone generator 20 and set the value of the selected parameter based on the operation of the encoder 19.

Figure 18:
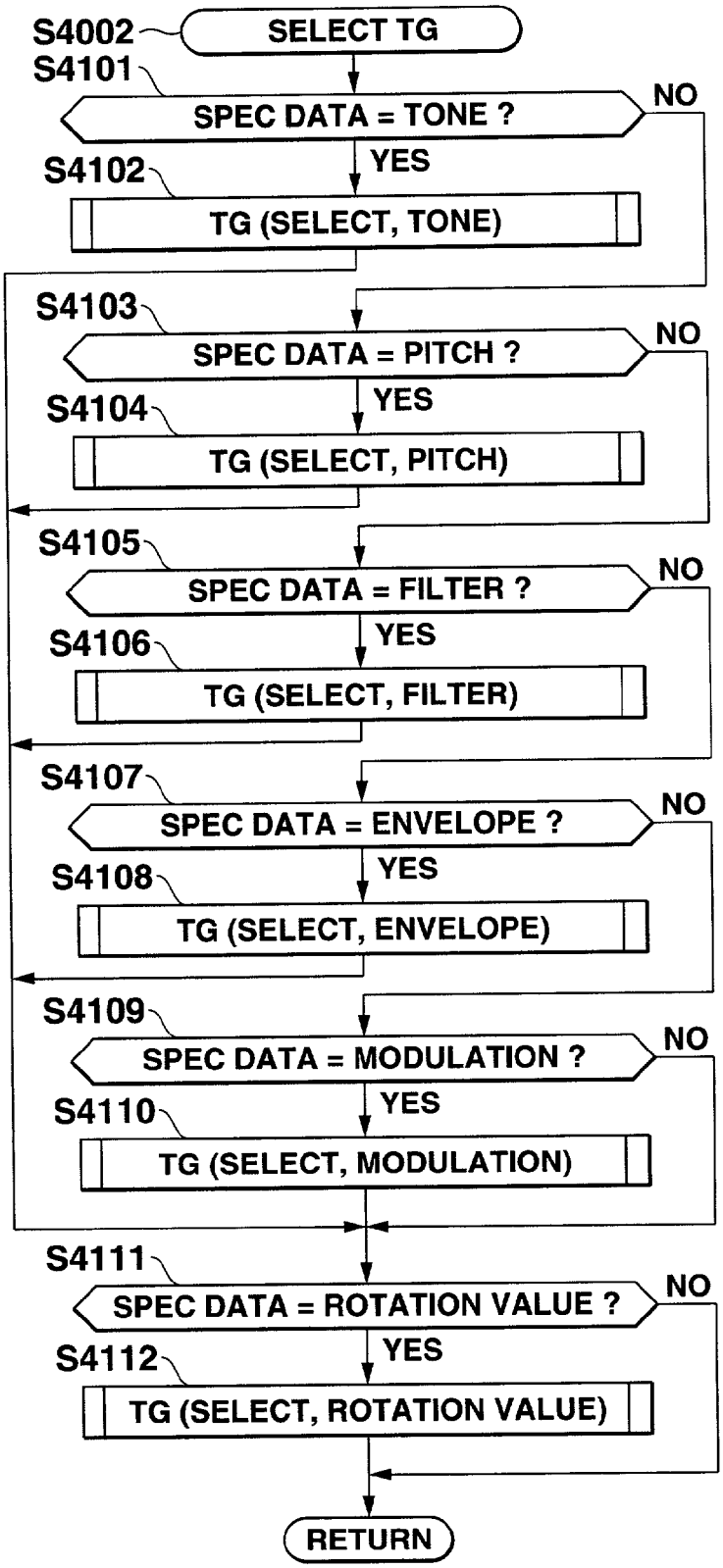
FIG. 18 is a flow chart of a select TG routine.

FIG. 18 is a flow chart of the select TG routine S4002. Details of blocks S4102, S4104, S4106, S4108 and S4110 are shown in FIGS. 19A–19E.

According to the specification data table shown in FIGS. 4A–4D, TG (SELECT, ) specification data (specification data having the first data item "TG" and second data item "SELECT") has the third data item which is one of the six terms of "TONE", "PITCH", "FILTER", "ENVELOPE", "MODULATION" and "ROTATION VALUE". The select TG routine S4002 checks and identifies the third data item of TG select specification data.

Figure 19A:
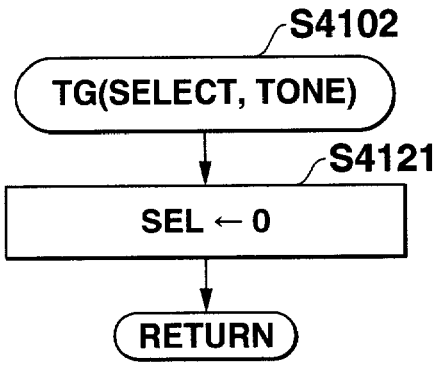
FIGS. 19A–E are flow charts of TG (SELECT, TONE), TG (SELECT, PITCH), TG (SELECT, FILTER), TG (SELECT, ENVELOPE) and TG (SELECT, MODULATION) routines in FIG. 18.
Figure 19D:
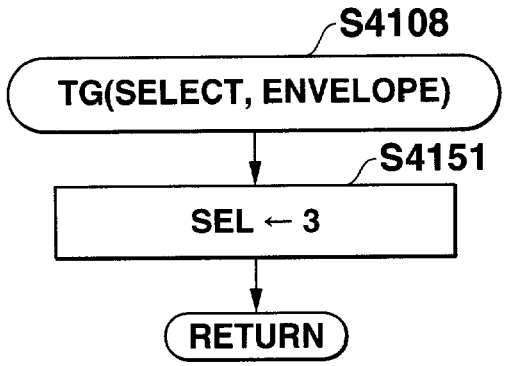

Specifically, if the third data item of TG (SELECT, ) specification data is "TONE" (YES at block S4101), the routine S4002 calls or executes the TG (SELECT, TONE) routine S4102 to set a variable SEL to "0" indicative of tone, as shown in S4121 in FIG. 19A.

Figure 19B:
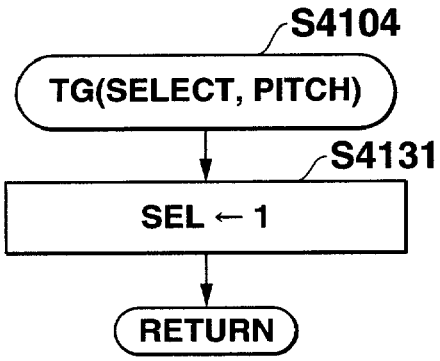
Figure 19E:
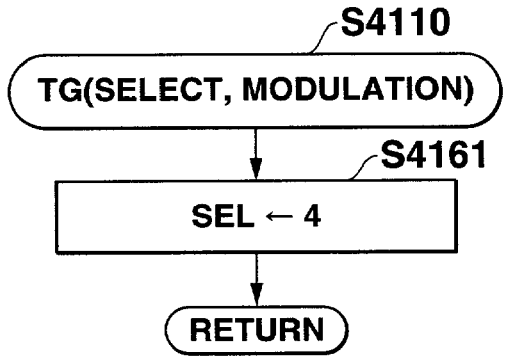

If the third data item is "PITCH" (YES at block S4103), the routine S4002 executes the TG (SELECT, PITCH) routine S4104 to set SEL to "1" indicative of pitch, as shown in S4131 in FIG. 19B. If the third data item is "FILTER"

Figure 19C:
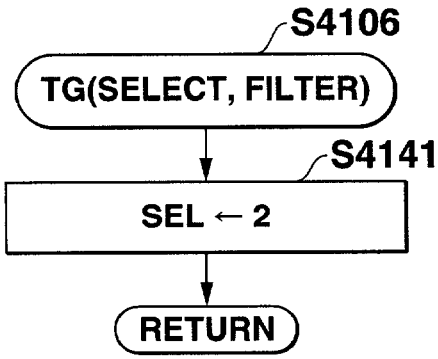

(YES at block S4105), the routine S4002 executes the TG (SELECT, FILTER) routine S4105 to set SEL to "2" indicative of filter, as shown in S4141 in FIG. 19C. If the third data item is "ENVELOPE" (YES at block S4107), the routine S4002 executes the TG (SELECT, ENVELOPE) routine S4108 to set SEL to "3" indicative of envelope, as shown in S4151 in FIG. 19D. If the third data item is "MODULATION" (YES at block S4109), the routine S4002 executes the TG (SELECT, MODULATION) routine S4110 to set SEL to "4" indicative of modulation, as shown in S4161 in FIG. 19E.

After the routine S4102, S4104, S4106, S4108 or S4110, or when each check block S4101, S4103, S4105, S4107, S4109 finds negative, the check block S4111 is executed to check if the third data item of TG (SELECT, ) specification data is "ROTATION VALUE". In the affirmative, the routine S4002 executes the TG (SELECT, ROTATION VALUE) routine S4112. Then, or in the negative, the routine S4002 returns to the flow of FIG. 17.

Figure 20:
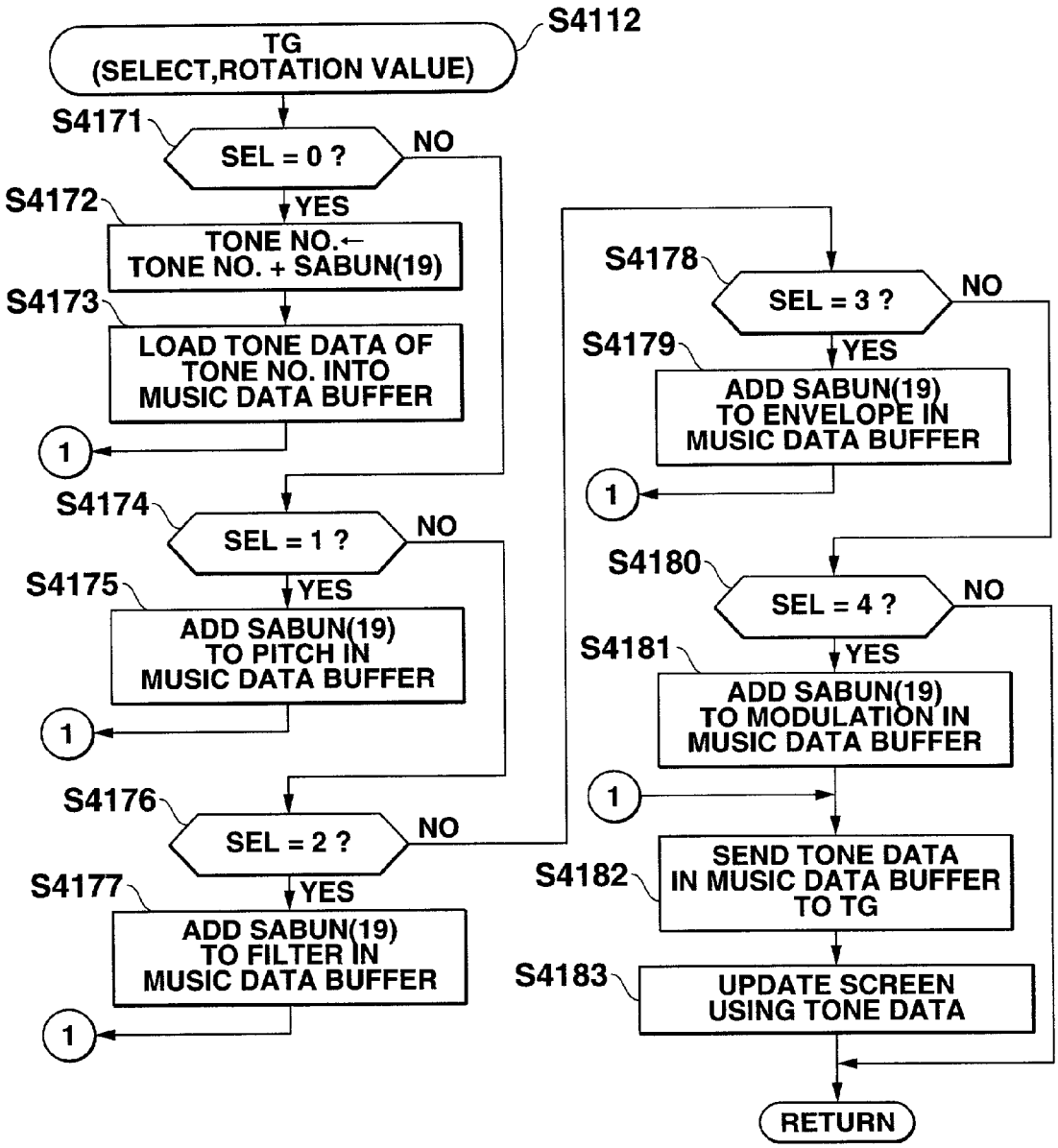
FIG. 20 is a flow chart of TG (SELECT, ROTATION VALUE) routine.

FIG. 20 is a flow chart of the TG (SELECT, ROATION VALUE) routine S4112.

Block S4171 checks if SEL is set to "0", meaning that the selected TG parameter is "TONE". In the affirmative, block S4172 is executed. In the negative, block S4174 is executed.

Block S4172 updates the tone number TONE NO. by adding SABUN(19), indicative of the operation value of the encoder 19, to TONE NO.

Block S4173 loads tone data of the tone number TONE NO. from ROM 13 into the tone data buffer in RAM 14. Then block S4182 is executed.

Block S4174 checks if SEL is set to "1", meaning that the selected TG parameter is "PITCH". In the affirmative, block S4175 updates the reference pitch PITCH by adding SABUN (19) to PITCH. Then, block S4182 is executed. In the negative, check block S4176 is executed.

Similarly, block S4176 checks if SEL is set to "2" to see whether the selected TG parameter is "FILTER". In the affirmative, the routine S4112 executes block S4177 to update filter FILTER in the tone data buffer by adding SABUN (19) to FILTER before executing block S4182.

In the negative, block S4178 checks if SEL is set to "3" to see whether the selected TG parameter is "ENVELOPE". In the affirmative, the routine S4112 executes block S4179 to update envelope ENVELOPE in the tone data buffer by adding SABUN (19) to ENVELOPE before executing block S4182.

In the negative, block S4180 checks if SEL is set to "4" to see whether the selected TG parameter is "MODULATION". In the affirmative, block S4181 updates modulation MODULATION in the tone data buffer by adding SABUN (19) to MODULATION before executing block S4182.

Block S4182 sends contents of the tone data buffer to the tone generator 20.

Block S4183 updates the change TG parameter screen (FIG. 3E) on LCD 15 according to the contents of the tone data buffer.

Then, the routine S4112 returns to the flow of FIG. 18.

4-2. Set Tone

The object of the set tone routine is to set tone TONE of the tone generator 20 based on operation of slider 17 or switch 18. According to the specification data table shown in FIGS. 4A–4D, the specification data of the slider 17*a*, switch 18*k* and 18*n* in the state row of change TG parameter are TG (TONE, VALUE), TG (TONE, ADD) and TG (TONE, SUBTRACT), respectively. In other words, TG (TONE, ) specification data (i.e., specification data having the first item "TG" and second item "TONE") has the third item which is one of the three terms of "ADD", "SUBTRACT" and "VALUE".

Figure 21:
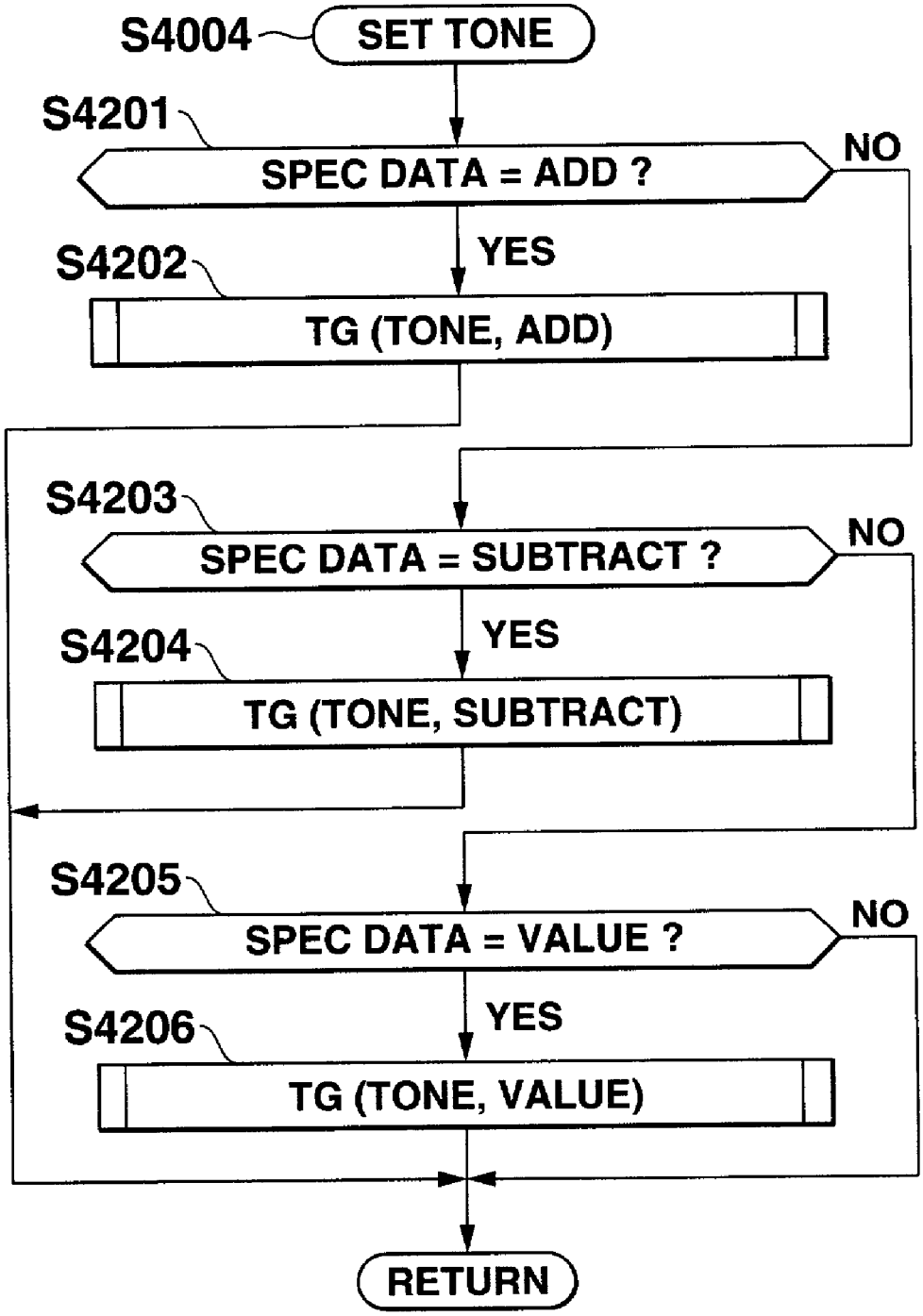
FIG. 21 is a flow chart of a set tone routine.

FIG. 21 is a flow chart of the set tone routine S4004 which is called when TG (TONE, ) specification data is found. The set tone routine identifies the third item of TG (TONE, ) specification data and performs a corresponding process.

Specifically, if the third item of TG (TONE, ) specification data is "ADD" (YES at block S4201), TG (TONE, ADD) routine S4202 is called. If it is "SUBTRACT" (YES at block S4203), TG (TONE, SUBTRACT) routine S4204 is executed. If it is "VALUE" (YES at block S4205), TG (TONE, VALUE) routine S4206 is executed.

Figure 22A:
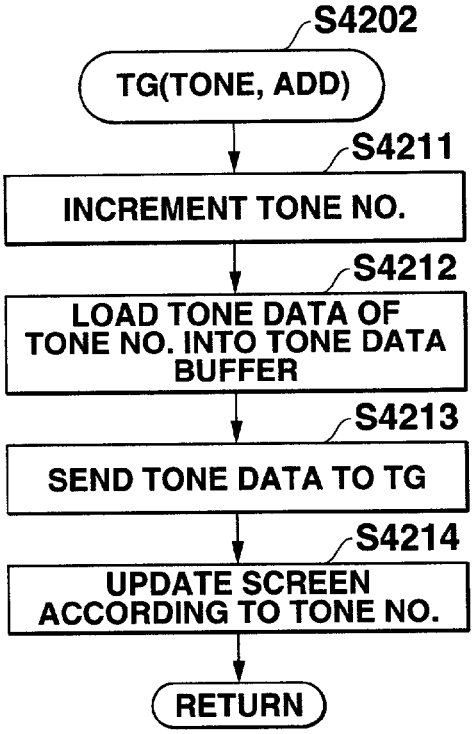
FIGS. 22A–C are flow charts of TG (TONE, ADD), TG (TONE, SUBTRACT) and TG (TONE, VALUE) routines in FIG. 21.
Figure 22C:
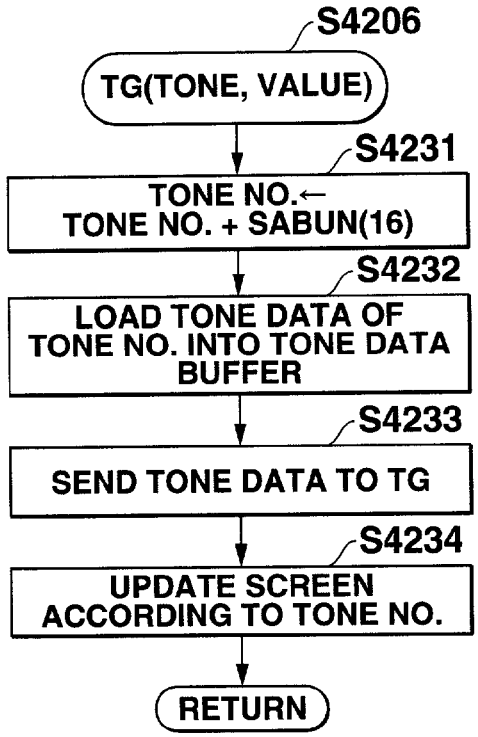
Figure 22B:
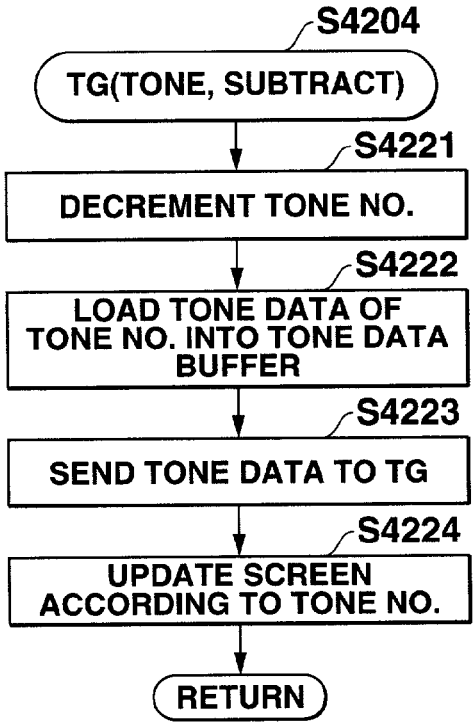

Details of TG (TONE, ADD) routine S4202, TG (TONE, SUBTRACT) routine S4204 and TG (TONE, VALUE) routine S4206 are shown in FIGS. 22A–22C.

In TG (TONE, ADD) routine S4202 of FIG. 22A, block S4211 increments tone number TONE NO. in RAM 14 by one.

Block S4212 loads tone data of TONE NO. from ROM 13 into the tone data buffer in RAM 14.

Block S4213 sends contents of the tone data buffer to the tone generator 20.

Block S4214 updates the change TG parameter screen (FIG. 3E) on LCD 15 according to TONE NO.

In TG (TONE, SUBTRACT) routine S4204 of FIG. 22B, block S4221 decrements tone number TONE NO. in RAM 14 by one. The remaining blocks S4222–4224 correspond to blocks S4212–4214 in FIG. 22A.

In TG (TONE, VALUE) routine S4206 of FIG. 22C, block S4231 updates the tone number TONE NO. by adding SABUN (16) to TONE NO. The remaining blocks S4232–S4234 are identical with blocks S4212–S4214 in FIG. 22A.

4-3. Set Pitch

The object of the set pitch routine S4006 (FIG. 17) is to set a reference pitch of the tone generator 20 based on operation of the slider 17 or switch 18. According to the specification data table shown in FIGS. 4A–4D, specification data of switch 181, switch 18*o* and slider 17*b* in the state row of change TG parameter are TG (PITCH, ADD), TG (PITCH, SUBTRACT) and TG (PITCH, VALUE), respectively. In other words, TG (PITCH, ) specification data (specification data having the first item "TG" and second item "PITCH") has the third item which is one of the three terms "ADD", "SUBTRACT" and "VALUE".

Figure 23:
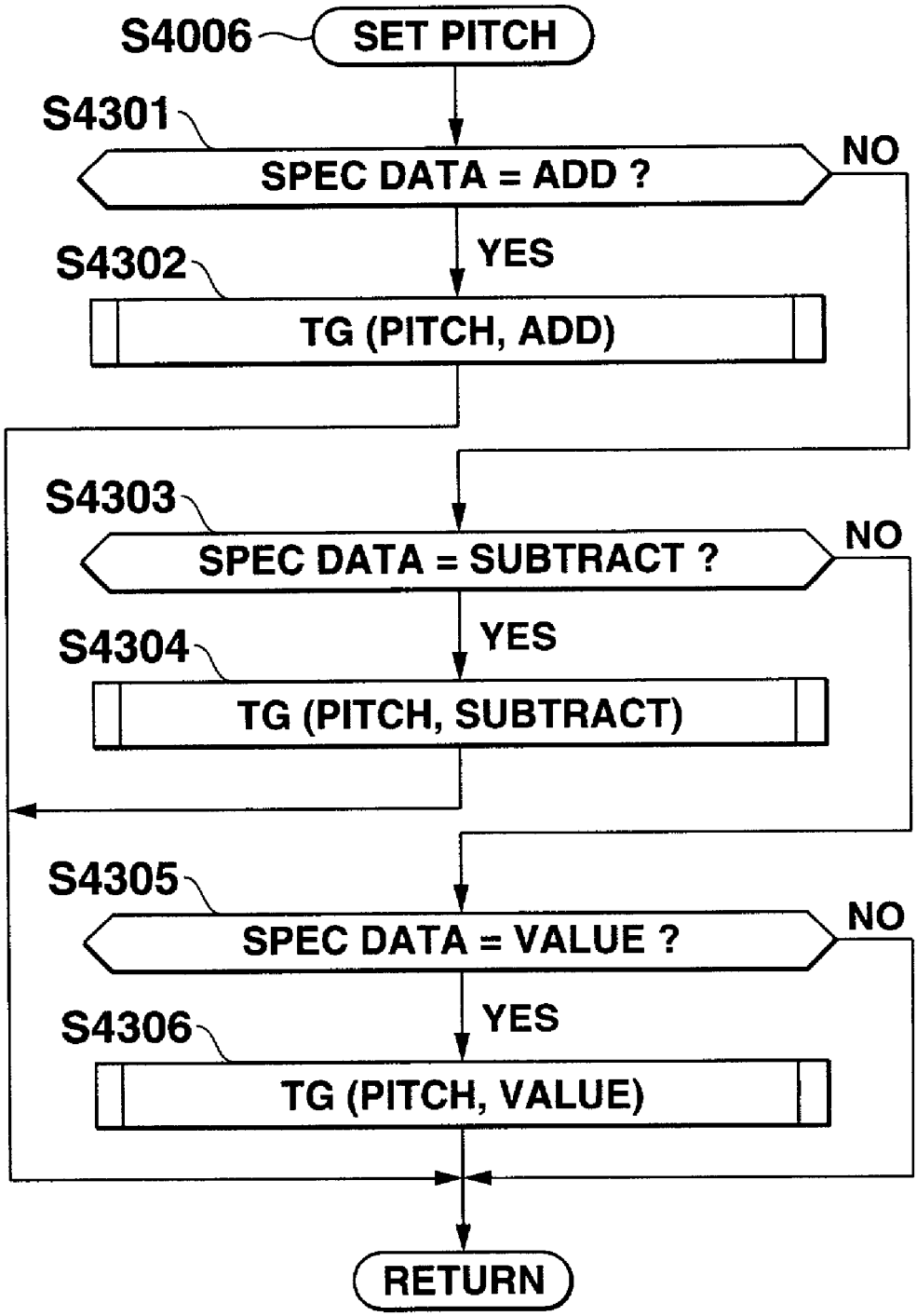
FIG. 23 is a flow chart of a set pitch routine.

FIG. 23 is a flow chart of the set pitch routine S4006 which is called when TG (PITCH, ) specification data is found. The set pitch routine S4006 is similar to the set tone routine S4004. Check blocks S4301, S4303 and S4305 checks the third item of TG (PITCH, ) specification data to identify specification data of TG (PITCH, ADD), TG (PITCH, SUBTRACT) or TG (PITCH, VALUE). Based on the identified specification data, a corresponding one of TG (PITCH, ADD) routine S4302, TG (PITCH, SUBTRACT) routine S4304 and TG (PITCH, VALUE) routine S4306 is executed.

Figure 24A:
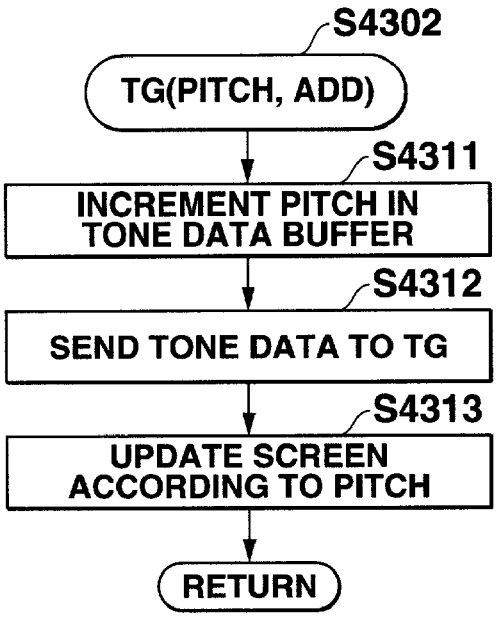
FIGS. 24A–C are flow charts of TG (PITCH, ADD), TG (PITCH, SUBTRACT) and TG (PITCH, VALUE) routines in FIG. 23.
Figure 24C:
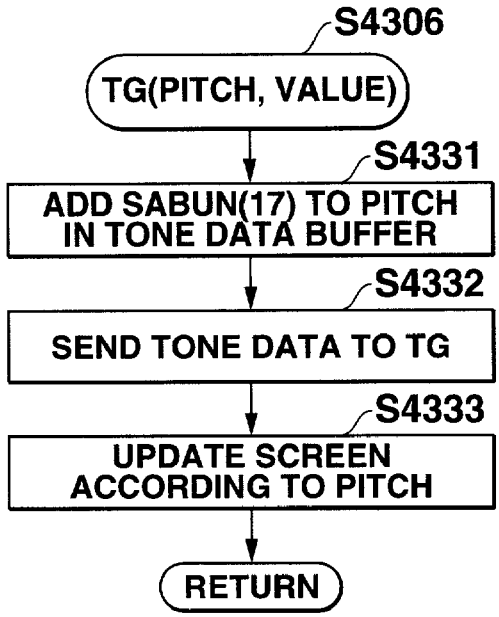
Figure 24B:
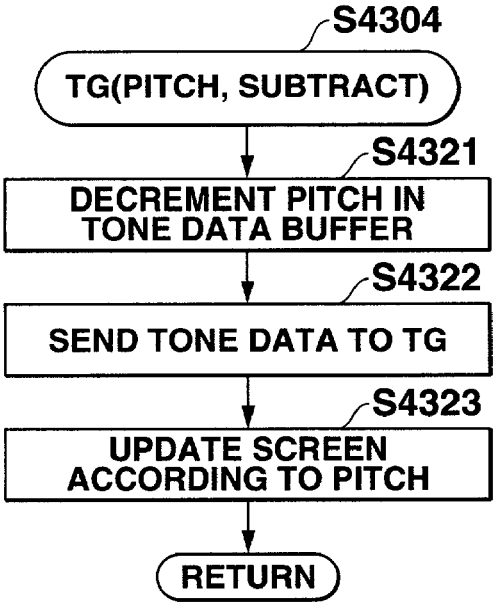

Details of the routines S4302, S4304 and S4306 are shown in FIGS. 24A–24C.

In TG (PITCH, ADD) routine S4302 shown in FIG. 24A, block S4311 increments reference pitch PITCH in the tone data buffer in RAM 14. Block S4312 sends contents of the tone data buffer to the tone generator 20. Block S4313 updates the change TG parameter screen (FIG. 3E) on LCD 15 according to PITCH.

In TG (PITCH, SUBTRACT) routine S4304 of FIG. 24B, block S4321 decrements the reference pitch PITCH in the tone data buffer. The remaining blocks S4322 and S4323 are identical with blocks S4312 and S4313 in FIG. 24A. In TG (PITCH, VALUE) routine S4306 of FIG. 24C, block S4331 updates the reference pitch PITCH by adding SABUN (17) to PITCH. The remaining blocks S4332 and S4333 are identical with blocks S4312 and S4313 in FIG. 24A.

4-4. Set Filter

The object of the set filter routine S4008 (FIG. 17) is to set filter property of the tone generator 20 based on operation of slider 17 or switch 18. According to the specification data table shown in FIGS. 4A–4D, specification data of switch 18*m*, switch 18*p* and slider 17*c* in the state row of change TG parameter are TG (FILTER, ADD), TG (FILTER, SUBTRACT) and TG (FILTER, VALUE), respectively. In other words, TG (FILTER, ) specification data (specification data having the first item "TG" and second item "FILTER") has the third item which is one of the three terms "ADD", "SUBTRACT" and "VALUE".

Figure 25:
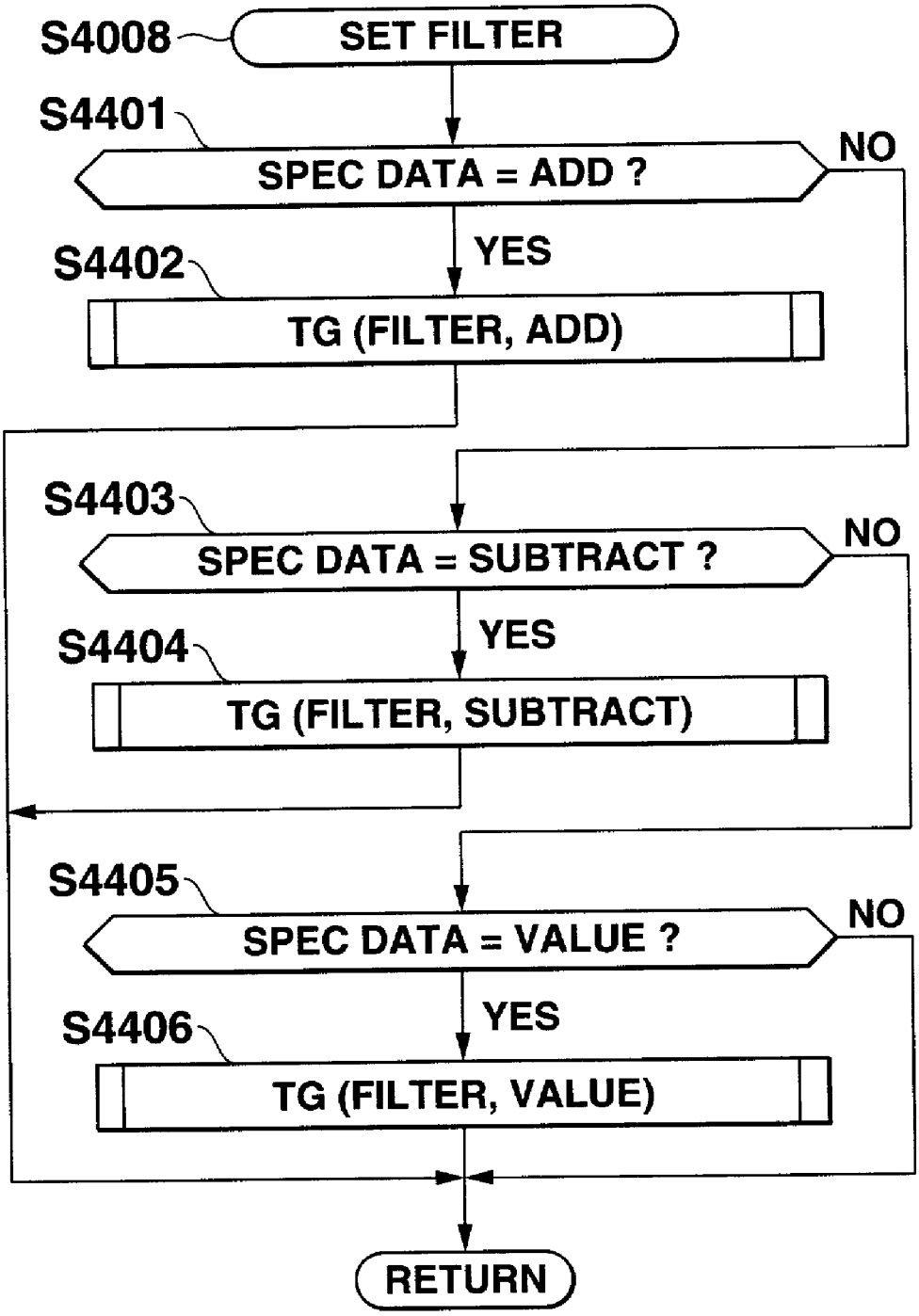
FIG. 25 is a flow chart of a set filter routine.

FIG. 25 is a flow chart of the set filter routine S4008 which is called when TG (FILTER, ) specification data is found. The set filter routine S4008 is similar to the set pitch routine shown in FIG. 23. Check blocks S4401, S4403 and S4405 identify the third or last item of TG (FILTER, ) specification data, thus identifying the complete specification data which is TG (FILTER, ADD), TG (FILTER, SUBTRACT) or TG (FILTER, VALUE). Based on the identified specification data, a corresponding one of TG (FILTER, ADD) routine S4402, TG (FILTER, SUBTRACT) routine S4404 and TG (FILTER, VALUE) routine S4406 is executed.

Figure 26A:
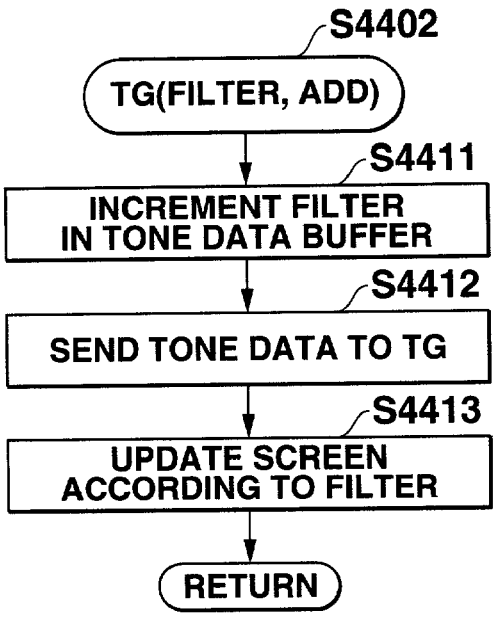
FIGS. 26A–C are flow charts of TG (FILTER, ADD), TG (FILTER, SUBTRACT) and TG (FILTER, VALUE) routines in FIG. 25.
Figure 26C:
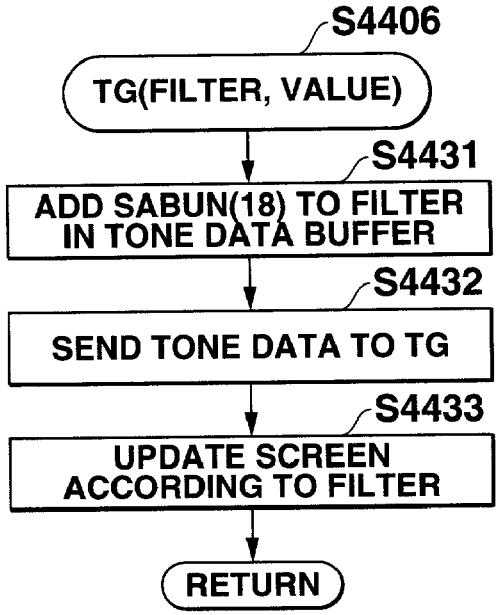
Figure 26B:
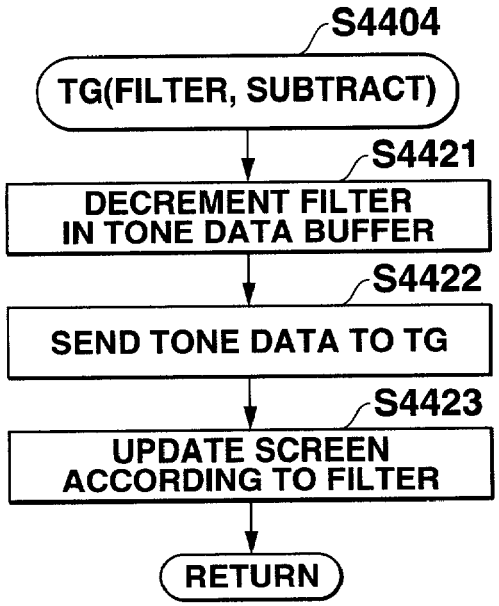

Details of the routine S4402, S4404 and S4406 are shown in FIGS. 26A–26C.

In TG (FILTER, ADD) routine S4402 of FIG. 26A, block S4411 increments filter FILTER in the tone data buffer. Block S4412 sends contents of the tone data buffer to the tone generator 20. Block S4413 updates the change TG parameter screen (FIG. 3E) according to FILTER. In TG (FILTER, SUBTRACT) routine S4403 of FIG. 26B, block S4412 decrements FILTER. The remaining blocks S4422 and S4423 are identical with blocks S4412 and S4413. In TG (FILTER, VALUE) routine of FIG. 26C, block S4431 updates FILTER by adding SABUN to FILTER. The remaining blacks S4432 and S4433 are identical with blocks S4412 and S4413.

4-5. Set Envelope

The object of the set envelope routine S4010 (FIG. 17) is to set tone envelope property of the tone generator 20 based on operation of slider 17 or switch 18.

According to the specification data table shown in FIGS. 4A–4D, specification data of switch 181, switch 18*o* and slider 17*b* in the state row of stop auto performance are TG (ENV, ADD), TG (ENV, SUBTRACT) and TG (ENV, VALUE), respectively. In other words, TG (ENV, ) specification data (specification data having the first item "TG" and second item "ENVELOPE") has the third item which is one of the three terms "ADD", "SUBTRACT" and "VALUE".

Figure 27:
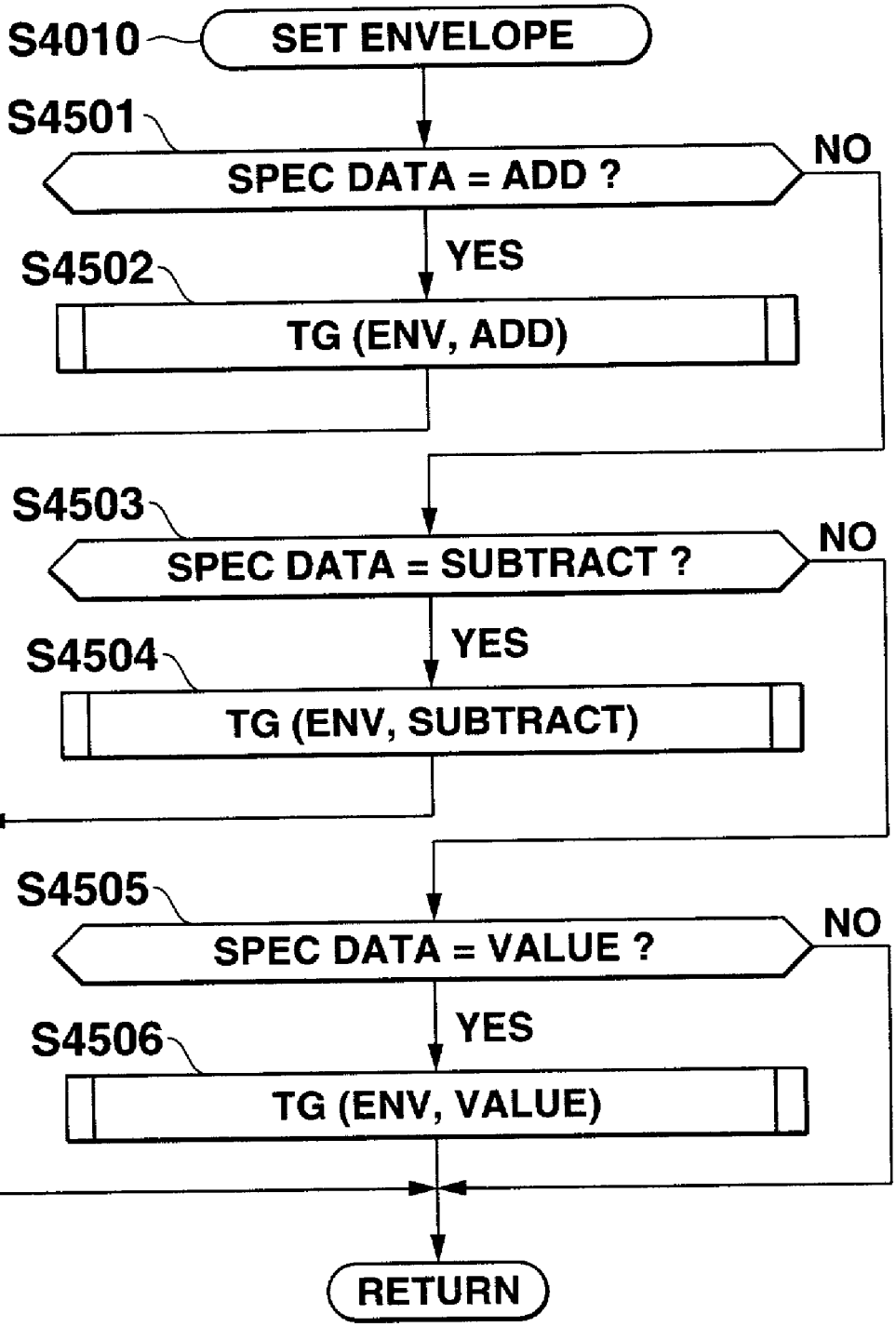
FIG. 27 is a flow chart of a set envelope routine.

FIG. 27 is a flow chart of the set envelope routine S4010 which is called when TG (INVELOPE, ) specification data is found. Each check block S4501, S4503, S4505 identifies the third item of TG (ENVELOPE, ) specification data, thus identifying complete specification data TG (ENV, ADD), TG (ENV, SUBTRACT) or TG (ENV, VALUE). Based on the identified specification data, a corresponding one of TG (ENV, ADD) routine S4502, TG (ENV, SUBTRACT) routine S4504 and TG (ENV, VALUE) S4506 is executed.

Figure 28A:
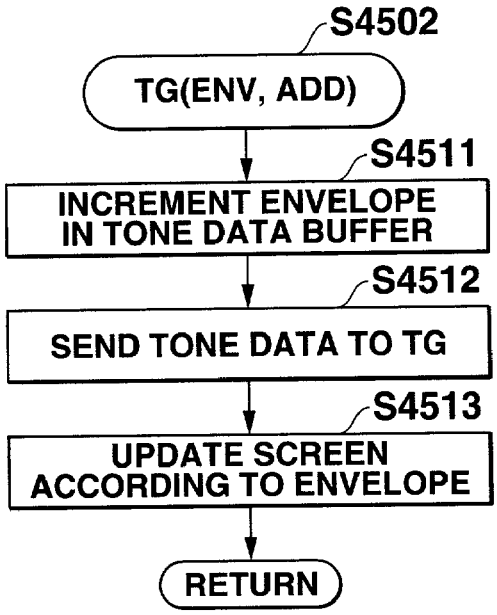
FIGS. 28A–C are flow charts of TG (ENV, ADD), TG (ENV, SUBTRACT) and TG (ENV, VALUE) routines in FIG. 27.
Figure 28C:
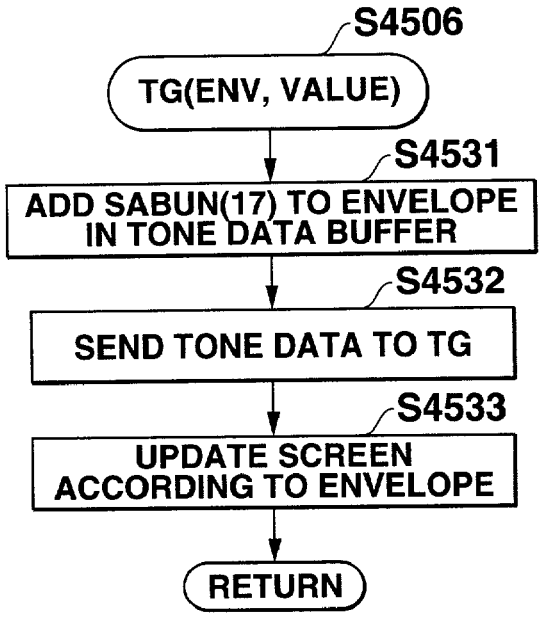
Figure 28B:
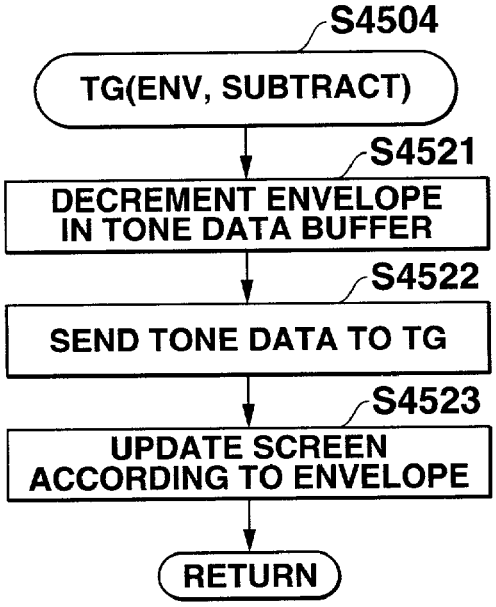

Details of the routine S4502, S4504 and S4506 are shown in FIGS. 28A–28C.

In TG (ENV, ADD) routine S4502 of FIG. 28A, black S4511 increments tone envelope ENVELOPE in the tone data buffer. Block S4512 sends contents of the tone data buffer to the tone generator 20. Block S4513 updates the change TG parameter screen according to INVELOPE. In TG (ENV, SUBTRACT) routine S4504 of FIG. 28B, block S4521 decrements ENVELOPE in the tone data buffer. The remaining blocks S4522 and S4523 are identical with blocks S4512 and S4513 in FIG. 28A. In TG (ENV, VALUE) routine S4506 of FIG. 28C, block S4531 updates ENVELOPE by adding SABUN (17) to envelope. The remaining blocks S4532 and S4533 are identical with blocks S4512 and S4513 in FIG. 28A.

4-6. Set Modulation

The object of the set modulation routine S4012 (FIG. 17) is to set tone modulation depth MODULATION of the tone generator 20 based on operation of slider 17 or switch 18. According to the specification data table shown in FIGS. 4A–4D, specification data of switch 18*m*, switch 18*p* and slider 17*c* in the state row of stop auto performance are TG (MOD, ADD), TG (MOD, SUBTRACT) and TG (MOD, VALUE). In other words, TG (MOD, ) specification data (i.e., specification data having the first item "TG" and second item "MOD") has the third item which is one of the three terms "ADD", "SUBTRACT" and "VALUE".

Figure 29:
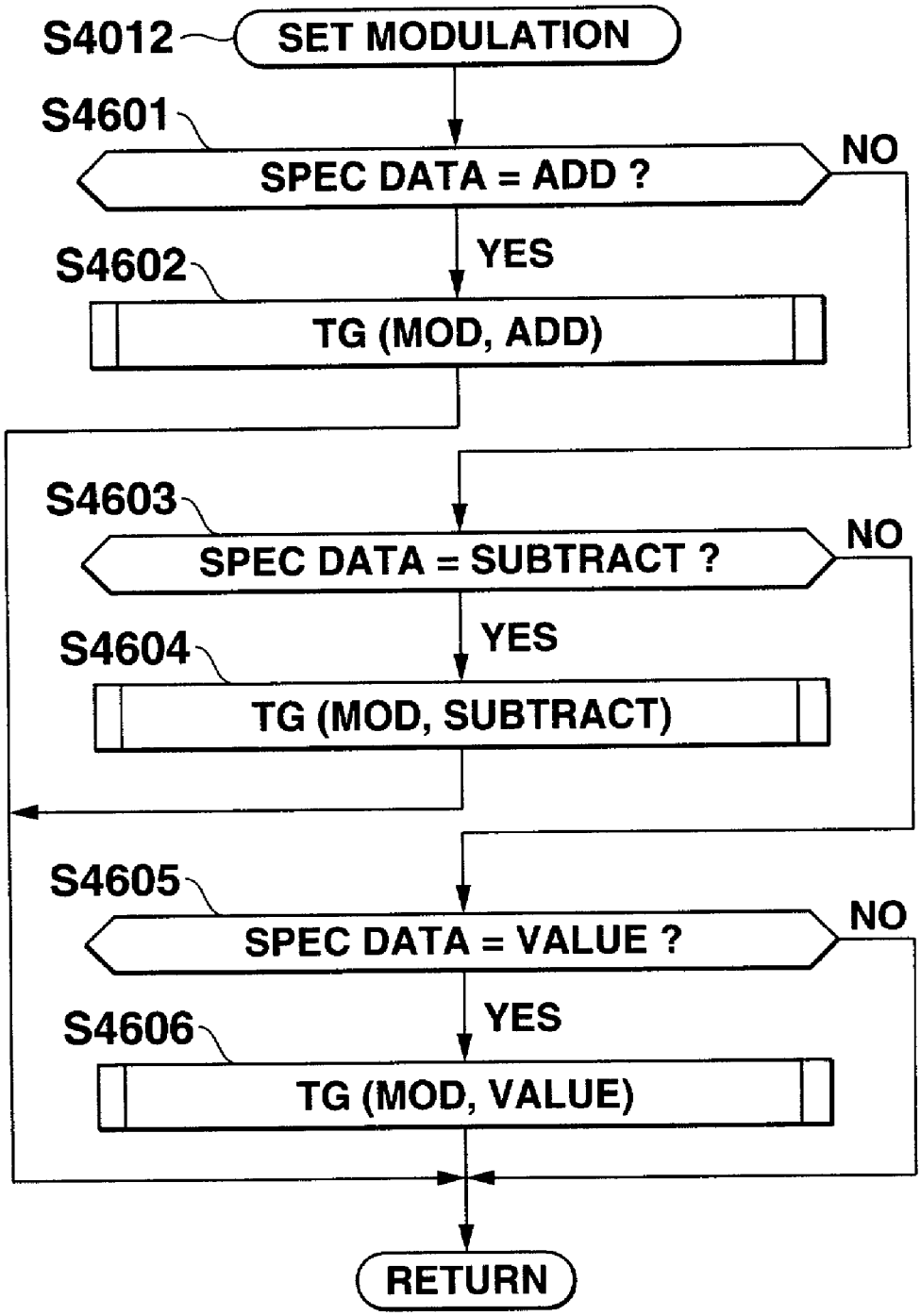
FIG. 29 is a flow chart of a set modulation routine.

FIG. 29 is a flow chart of the set modulation routine S4012 which is called when TG (MOD, ) specification data is found. Each check block S4601, S4603, S4605 identifies the third item of TG (MOD, ) specification data, thus identifying complete specification data TG (MOD, ADD), TG (MOD, SUBTRACT) or TG (MOD, VALUE). Based on the identified specification data, a corresponding one of TG (MOD, ADD) routine S4602, TG (MOD, SUBTRACT) routine S4604 and TG (MOD, VALUE) routine S4606 is executed.

Figure 30A:
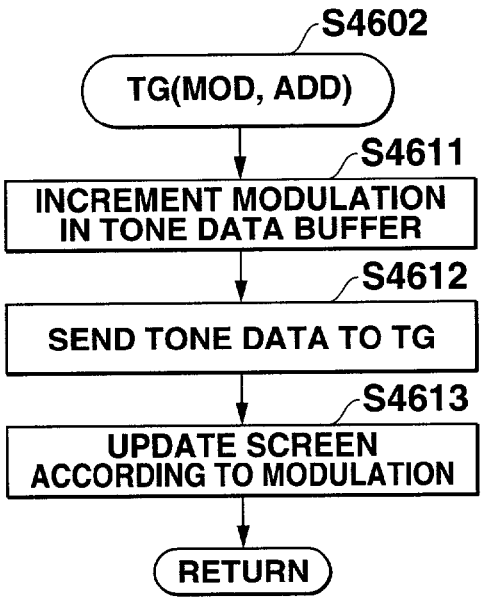
FIGS. 30A–C are flow charts of TG (MOD, ADD), TG (MOD, SUBTRACT) and TG (MOD, VALUE) routines in FIG. 29.
Figure 30C:
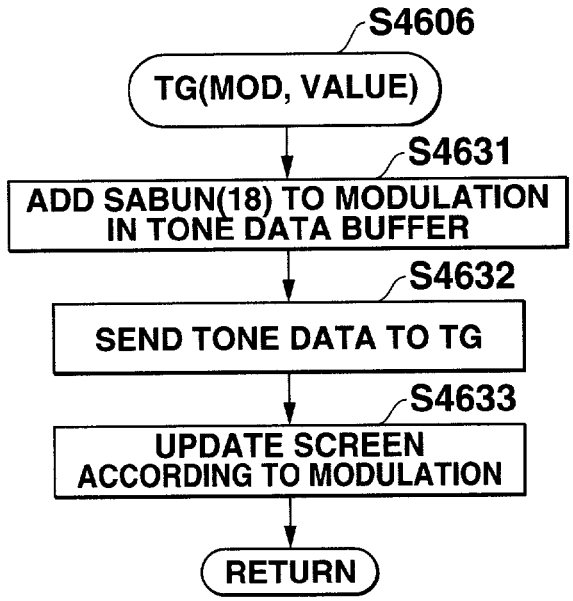
Figure 30B:
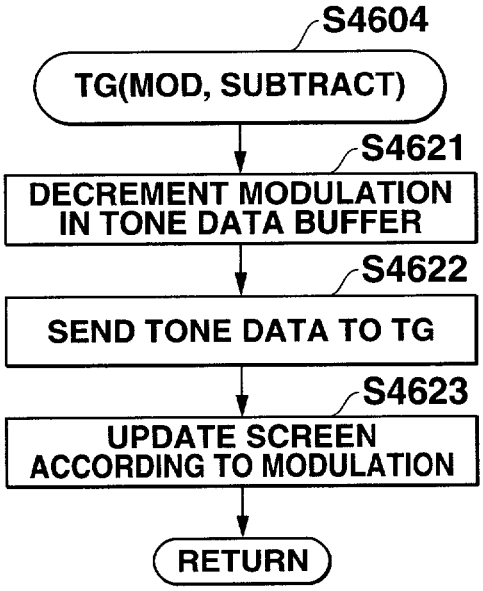

Details of the routines S4602, S4604 and S4606 are shown in FIGS. 30A–30C.

In TG (MOD, ADD) routine S4602 of FIG. 30A, block S4611 increments tone modulation depth MODULATION in the tone data buffer. Block S4612 sends contents of the tone data buffer to the tone generator 20. Block S4613 updates the change TG parameter screen according to MODULATION. In TG (MOD, SUBTRACT) routine S4604 of FIG. 30B, block S4621 decrements MODULATION in the tone data buffer. In TG (MOD, VALUE) routine S4606 of FIG. 30C, block S4632 updates MODULATION in the tone data buffer by adding SABUN (18) to MODULATION. The remaining blocks S4622 and S4623 in FIG. 30B and the remaining blocks S4632 and S4633 in FIG. 30C are identical with blocks S4612 and S4613 in FIG. 30A.

4-7. Set TG and Keyboard

The object of the set TG and keyboard routine S4014 is to determine a chord or control the tone generator 20 based on information on the operation of the keyboard 21, acquired by the process keyboard routine.

The set TG and keyboard routine S4014 is called when TG (KEYBOARD) specification data (i.e., specification data having the first item "TG" and second item "KEYBOARD") is found. According to the specification data table shown in FIGS. 4A–4D, TG (KEYBOARD) specification data is assigned to keyboard operation in the instrument state "initial screen", "stop auto performance", "run auto performance", "change TG parameter", or "change performance parameter".

Figure 31:
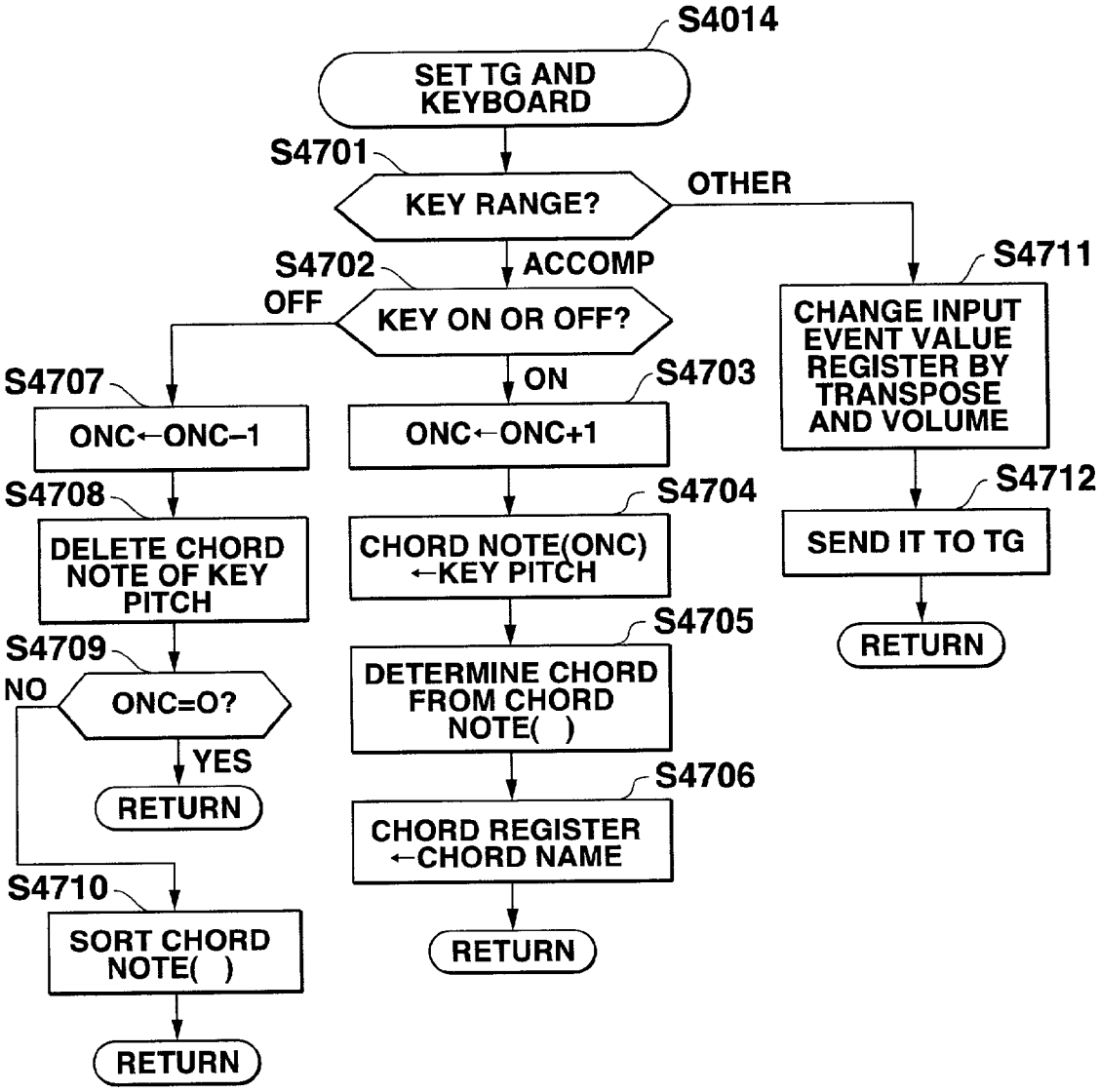
FIG. 31 is a flow chart of a set TG and keyboard routine.

FIG. 31 is a flow chart of the set TG and keyboard routine S4014.

Block S4701 determines the key range of the operated key. If it pertains to an accompaniment keyboard (left portion of the musical keyboard 21), block S4702 is executed. In the negative, block S4711 is executed.

Block S4702 checks if the key operation is key-on. In the affirmative block S4703 is executed. In the negative (key-off operation), block S4707 is executed.

Block 4703 increments ONC.

Block S4704 sets CHORD NOTE (ONC) to the key pitch.

Block S4705 determines a chord CHORD from contents of pitch array CHORD NOTE ( ). Block S4706 sets CHORD register to CHORD. The CHORD register is referenced in the perform accompaniment routine to convert the accompaniment note event data. Then, the routine S4014 returns to the flow of FIG. 17.

Block S4707 decrements ONC.

Block S4708 deletes CHORD NOTE (ONC) of the key-off from pitch array CHORD NOTE ( ).

Block S4709 checks if ONC is "0". In the affirmative, the routine S4014 returns to the flow of FIG. 17. In the negative, block S4710 sorts the array CHORD NOTE ( ). Then, the routine S4014 returns to the flow of FIG. 17.

Block S4711 modifies or corrects pitch and velocity of the INPUT EVENT VALUE register according to TRANSPOSE and VALUE, respectively. Block S4712 sends the corrected pitch and velocity to the tone generator 20. Then the routine S4014 returns to the flow of FIG. 17.

5. Set Instrument

Figure 32:
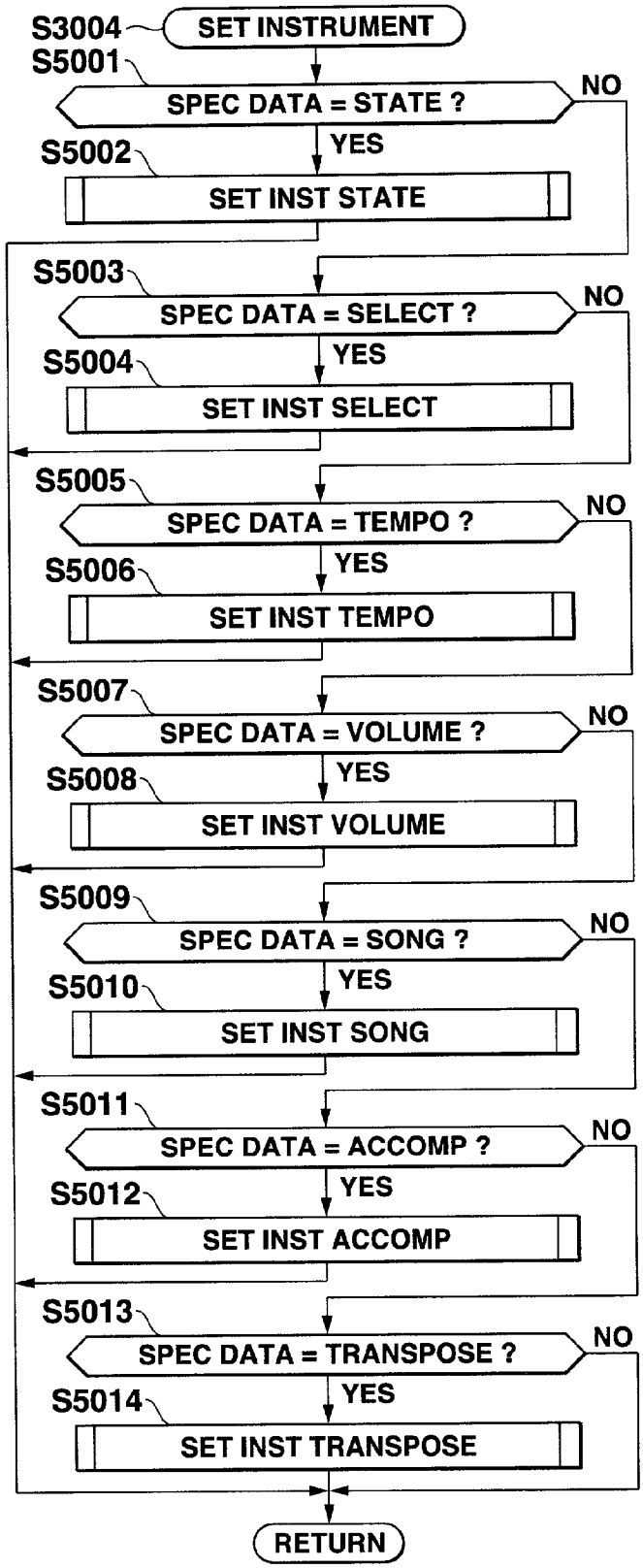
FIG. 32 is a flow chart of a set instrument routine.

The set instrument routine S3004 (FIG. 16) is called when INST specification data (i.e., specification data having the first item "INST") is found. FIG. 32 is a flow chart of the set instrument routine S3004.

According to specification data table shown in FIGS. 4A–4D, INST specification data has the second item which is one of the seven terms "STATE", "SELECT", "TEMPO", "VOLUME", "SONG", "ACCOMP" and "TRANSPOSE". The set instrument routine S3004 identifies the second item of INST specification data, thus identifying specification data INST (STATE), INST (SELECT), INST (TEMPO), INST (VOLUME), INST (SONG), INST (ACCOMP) or INST (TRANSPOSE). Based on the identified specification data, it calls or executes a corresponding routine. Specifically, if specification data is INST (STATE) (YES at block S5001), the set inst state routine S5002 is executed. If specification data is INST(SELECT) (YES at block S5003), the set inst select routine S5004 is executed. If it is INST (TEMPO) (YET at block S5005), the set inst tempo routine S5006 is executed. If it is INST (VOLUME) (YES at block S5007), the set inst volume routine S5008 is executed. If it is INST (SONG) (YES at block S5009), the set inst song routine S5010 is executed. If it is INST (ACCOMP) (YES at block S5011), the set inst accomp routine S5012 is executed. If it is INST (TRANSPOSE) (YES at block S5013), the set inst transpose routine S5014 is executed.

Details of the routines S5002, S5004, S5006, S5008, S5010, S5012 and S5014 are now described in more details.

5-1. Set Inst State

The object of the set inst routine S5002 is to set or change a state of the instrument based on operation of the switch 18 or keyboard 21. As described, there are eight possible states of the instrument. According to the specification data table shown in FIGS. 4A–4D, INST (STATE, ) specification data (i.e., specification data having the first item "INST" and second item "STATE") has the third item which is one of the eight terms "INITIAL SCREEN", "STOP PERFORMANCE", "RUN PERFORMANCE", "WAIT FOR PERFORMANCE", "CHANGE TG", "CHANGE PERFORMANCE", "WRITE" and "READ". The specification data INST (STATE, INITIAL SCREEN), INST (STATE, STOP PERFORMANCE), INST (STATE, RUN PERFORMANCE), INST (STATE, WAIT FOR PERFORMANCE), INST (STATE, CHANGE TG), INST (STATE, CHANGE PERFORMANCE), INST (STATE, WRITE) and INST (STATE, READ) are assigned to switches 18*a*–18*j* in appropriate states of the instrument. The specification data INST (STATE, RUN PERFORMANCE) is also assigned to keyboard 21 in the wait for auto performance state of the instrument.

Figure 33:
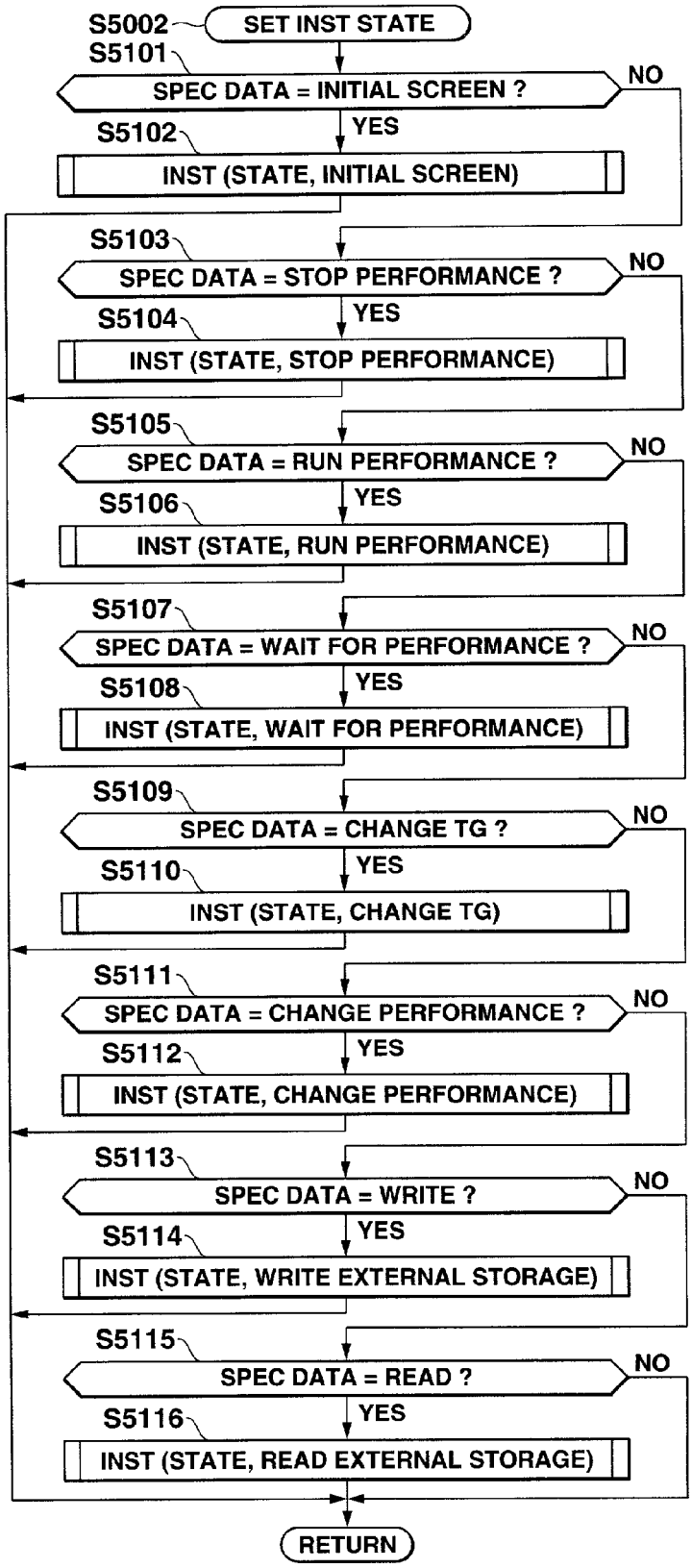
FIG. 33 is a flow chart of a set inst state routine.

FIG. 33 is a flow chart of the set instrument routine S3004 which is called when INST (STATE, ) specification data is found. If the third item of INST (STATE, ) specification data is INITIAL SCREEN, or the complete specification data is INST (STATE, INITIAL SCREEN) (YES at block S5101), INST (STATE, INITIAL SCREEN) routine S5102 is executed. If the complete specification data is INST (STATE, STOP PERFORMANCE) (YES at block S5103), INST (STATE, STOP PERFORMANCE) routine S5104 is executed. If specification data INST (STATE, RUN PERFORMANCE) is found (YES at block S5105), INST (STATE, RUN PERFORMANCE) routine S5106 is executed. If specification data INST (STATE, WAIT FOR PERFORMANCE ) is found (YES at block S5107), INST (STATE, WAIT FOR PERFORMANCE) routine S5108 is executed. If specification data INST (STATE, CHANGE TG) is found (YES at block S5109), INST (STATE, CHANGE TG) routine S5110 is executed. If specification data INST (STATE, CHANGE PERFORMANCE) is found (YES at block S5111), INST (STATE, CHANGE PERFORMANCE) routine S5112 is executed. If specification data INST (STATE, WRITE) is found (YES at block S5113), INST (STATE, WRITE) routine S5114 is executed. If specification data INST (STATE, READ) is found (YES at block S5115), INST (STATE, READ) routine S5116 is executed.

Details of the routines S5102, S5104, S5106, S5108 S5110, S5112, S5114 and S5116 are now described.

Figure 34:
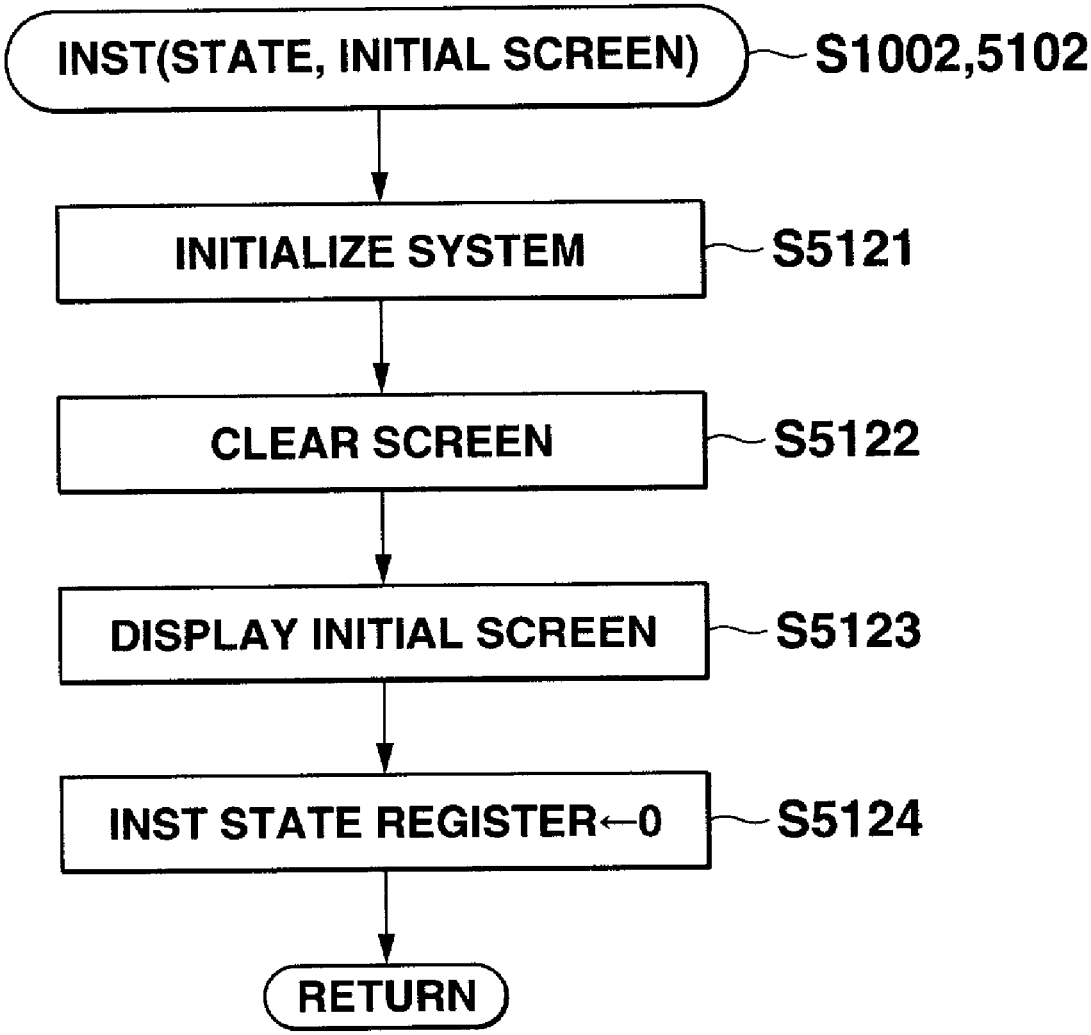
FIG. 34 is a flow chart of INST (STATE, INITIAL SCREEN) routine.

FIG. 34 is a flow chart of INST (STATE, INITIAL SCREEN) routine S5102. Block S5121 initializes the system in the manner as described with respect to block S1001 (FIG. 8). Block s5122 clears the screen on LCD 15. Then block S5123 displays the initial screen shown in FIG. 3A. Block S5124 sets a STATE register to "0" indicative of initial screen state of the instrument. The INST (STATE, INITIAL SCREEN) routine is also called in block S1002 in FIG. 8.

Figure 35:
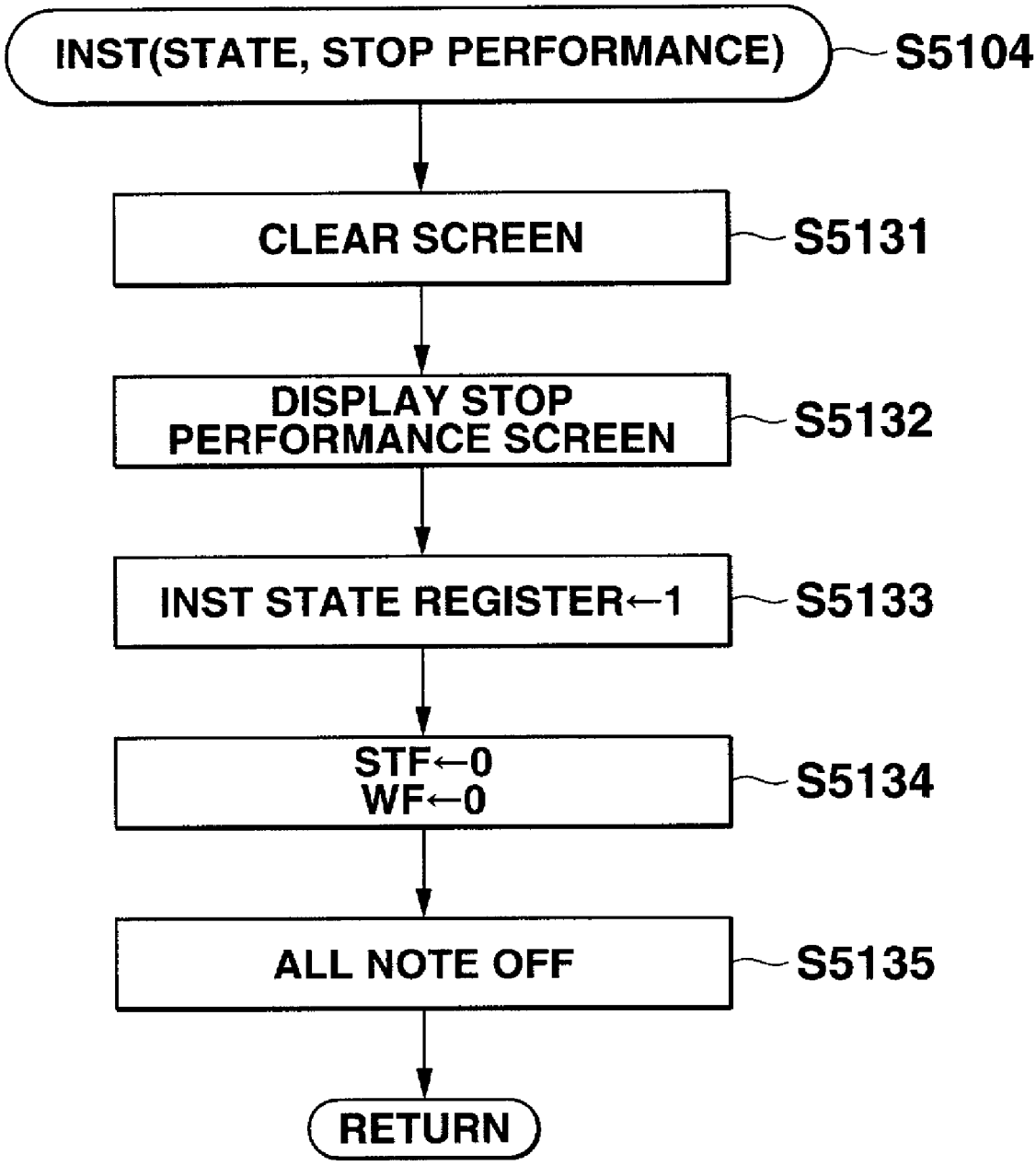
FIG. 35 is a flow chart of INST (STATE, STOP PERFORMANCE) routine.

FIG. 35 is a flow chart of INST (STATE, STOP PERFORMANCE) routine S5104. Block S5131 clears the screen on LCD 15. Then block S5132 displays the stop performance screen shown in FIG. 3B. Block S5133 sets STATE register to "1" indicative of stop performance state. Block S5134 reset music start flag STF and wait flag WF to "0" to stop performance. Block S5135 executes all note-off to stop the performance.

Figure 36A:
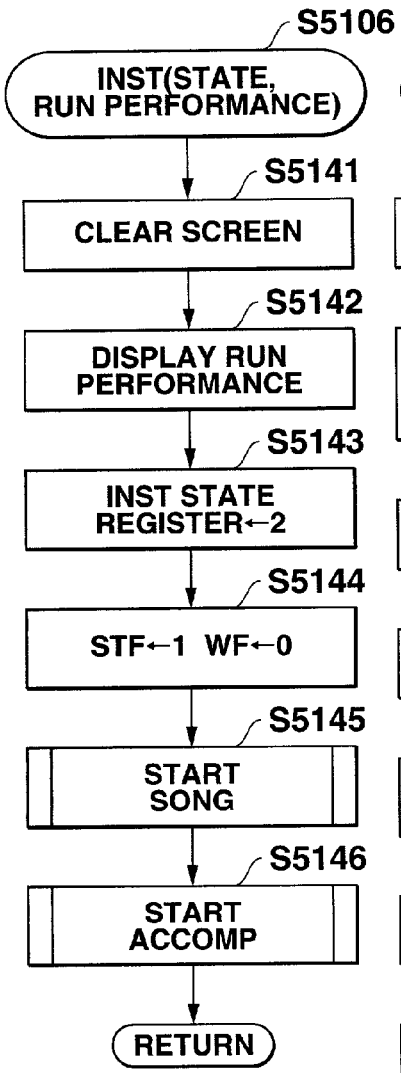
FIGS. 36A–C are flow charts showing details of INST (STATE,RUN PERFORMANCE) routine.

FIG. 36A is a flow chart of INST (STATE, RUN PERFORMANCE) routine S5106. Block S5141 clears the screen on LCD 15. Block S5142 displays run performance screen shown in FIG. 3C. Block S5143 sets STATE register to "2" indicative of run performance state. Block S5144 sets music start flag STF to "1" and resets wait flag WF to "0" to start performance. Then, start song routine S5145 and start accomp routine S5146 are executed.

Figure 36B:
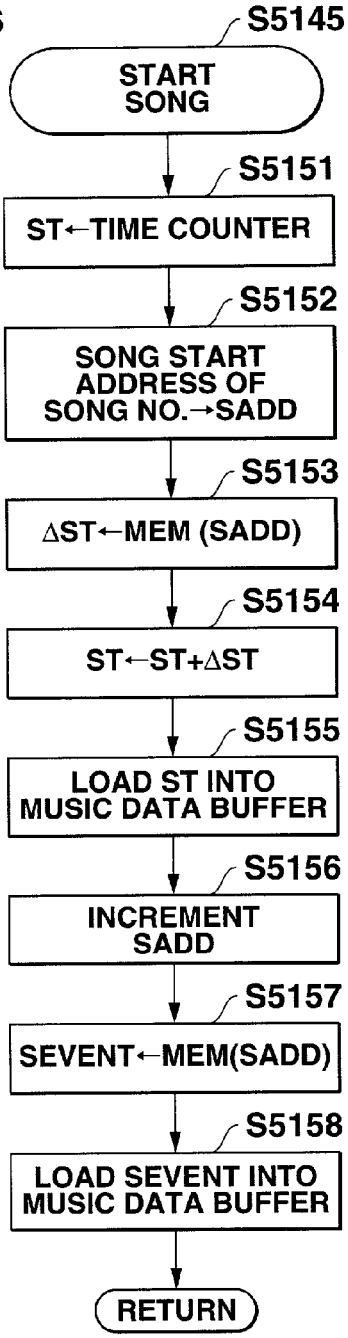

FIG. 36B is a flow chart of the start song routine S5145. Block S5151 sets ST to the time counter. Block S5152 sets song address pointer SADD to the song start address of SONG NO.

Block S5153 reads first time data MEM (SADD) of the song in ROM 13 at address SADD and sets ΔST to MEM (SADD).

Block S5154 adds AST to ΔST. Block S5155 loads the time data ST into the music data buffer.

Block S5156 increments SADD. Block S5157 reads first note event data MEM (SADD) and sets SEVENT to MEM (SADD).

Block S5158 loads SEVENT into the music data buffer.

Figure 36C:
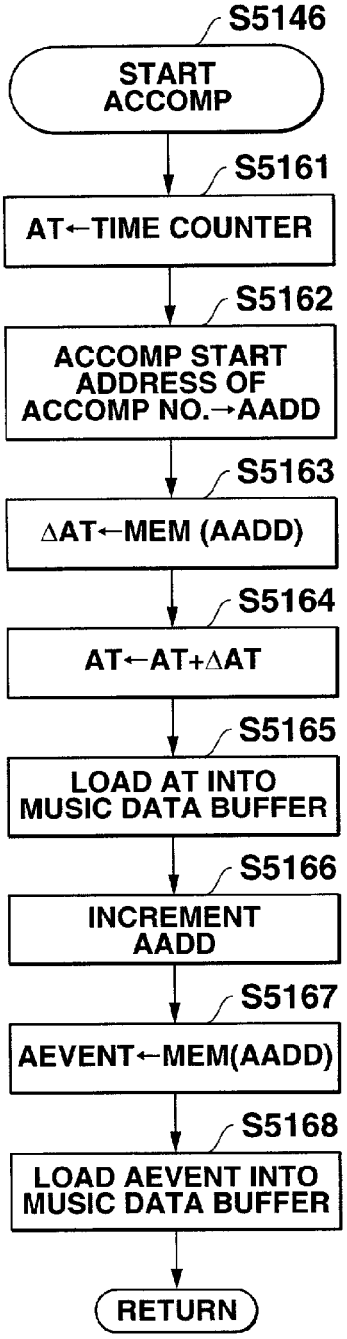

FIG. 36C is a flow chart of the start accomp routine S5146. Blocks S5161–S5168 in FIG. 36C correspond to blocks S5151–S5158 in FIG. 36B. It is noted, however, that the start accomp routine S5146 gets access to accompaniment data rather than song data to start the accompaniment.

Figure 37:
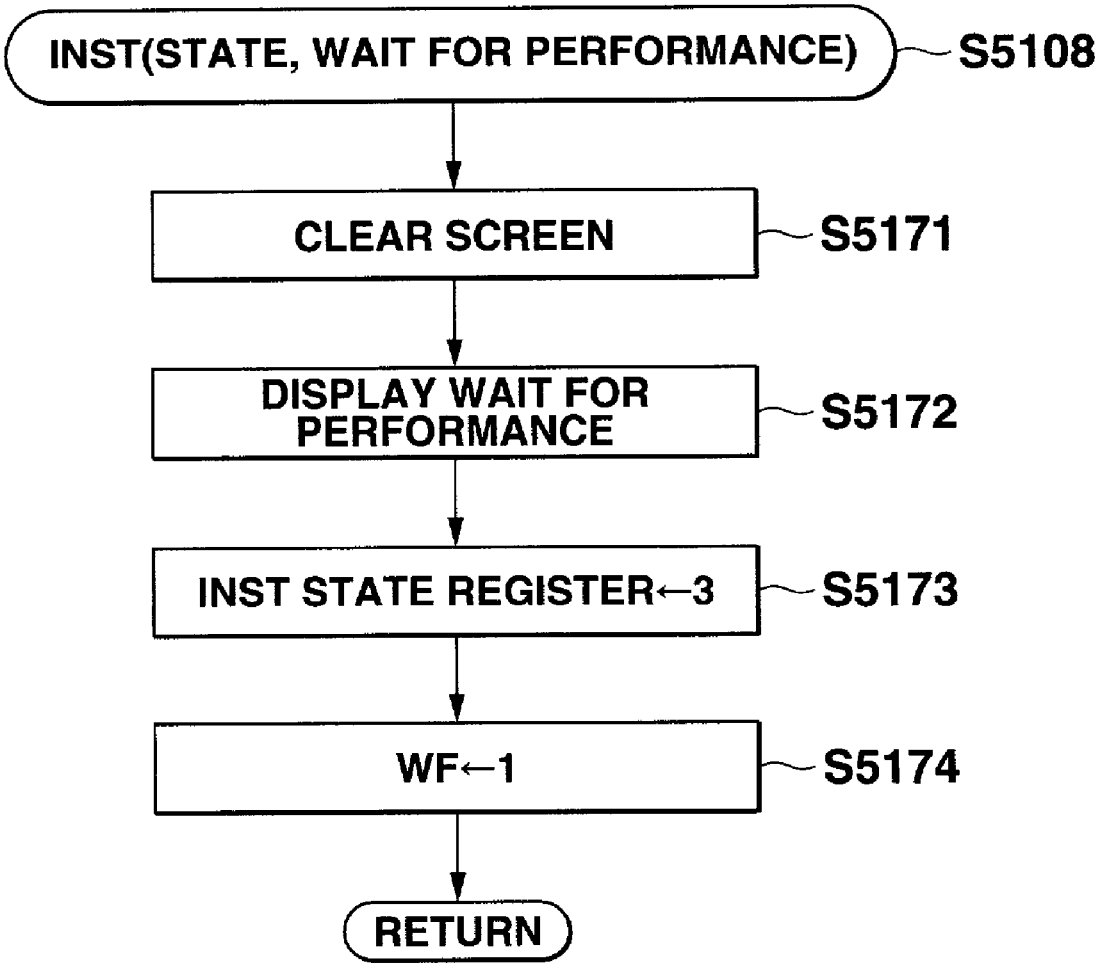
FIG. 37 is a flow chart of INST (STATE, WAIT FOR PERFORMANCE) routine.

FIG. 37 is a flow chart of INST (STATE, WAIT FOR PERFORMANCE) routine S5108. Block S5171 clears the screen on LCD 17. Block S5172 displays the wait for performance screen shown in FIG. 3D. Block S5173 sets INST STATE register to "2" indicative of the wait for performance state of the instrument. Finally, block S5174 sets the wait flag WF to "1" to wait for performance.

Figure 38:
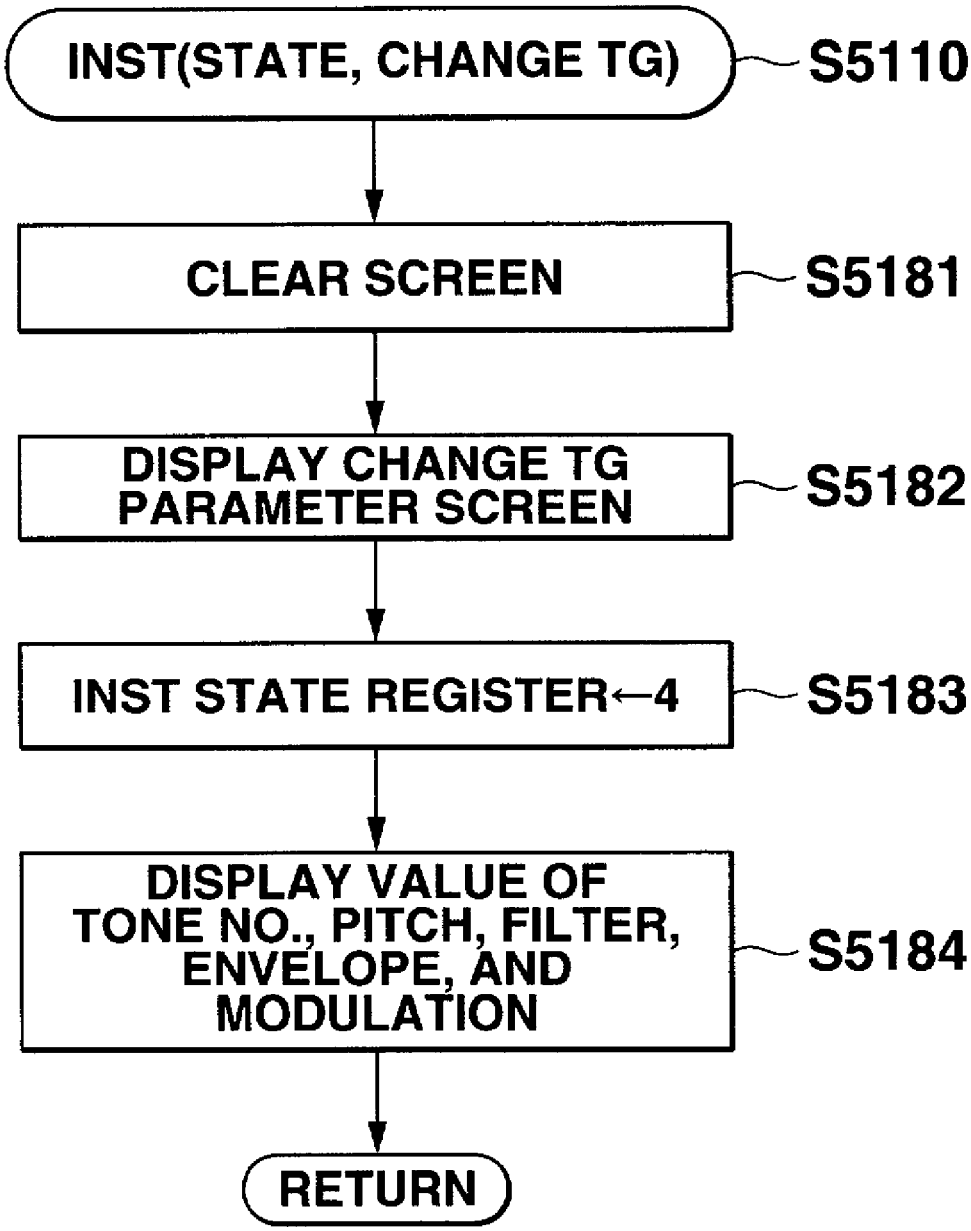
FIG. 38 is a flow chart of INST (STATE, CHANGE TG) routine.

FIG. 38 is a flow chart of INST (STATE, CHANGE TG) routine. Block S5181 clears the screen on LCD 15. Block S5182 displays the change TG parameter screen shown in FIG. 3E. Block S5183 sets INST STATE register to "4" indicative of the change TG parameter state of the instrument. Block S5184 displays the value of TONE NO. PITCH, FILTER, ENVELOPE and MODULATION.

Figure 39:
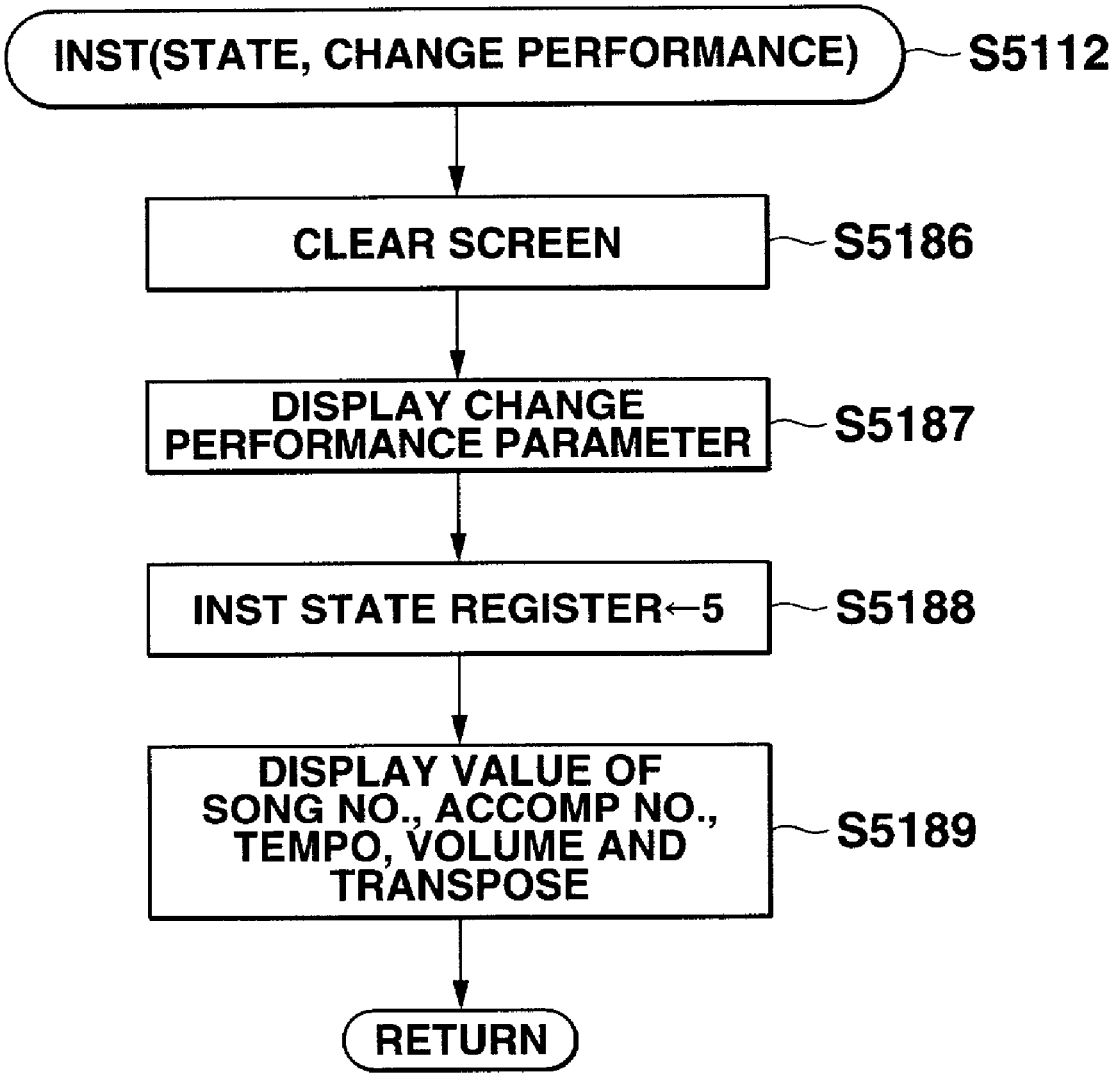
FIG. 39 is a flow chart of INST (STATE, CHANGE PERFORMANCE) routine.

FIG. 39 is a flow chart of INST (STATE, CHANGE PERFORMANCE) routine S5112. Block S5186 clears the screen on LCD 15. Block S5187 displays the change performance parameter screen shown in FIG. 3F. Block S5188 sets INST STATE register to "5" indicative of the change performance parameter state of the instrument. Block S5189 displays the value of SONG NO., ACCOMP NO., TEMPO, VOLUME and TRANSPOSE.

Figure 40:
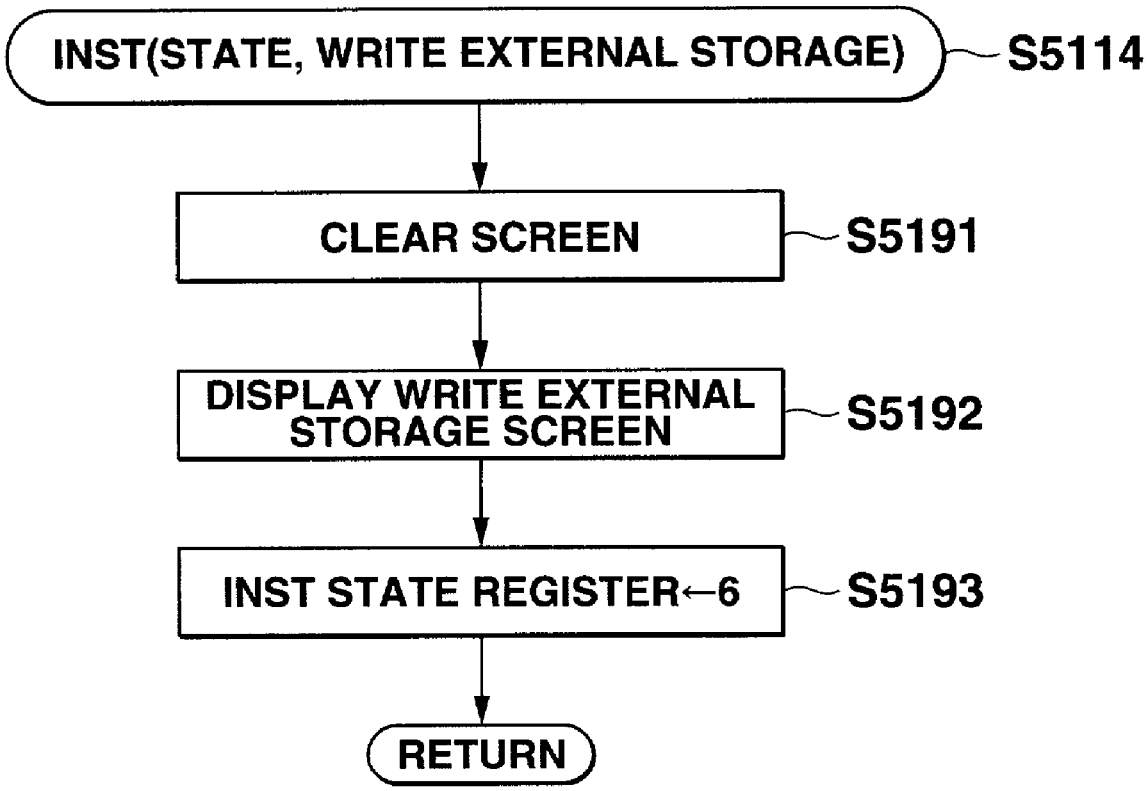
FIG. 40 is a flow chart of INST (STATE, WRITE EXTERNAL STORAGE) routine.

FIG. 40 is a flow chart of INST (STATE, WRITE EXTERNAL STORAGE) routine S5114. Block S5191 clears the screen on LCD 15. Block S5192 displays the write external storage screen shown in FIG. 3G. Block S5193 sets INST STATE register to "6" indicative of the write external storage state of the instrument.

Figure 41:
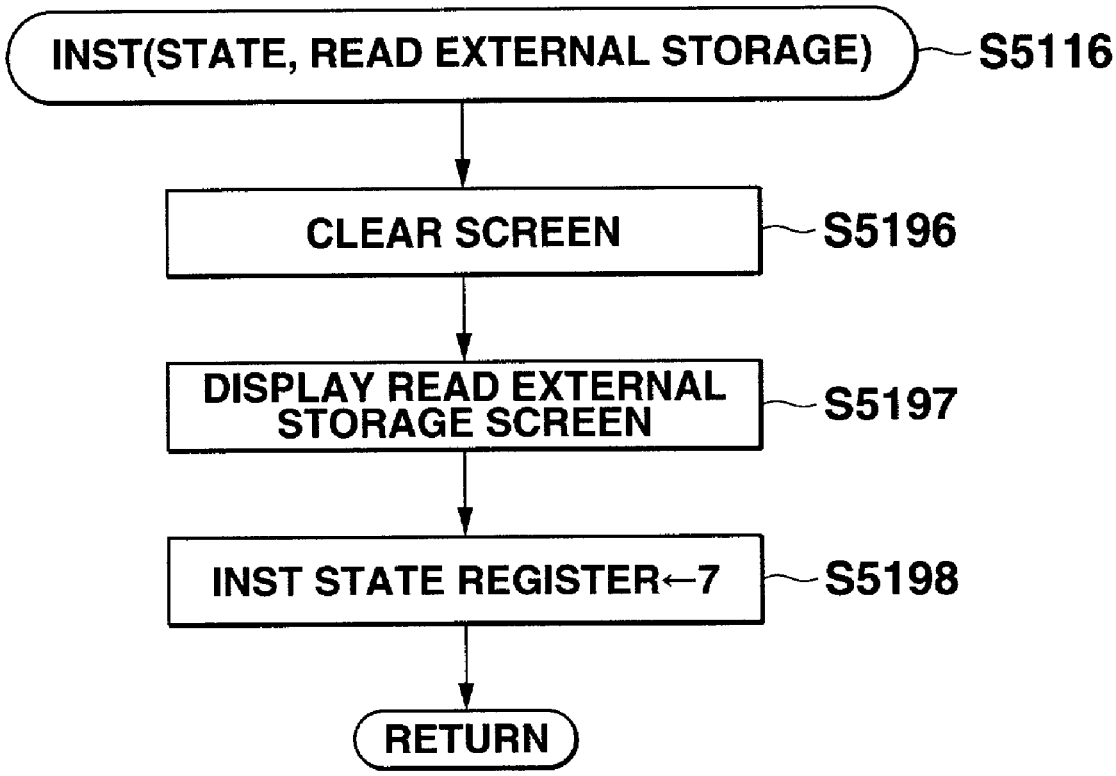
FIG. 41 is a flow chart of INST (STATE, READ EXTERNAL STORAGE) routine.

FIG. 41 is a flow chart of INST (STATE, READ EXTERNAL STORAGE) routine S5116. Block 5196 clears the screen on LCD 15.

Block S5197 displays the write external storage screen shown in FIG. 3H. Finally, block S5198 sets INST STATE register to "7" indicative of the read external storage state of the instrument.

5-2. Set Inst Select

The object of the set inst select routine S5004 is to select a performance parameter of the instrument to be set based on operation of switch 18 and set the value of the selected performance parameter (song, accomp, transpose, tempo or volume) based on operation of the encoder 19.

According to the specification data table shown in FIGS. 4A–4D, the change performance parameter state row includes six INST (SELECT, ) specification data. Specifically, INST (SELECT, SONG) specification data is provided for switch 18*f*, INST (SELECT, TRANSPOSE) specification data for switch 18*g*, INST (SELECT, ACCOMP) specification data for switch 18*h*, INST (SELECT, TEMPO) specification data for switch 18*i*, INST (SELECT, VOLUME) specification data for switch 18*j* and INST (SELECT, ROTATION VALUE) specification data for encoder 19.

Figure 42:
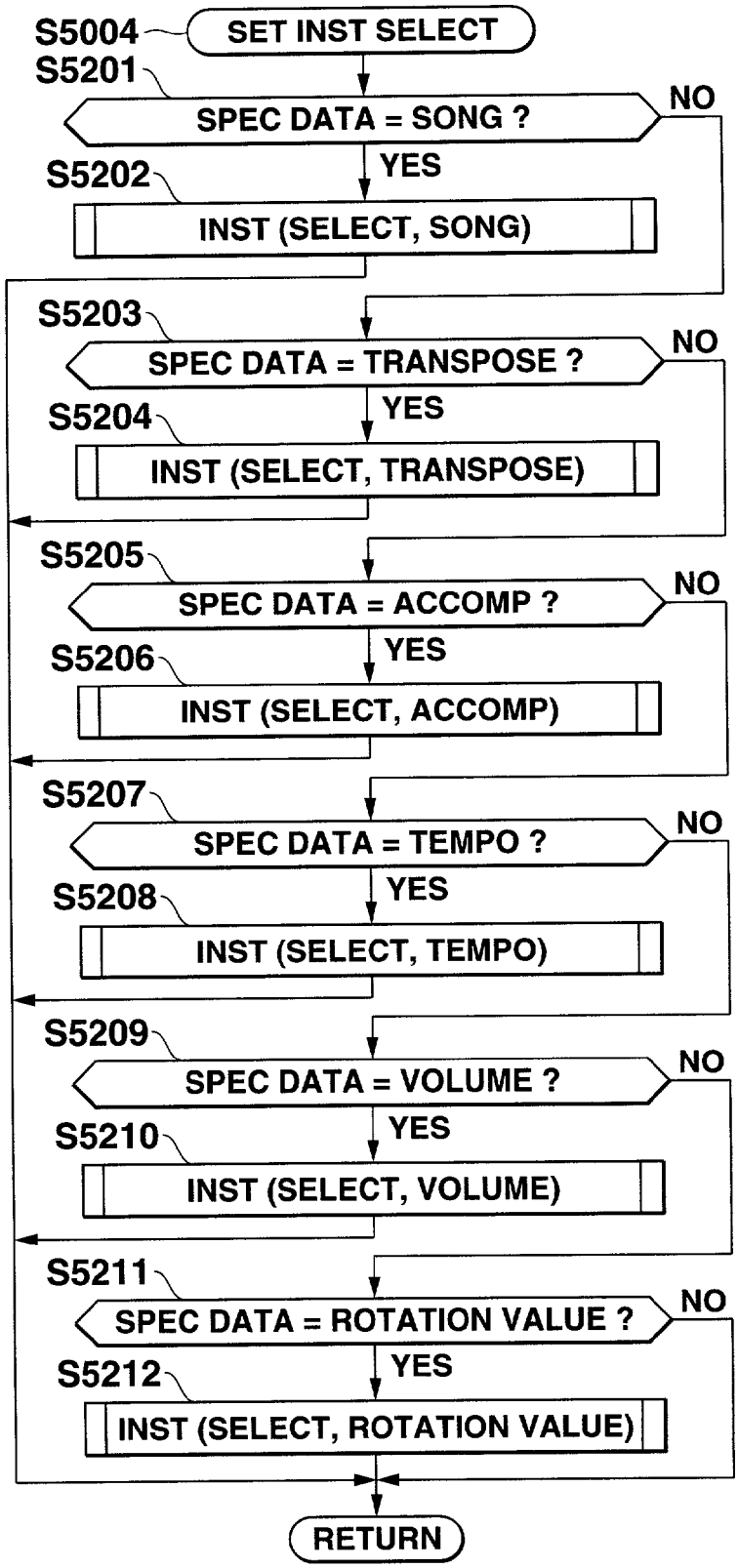
FIG. 42 is a flow chart of a set inst select routine.

FIG. 42 is a flow chart of the set inst select routine S5004 which is called when INST (SELECT, ) specification data (i.e., specification data having the first item "INST" and second item "SELECT") is found.

The set inst select routine S5004 identifies the third item of INST (SELECT, ) specification data, thus identifying the complete specification data. Based on the identified specification data, it calls or executes a corresponding routine.

Figure 43A:
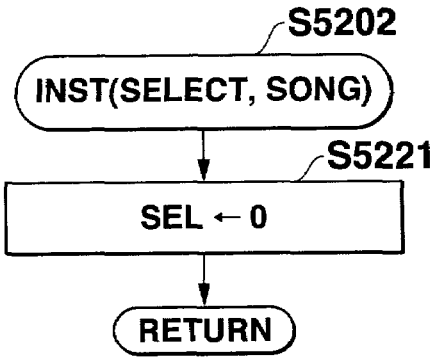
FIGS. 43A–E are flow charts of INST (SELECT, SONG), INST (SELECT, TRANSPOSE), INST (SELECT, ACCOMP), INST (SELECT, TEMPO) and INST (SELECT, VOLUME) routines in FIG. 42.
Figure 43D:
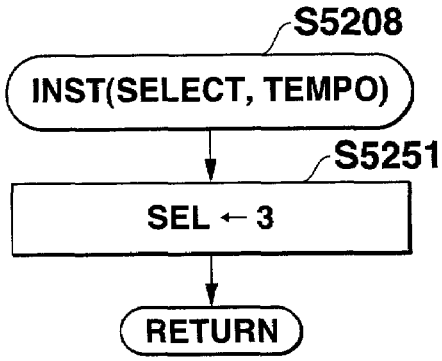
Figure 43B:
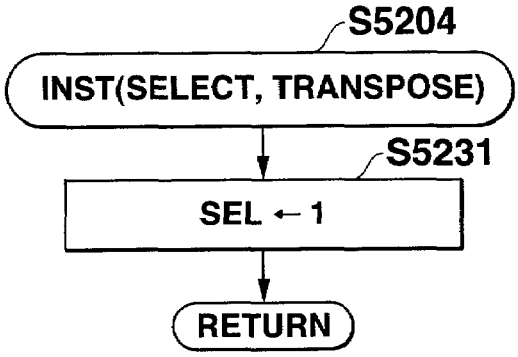
Figure 43E:
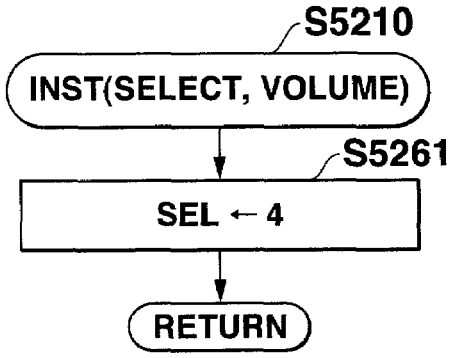
Figure 43C:
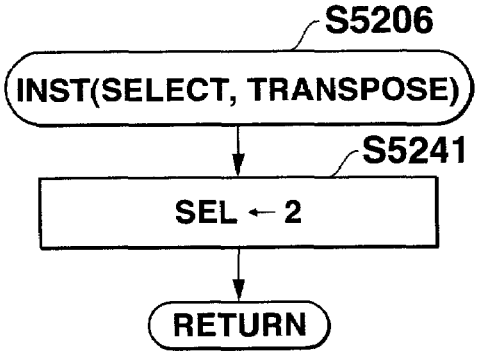

Specifically, if the third item of INST (SELECT, ) specification data is "SONG", or INST (SELECT, SONG) specification data is found (YES at block S5201), INST (SELECT, SONG) routine S5202 is executes to set SEL to "0", as shown in block S5221 of FIG. 43A. If INST (SELECT, TRANSPOSE) specification data is found (YES at block S5203), INST (SELECT, TRANSPOSE) routine S5204 is executed to set SEL to "1", as shown in block S5231 of FIG. 43B. If INST (SELECT, ACCOMP) specification data is found (YES at block S5205), INST (SELECT, ACCOMP) routine S5206 is executed to set SEL to "2", as shown in block S5241 of FIG. 43C. If INST (SELECT, TEMPO) specification data is found (YES at block S5207), INST (SELECT, TEMPO) routine S5208 is executed to set SEL to "3", as shown in block S5251 of FIG. 43D. If INST (SELECT, VOLUME) specification data is found (YES at block S5209), INST (SELECT, VOLUME) routine S5210 is executed to set SEL to "4", as shown in FIG. 43E.

If INST (SELECT, ROTATION VALUE) specification data is found (YES at block S5211), INST (SELECT, ROTATION VALUE) routine S5212 is executed.

Figure 44:
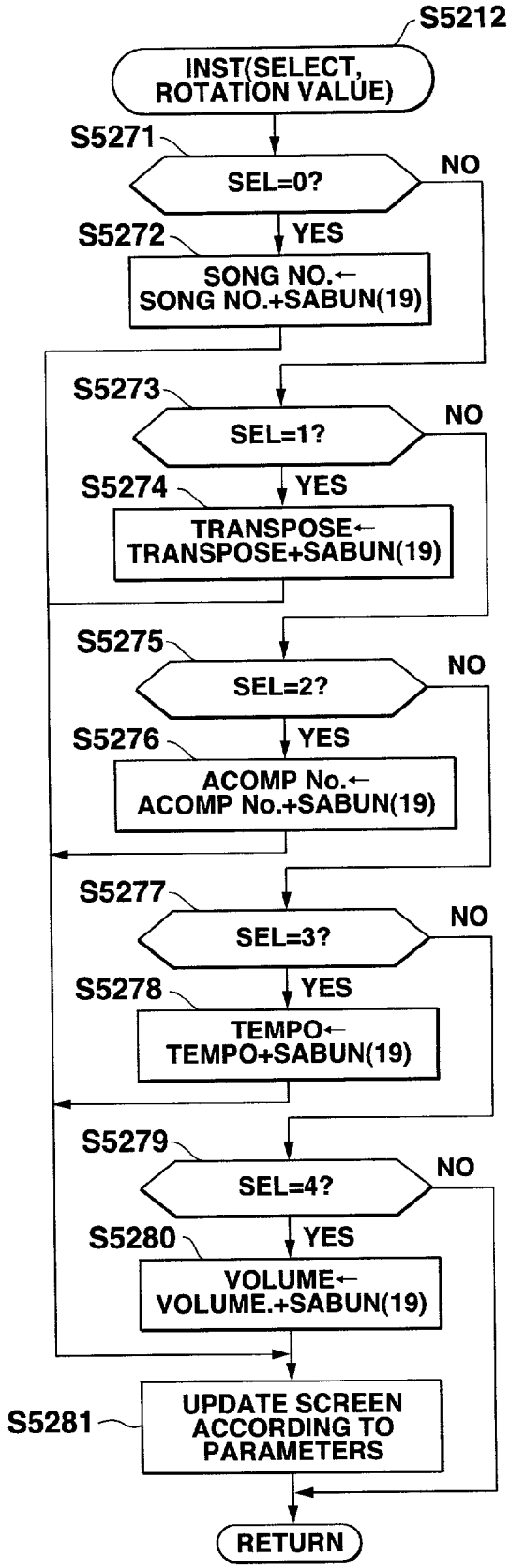
FIG. 44 is a flow chart of INST (SELECT, ROTATION VALUE) routine.

FIG. 44 is a flow chart of INST (SELECT, ROTATION VALUE) routine S5212. Block S5271 checks if SEL is set to "0", indicative of song. In the affirmative, block S5272 updates SONG NO. in RAM 14 by adding SABUN (19), indicative of the operation value of the rotary encoder 19, to SONG NO. In the negative, block S5273 checks if SEL is set to "1", indicative of transpose. In the affirmative, block S5274 updates TRANSPOSE in RAM 14 by adding SABUN (19) to TRANSPOSE. In the negative, block S5275 checks if SEL is set to "2" indicative of accompaniment. In the affirmative, block S5276 updates ACCOMP NO. in RAM 14 by adding SABUN (19) to ACCOMP NO. In the negative, block S5277 checks if SEL is set to "3" indicative of tempo. In the affirmative, block S5278 updates TEMPO in RAM 14 by adding SABUN (19) to TEMPO. In the negative, block S5279 checks if SEL is set to "4" indicative of volume. In the affirmative, block S5280 updates VOLUME in RAM 14 by adding SABUN (19) to VOLUME. After updating a performance parameter (SONG NO., TRANSPOSE, ACCOMP NO., TEMPO or VOLUME) by block S5272, S5274, S5276, S5278 or S5280, the routine S5212 executes block S5281 to update the change performance screen (FIG. 3F) according to the updated performance parameter.

5-3. Set Inst Tempo

The object of the set inst tempo routine S5006 (FIG. 32) is to set tempo of the auto performance based on operation of the slider 17, switch 18 or encoder 19. According to the specification data table shown in FIGS. 4A–4D, the run auto performance state row of the instrument includes specification data INST (TEMPO, ADD) for switch 18*k*, INST (TEMPO, SUBTRACT) for switch 18*n* INST (TEMPO, VALUE) for slider 17*a* and INST (TEMPO, ROTATION VALUE) for encoder 19.

Figure 45:
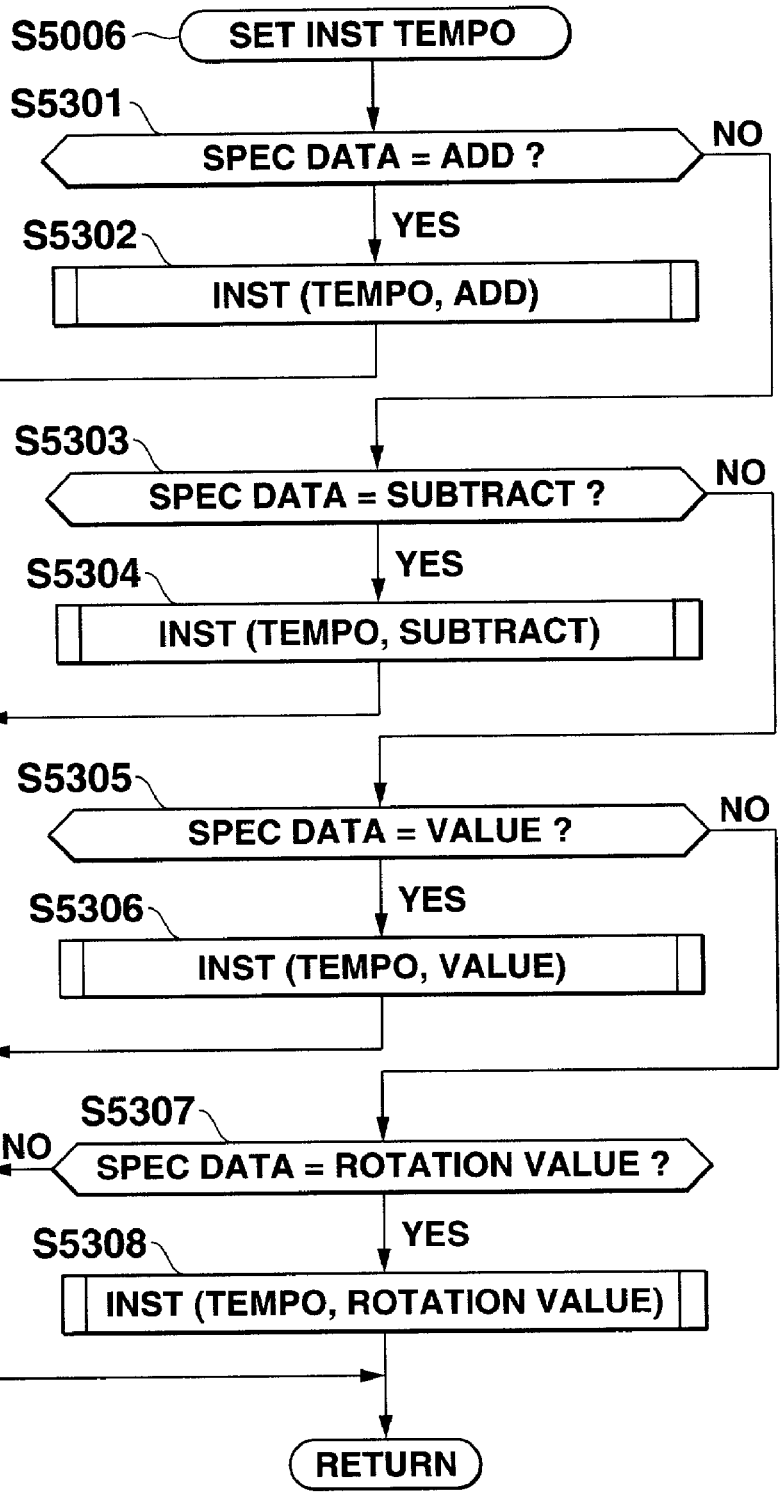
FIG. 45 is a flow chart of a set inst tempo routine.

FIG. 45 is a flow chart of the set inst tempo routine S5006 which is called when INST (TEMPO, ) specification data is found. Each check block S5301, S5303, S5305, S53007 identifies the third item of INST (TEMPO, ) specification data. Based on the identified specification data, the routine S5006 executes a corresponding one of INST (TEMPO, ADD) routine S5302, INST (TEMPO, SUBTRACT) routine S5304, INST (TEMPO, VALUE) routine S5306 and INST (TEMPO, ROTATION VALUE) routine S5308.

FIGS. 46A–46D are detailed flow charts of the routines S5302, S5304, S5306 and S5308 in FIG. 45.

Figure 46A:
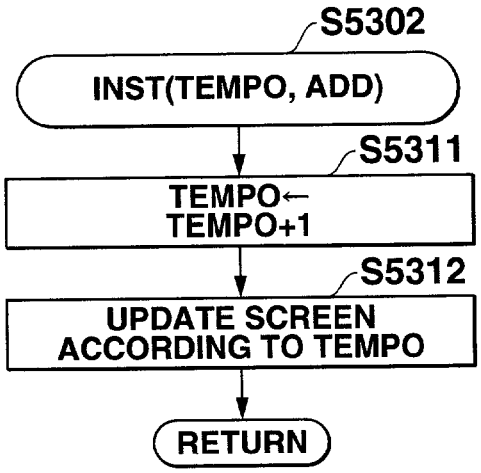
FIGS. 46A–D are flow charts of INST (TEMPO, ADD), INST (TEMPO, SUBTRACT), INST (TEMPO, VALUE) and INST (TEMPO, ROTATION VALUE) routines in FIG. 45.

In INST (TEMPO, ADD) routine S5302 shown in FIG. 46A, block S5311 increments TEMPO in RAM 14 by one.

Block S5312 updates the change performance parameter screen (FIG. 3F) according to TEMPO updated by block S5311.

INST (TEMPO, SUBTRACT) routine S5304 shown in FIG. 45B is identical with INST (TEMPO, ADD) routine S5302 shown in FIG. 46A except that block S5321 decrements TEMPO in RAM 14 by one.

Figure 46C:
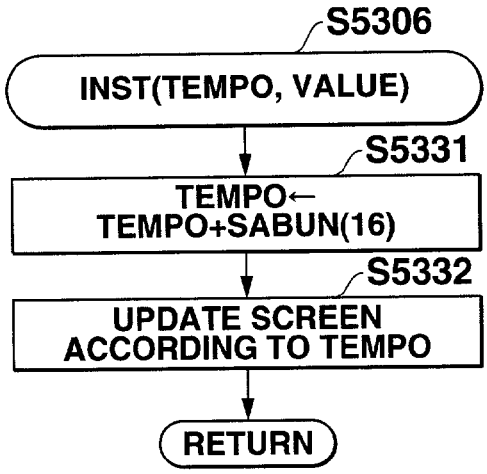

INST (TEMPO, VALUE) routine S5306 shown in FIG. 46C is identical with INST (TEMPO, ADD) routine shown in FIG. 46A except that block S5331 updates TEMPO in RAM 14 by adding SABUN (16) to TEMPO. INST (TEMPO, ROTATION) routine S5308 shown in FIG. 46D is identical with INST (TEMPO, ADD) routine S5302 shown in FIG. 46A except that block S5341 updates TEMPO in RAM 14 by adding SABUN (19) to TEMPO.

5-4. Set Inst Volume

The object of the set inst volume routine S5008 is to set a reference volume of the auto performance based on operation of slider 17 or switch 18. According to the specification data table shown in FIGS. 4A– 4D, the run auto performance state row includes specification data INST (VOLUME, ADD) for switch 181, INST (VOLUME, SUBTRACT) for switch 18*o* and INST (VOLUME, VALUE) for slider 17*b*.

Figure 47:
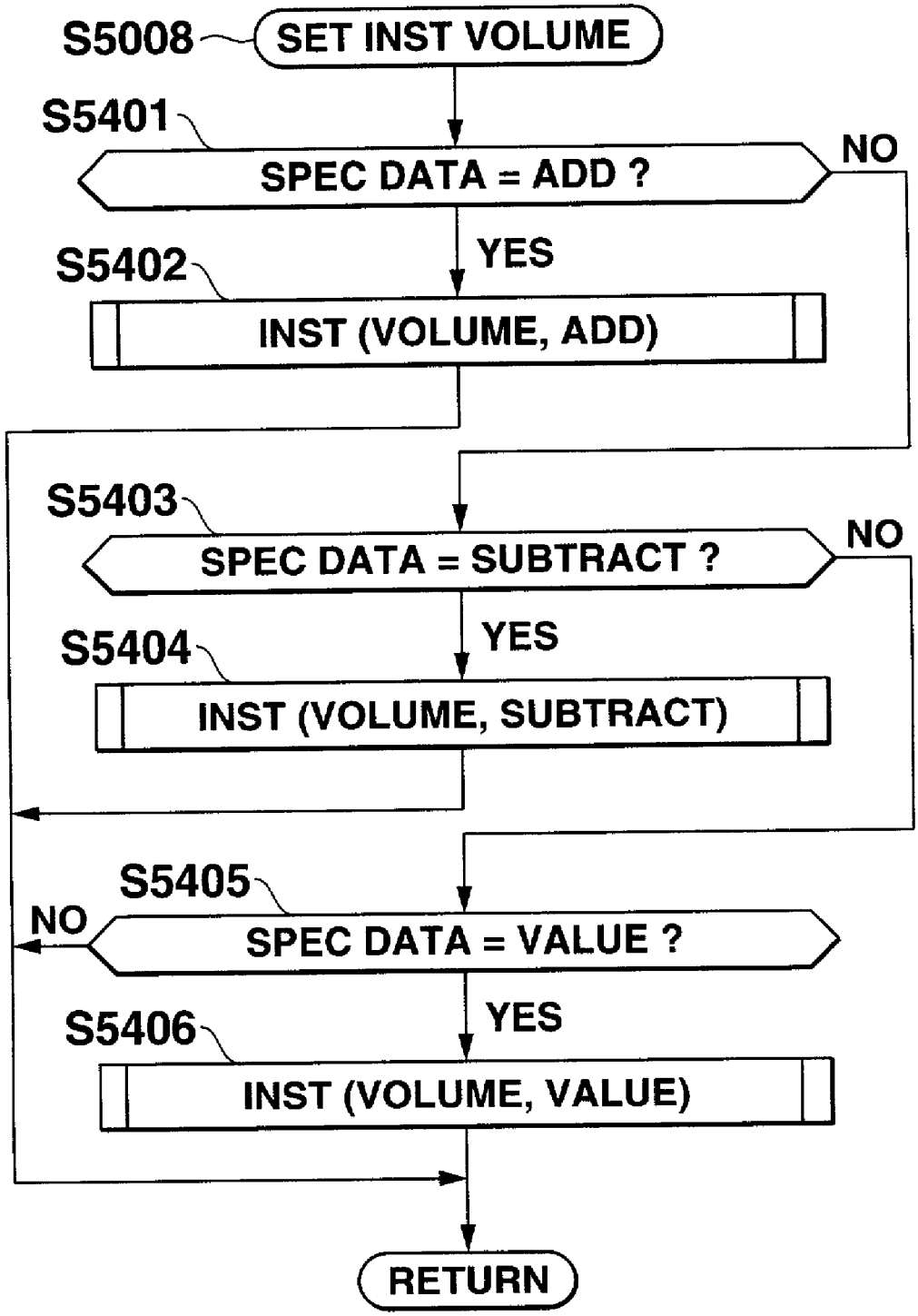
FIG. 47 is a flow chart of a set inst volume routine.

FIG. 47 is a flow chart of the set inst volume routine S5008. Blocks S5401 to S5406 correspond to blocks S5301 to S5306 in the set tempo routine except that VOLUME replaces TEMPO.

Figure 48A:
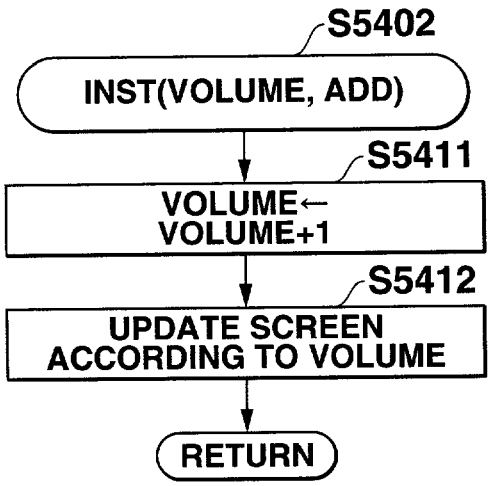
FIGS. 48A–C are flow charts of INST (VOLUME, ADD), INST (VOLUME, SUBTRACT) and INST (VOLUME, VALUE) routines in FIG. 47.
Figure 48C:
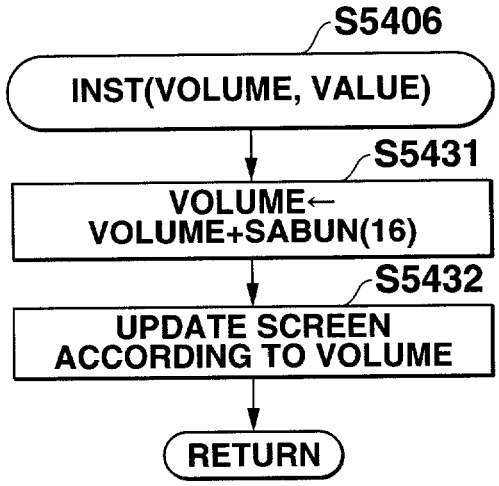
Figure 48B:
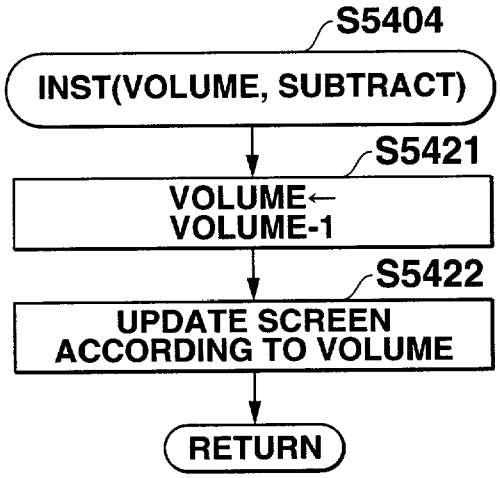

FIGS. 48A–48C are detailed flow charts of INST (VOLUME, ADD) routine S5402, INST (VOLUME, SUBTRACT) routine S5404 and INST (VOLUME, VALUE) routine S5406 in FIG. 47.

Figure 46B:
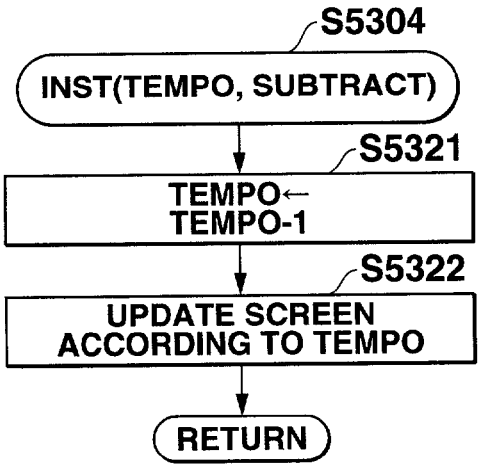
Figure 46D:
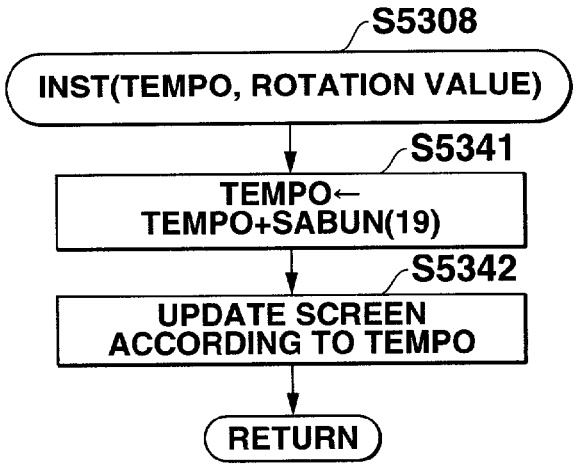

The routines S5402, S5404 and S5406 including blocks S5411 to S5432 correspond to routines S5302, S5304 and S5306 shown in FIGS. 46A–46C except that VOLUME replace TEMPO.

5-5. Set Inst Song

The object of the set inst song routine S5010 (FIG. 32) is to set the song of the auto performance based on operation of slider 17 or switch 18. According to the specification data table shown in FIGS. 4A–4D, the change performance parameter state row includes specification data INST (SONG, ADD) for switch 18*k*, INST (SONG, SUBTRACT) for switch 18*n* and INST (SONG, VALUE) for slider 17*a*.

Figure 49:
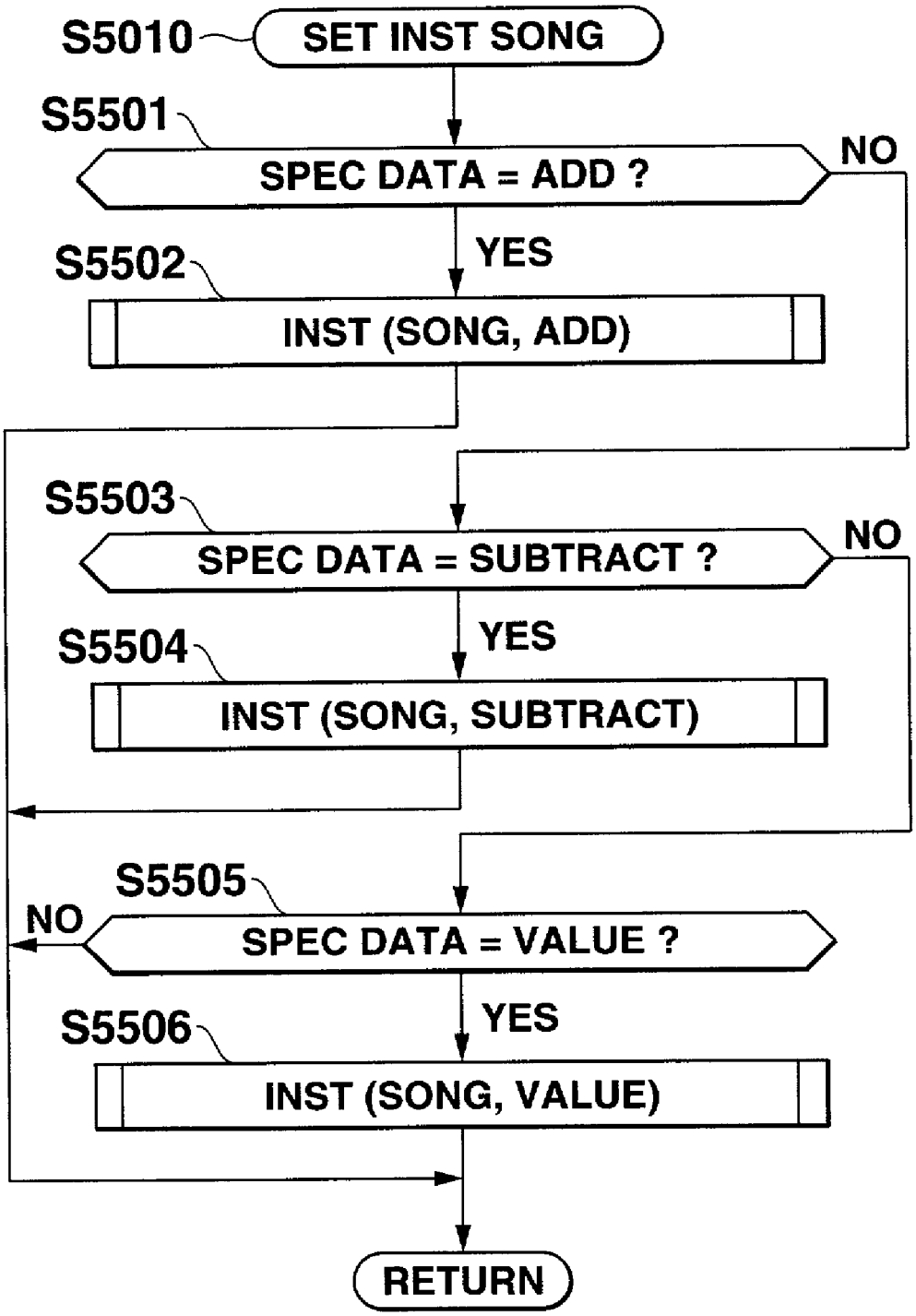
FIG. 49 is a flow chart of a set inst song routine.

FIG. 49 is a flow chart of the set inst song routine S5010. The routine S5010 including blocks S5501 to S5506 corresponds to the set inst volume routine shown in FIG. 47 except that SONG replaces VOLUME.

Figure 50A:
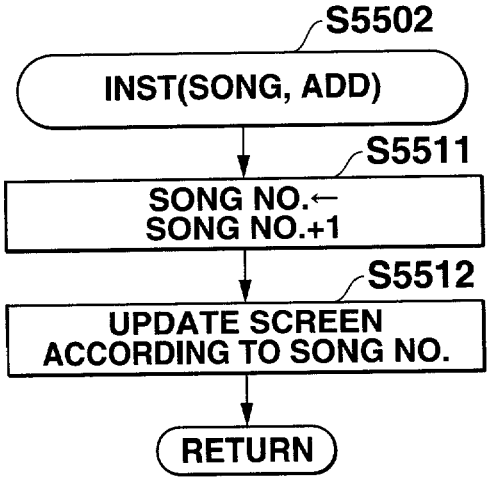
FIGS. 50A–C are flow charts of INST (SONG, ADD), INST (SONG, SUBTRACT) and INST (SONG, VALUE) routines in FIG. 49.
Figure 50C:
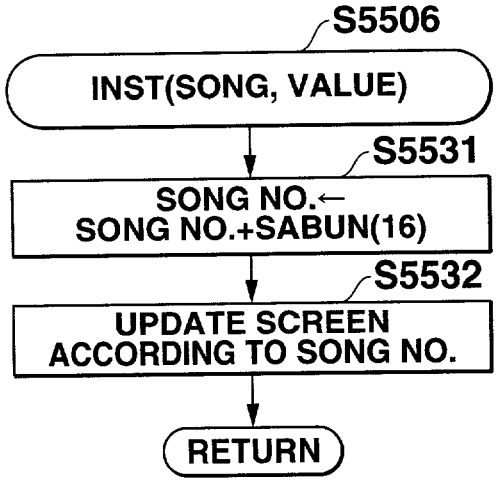
Figure 50B:
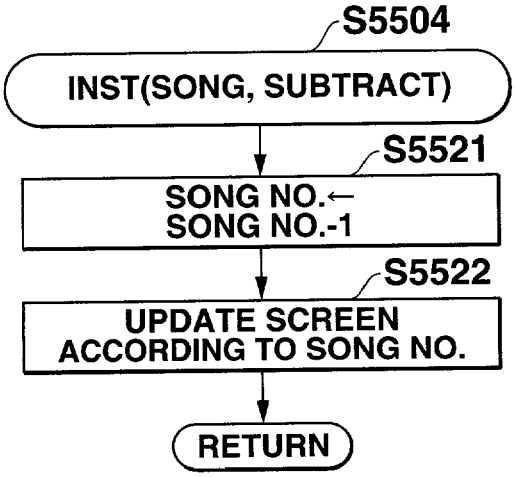

FIGS. 50A–50C are detailed flow charts of INST (SONG, ADD) routine S5502, INST (SONG, SUBTRACT) routine S5504 and INST (SONG, VALUE) routine S5506.

The routines S5502, S5504 and S5506 including blocks S5511 to S5532 correspond to the routines S5402, S5404 and S5406 shown in FIGS. 48A–48C except that SONG NO. replaces VOLUME.

5-6. Set Inst Accomp

The object of the set inst accomp routine S5012 (FIG. 32) is to set the accompaniment of the auto performance based on operation of slider 17 or switch 18. According to the specification data table shown in FIGS. 4A–4D, the change performance parameter state row of the instrument includes specification data INST (ACCOMP, ADD) for switch 18*m*, INST (ACCOMP, SUBTRACT) for switch 18*p* and INST (ACCOMP, VALUE) for slider 17*c*.

Figure 51:
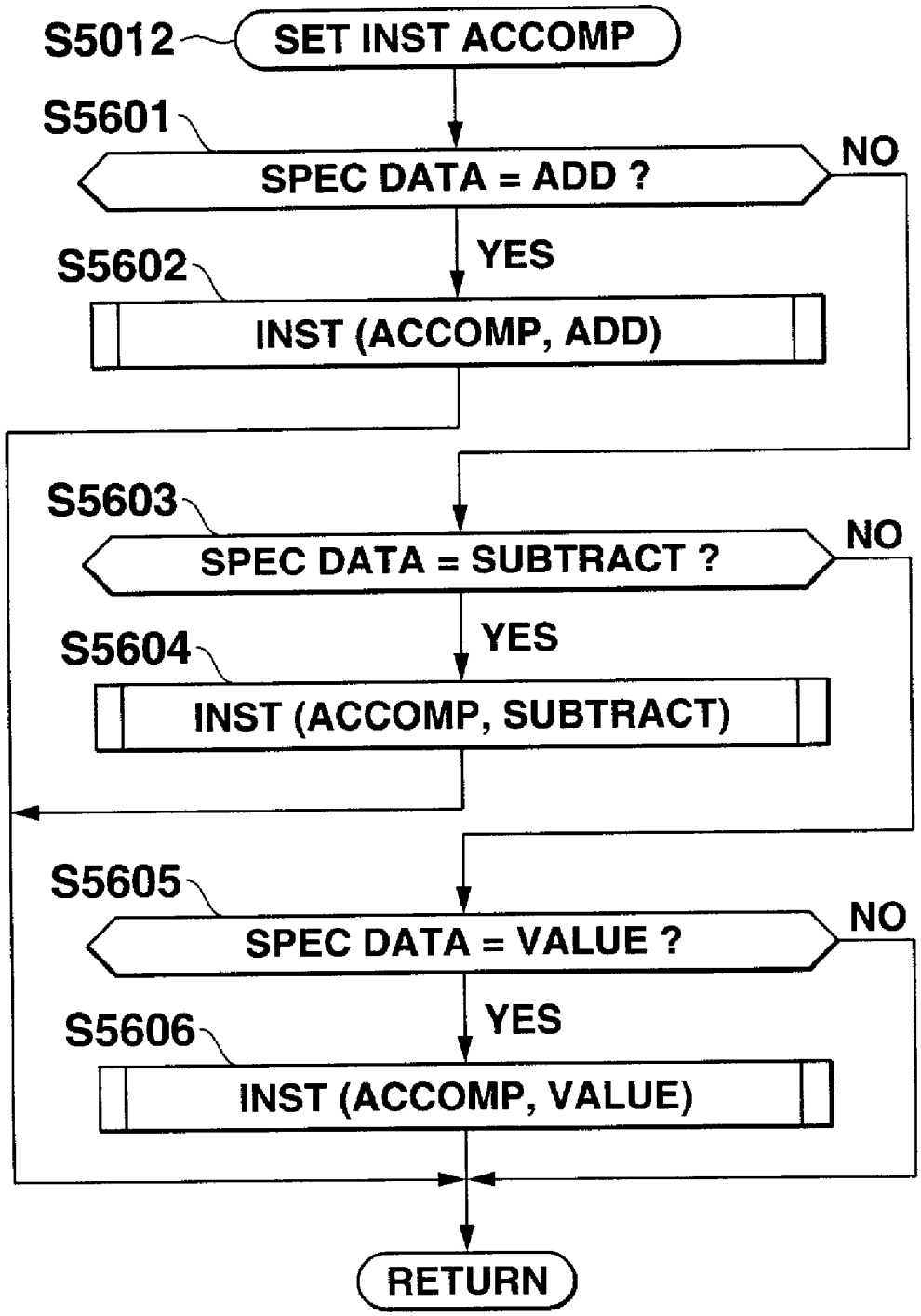
FIG. 51 is a flow chart of a set inst accomp routine.

FIG. 51 is a flow chart of the set inst accomp routine S5012. The routine S5012 including blocks S5601 to S5606 corresponds to the set inst volume routine shown in FIG. 7 except that ACCOMP replaces VOLUME.

Figure 52A:
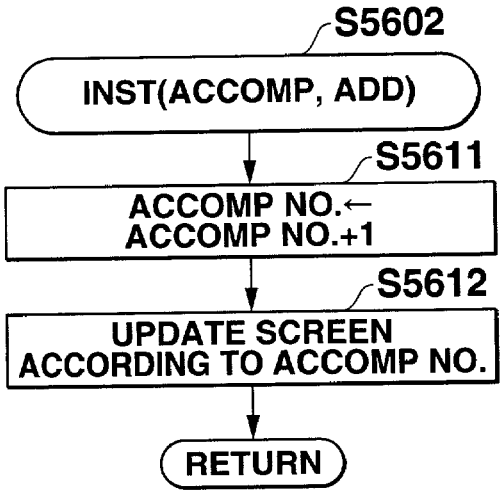
FIGS. 52A–C are flow charts of INST (ACCOMP, ADD), INST (ACCOMP, SUBTRACT) and INST (ACCOMP, VALUE) routines in FIG. 51.
Figure 52C:
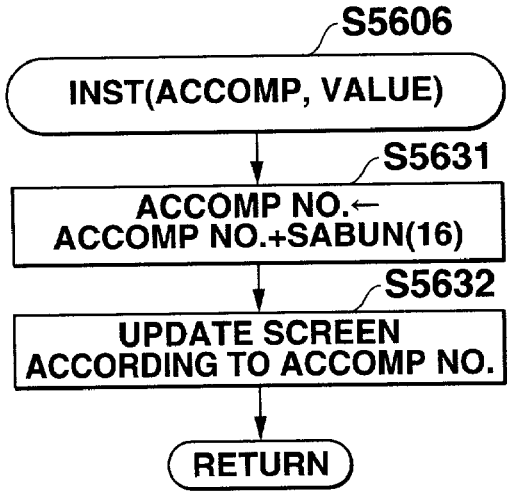
Figure 52B:
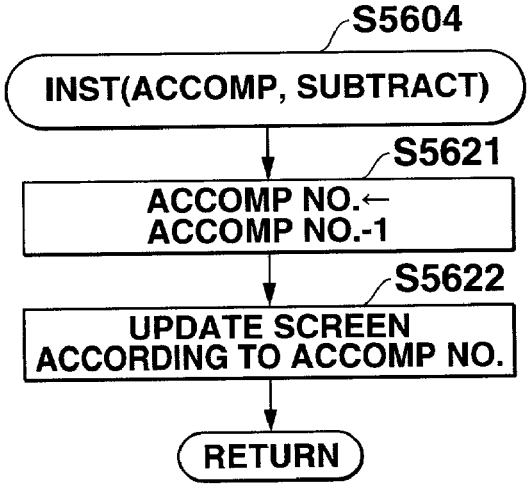

Details of INST (ACCOMP, ADD) routine S5602, INST (ACCOMP, SUBTRACT) routine S5604 and INST (ACCOMP, VALUE) routine S5606 are shown in FIGS. 52A-52*c*.

The routines S5602, S5604 and S5606 including blocks S5611 to S5632 correspond to routines S5302, S5304 and S5306 shown in FIGS. 46A–46C except that ACCOMP NO. replaces VOLUME.

5-7. Set Inst Transpose

The object of the set inst transpose routine S5014 is to set key transposition TRANSPOSE of the instrument based on operation of slider 17 or switch 18. According to the specification data table shown in FIGS. 4A–4D, the change parameter state row of the instrument includes specification data INST (TRANSPOSE, ADD) for switch 181, INST (TRANSPOSE, SUBTRACT) for switch 18*o* and INST (TRANSPOSE, VALUE) for slider 17*b*.

Figure 53:
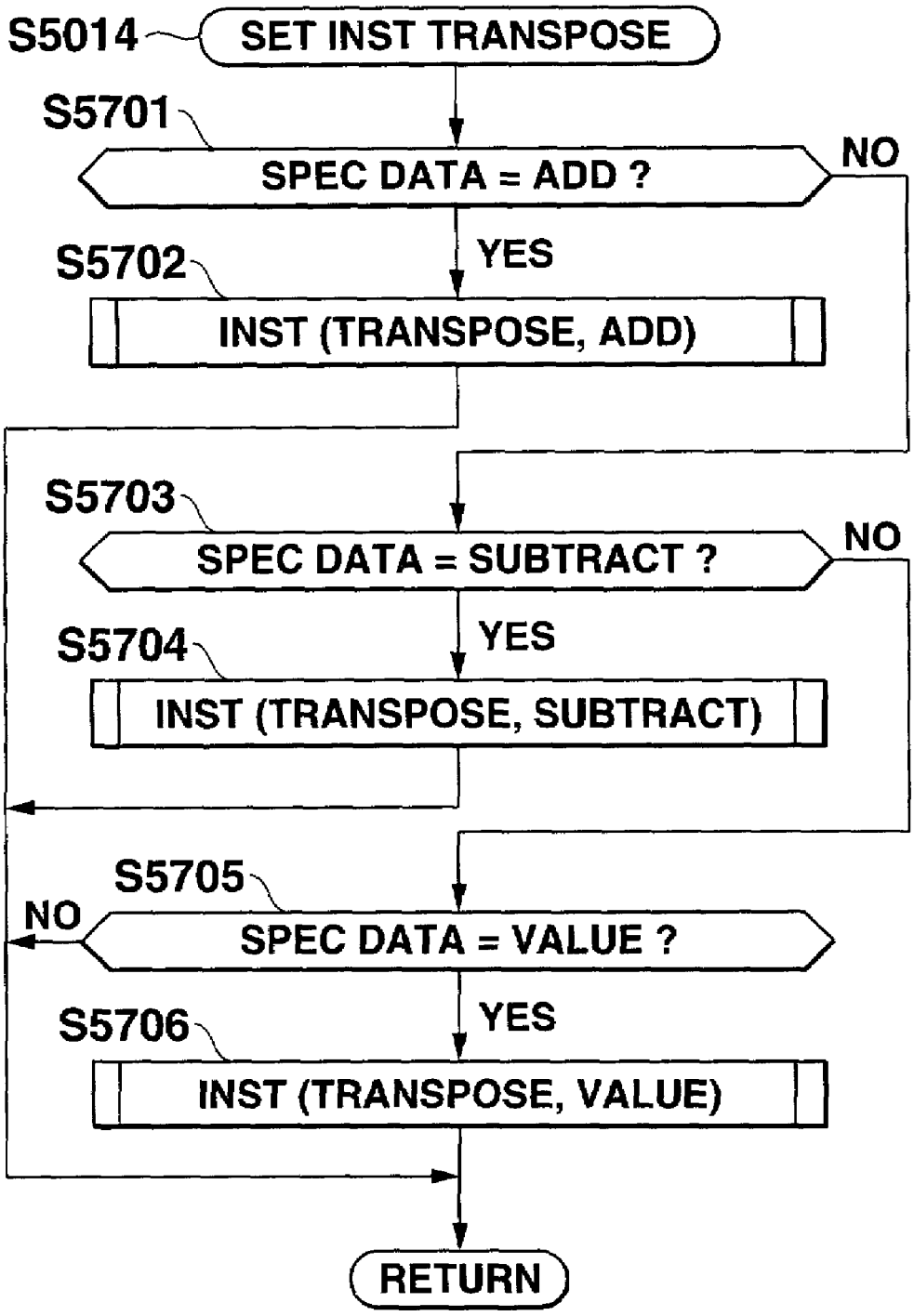
FIG. 53 is a flow chart of a set inst transpose routine.

FIG. 53 is a flow chart of the set inst transpose routine S5701. The routine S5701 including blocks S5701 to S5706 correspond to the set inst volume routine S5001 shown in FIG. 47 except that TRANSPOSE replaces VOLUME.

Figure 54A:
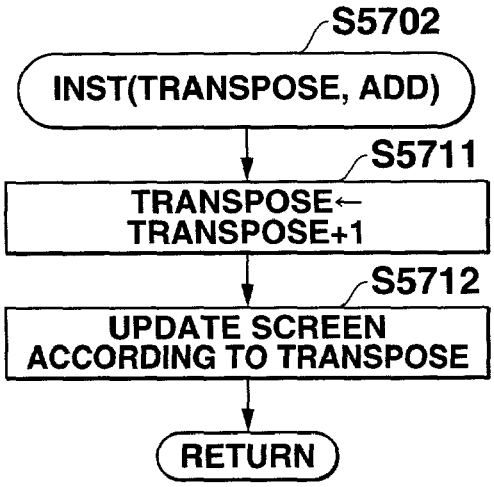
FIGS. 54A–C are flow charts of INST (TRANSPOSE, ADD), INST (TRANSPOSE, SUBTRACT) and INST (TRANSPOSE, VALUE) routines in FIG. 53.
Figure 54C:
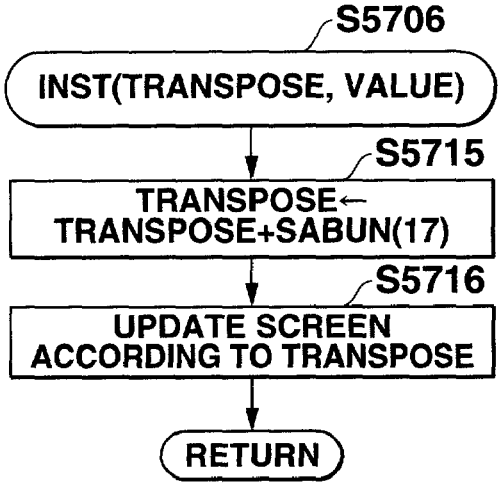
Figure 54B:
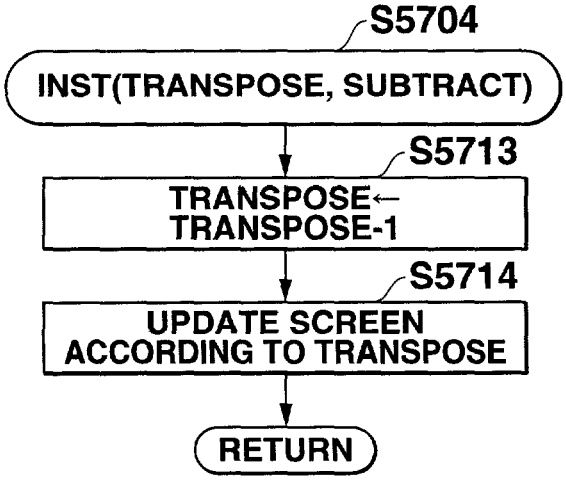

FIGS. 54A–54C show details of INST (TRANSPOSE, ADD) routine S5702, INST (TRANSPOSE, SUBTRACT) routine S5704 and INST (TRANSPOSE, VALUE) routine S5706 in FIG. 53.

The routines S5702, S5704 and S5706 including blocks S5711 to S5716 correspond to routines S5402, S5404 and S5406 shown in FIGS. 48A–48C except that TRANSPOSE replaces VOLUME.

6. Set FDD

The object of the set FDD routine S3006 (FIG. 16) is to transfer tone or song data between ROM 13 and a floppy disk of FDD 22 based on operation of switch 18 or encoder 19. According to the specification data table shown in FIGS. 4A–4D, when the instrument state is write or read external storage, a specification data FDD (SELECT, SONG) is assigned to switch 18*a*, specification data FDD (SELECT, TONE) to switch 18*b*, specification data FDD (SELECT, NEXT SONG, TONE) to switch 18*k*, specification data FDD (SELECT, PREVIOUS SONG, TONE) to switch 18*n* and specification data FDD (SELECT, ROTATION VALUE) to encoder 19. Further, specification data FDD (SELECT, WRITE) is assigned to switch 18*f* in the instrument state of write external storage. Specification data FDD (SELECT, READ) is assigned to switch 18*f* in the instrument state of read external storage.

Figure 55:
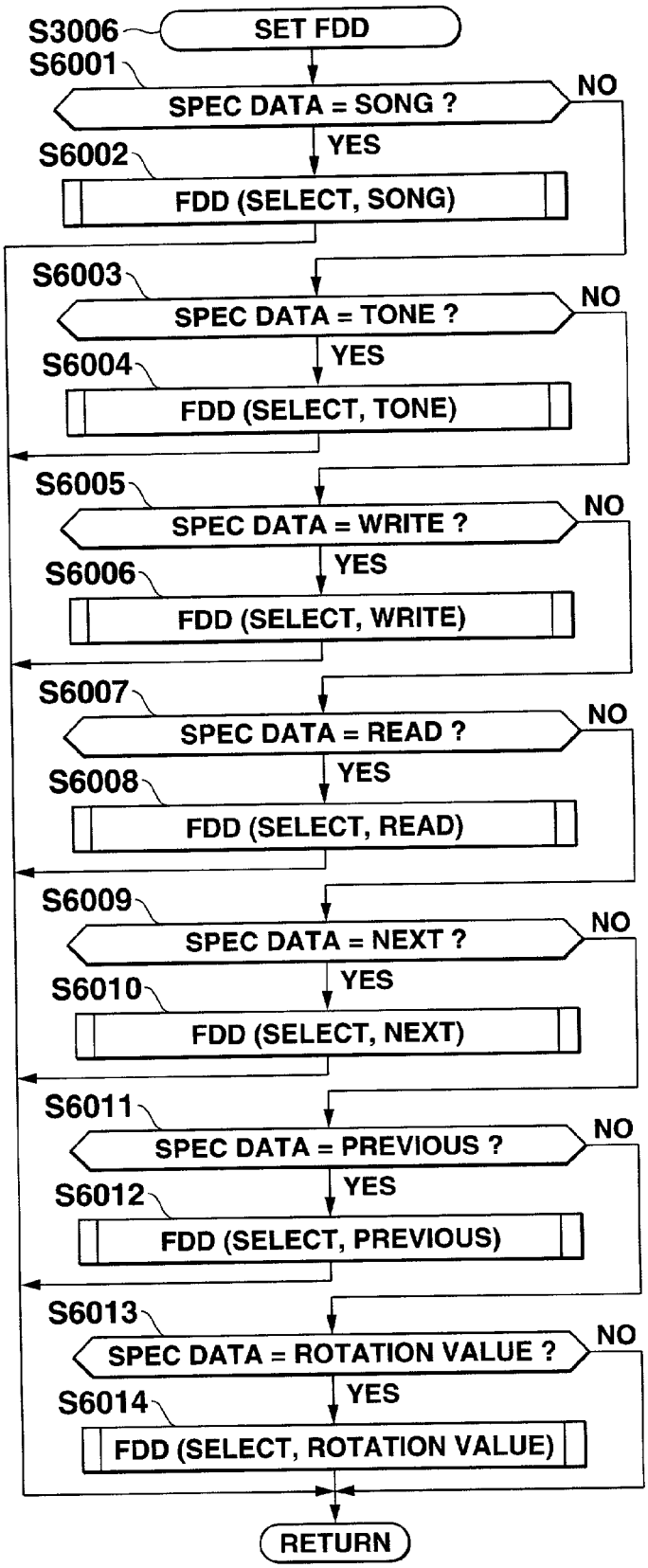
FIG. 55 is a flow chart of a set FDD routine.

FIG. 55 is a flow chart of the set FDD routine S3006. FIGS. 56A–56D and FIGS. 57A–57C show details of blocks S6002, S6004, S6006, S6008, S6010, S6012 and S6014 in FIG. 55.

According to the flow of FIG. 55, the set FDD routine S3006 identifies specification data in the manner as described with respect to the set TG routine. The identified specification data is FDD (SELECT, SONG), FDD (SELECT, TONE), FDD (SELECT, WRITE), FDD (SELECT, READ), FDD (SELECT, NEXT SONG, TONE), FDD (SELECT, PREVIOUS SONG, TONE) or FDD (SELECT, ROTATION VALUE).

Figure 56A:
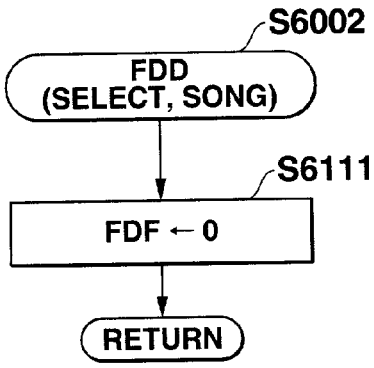
FIGS. 56A–D are flow charts of FDD (SELECT, SONG), FDD (SELECT, TONE), FDD (SELECT, WRITE) and FDD (SELECT, READ) routines in FIG. 55.

If FDD (SELECT, SONG) specification data is found (YES at block S6001 in FIG. 55), FDD (SELECT, SONG) routine S6002 is executed to set flag FDF to "0" as shown in block S6111 in FIG. 56A.

Figure 56C:
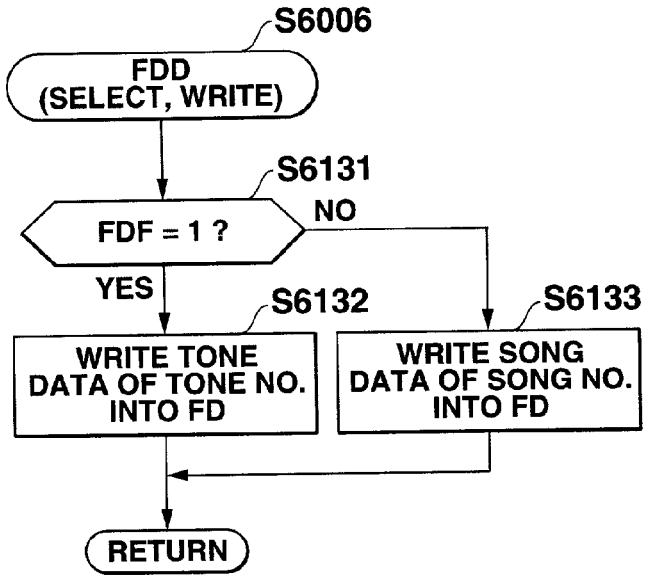
Figure 56B:
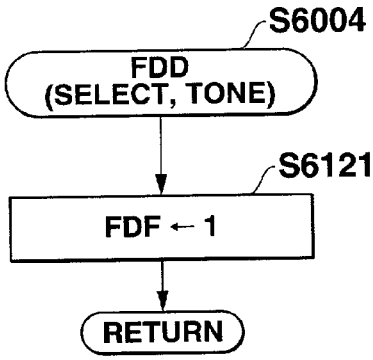

If FDD (SELECT, TONE) specification data is found (YES at block S6003 in FIG. 55), FDD (SELECT, TONE) routine S6004 is executed to set FDF to "1", as shown in block S6121 in FIG. 56B.

If FDD (SELECT, WRITE) specification data is found (YES at block S6005 in FIG. 55), FDD (SELECT, WRITE) routine S6006 is executed. Details of the routine S6006 are shown in FIG. 56C. If FDF is set to "1" (YES at block S6131), block S6132 writes tone data of TONE NO. of ROM 13 into the floppy disk. If FDF is set to "0" (NO at block S6131), block S6133 writes song data of SONG NO. of ROM 13 into the floppy disk.

Figure 56D:
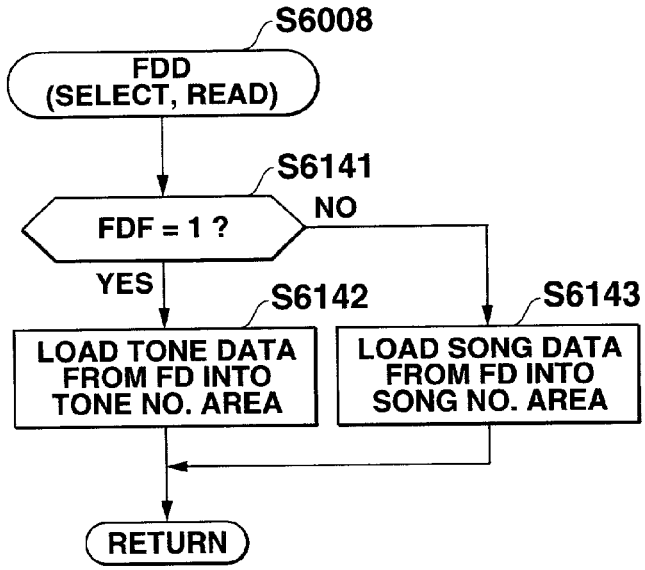

If FDD (SELECT, READ) specification data is found (YES at block S6007 in FIG. 55), FDD (SELECT, READ) routine S6008 is executed. Details of the routine S6008 are shown in FIG. 56D. If FDF is set to "1" (YES at block S6141), block S6142 loads tone data from the floppy disk into TONE NO. area of ROM 13. If FDF is set to "0" (NO at block S6141), block S6143 loads song data from the floppy disk into SONG NO. area of ROM 13.

Figure 57A:
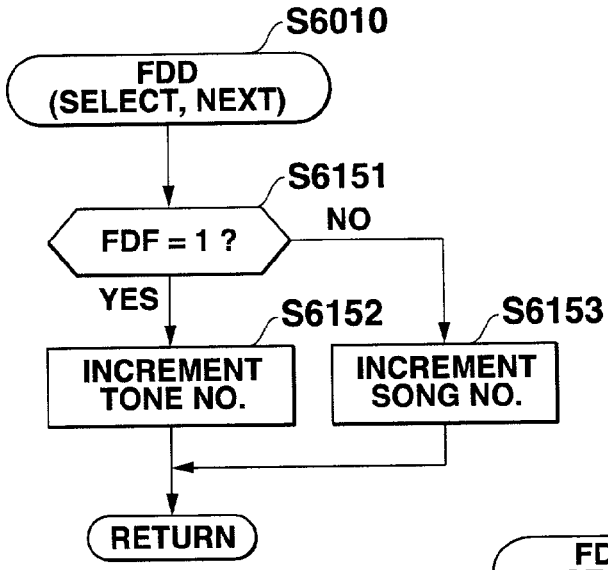
FIGS. 57A–C are flow charts of FDD (SELECT, NEXT), FDD (SELECT, PREVIOUS) and FDD (SELECT, ROTATION VALUE) routines in FIG. 55.

If FDD (SELECT, NEXT SONG, TONE) specification data is found (YES at block S6009 in FIG. 55), FDD (SELECT, NEXT) routine S6010 is executed. Details of the routine S6010 are shown in FIG. 57A. If FDF is set to "1" (YES at block S6151), block S6152 increments TONE NO. If FDF is set to "0" (NO at block S6151), block S6153 increments SONG NO.

Figure 57C:
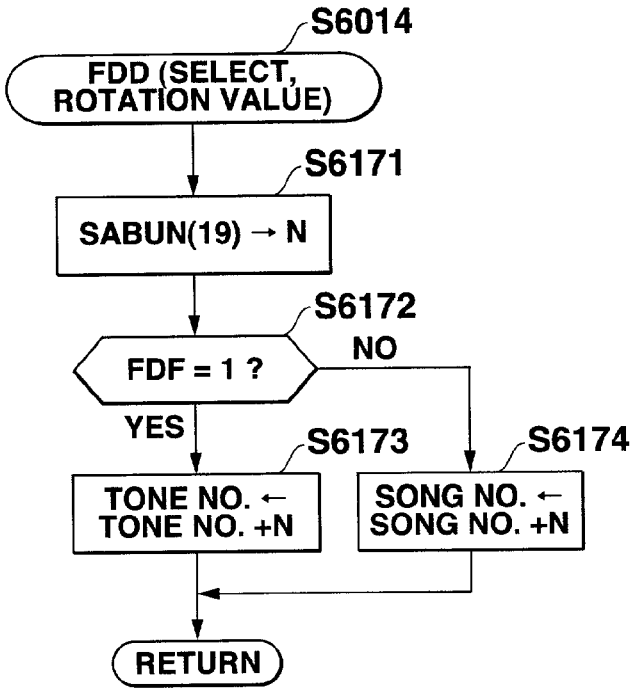
Figure 57B:
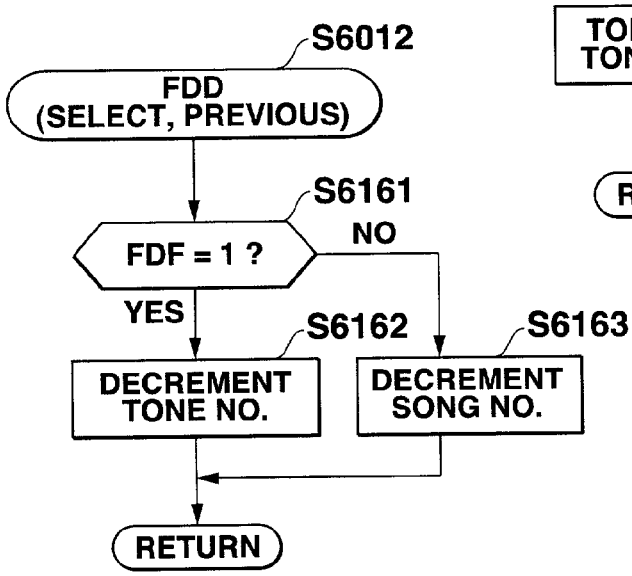

If FDD (SELECT, PREVIOUS SONG, TONE) specification data is found (YES at block S6011 in FIG. 55), FDD (SELECT, PREVIOUS) routine S6012 in executed. Details of the routine S6012 are shown in FIG. 57B. If FDF is set to "1" (YES at block S6161), block S6162 decrements TONE NO. In the negative, block S6163 decrements SONG NO.

If FDD (SELECT, ROTATION VALUE) specification data is found (YES at block S6013 in FIG. 55), FDD (SELECT, ROTATION VALUE) routine S6014 is executed. Details of the routine S6014 are shown in FIG. 57C. Block S6171 sets N to SABUN (19), indicative of operation value of the encoder 19. If FDF is set to "1" (YES at block S6172), block S6173 updates TONE NO. by adding N to TONE NO. In the negative, block S6174 updates SONG NO. by adding N to SONG NO.

7. Modifications of Process

In this manner, the instrument realizes required functions of operation members by performing respective processes described so far according to specification data of operation members.

Figure 58A:
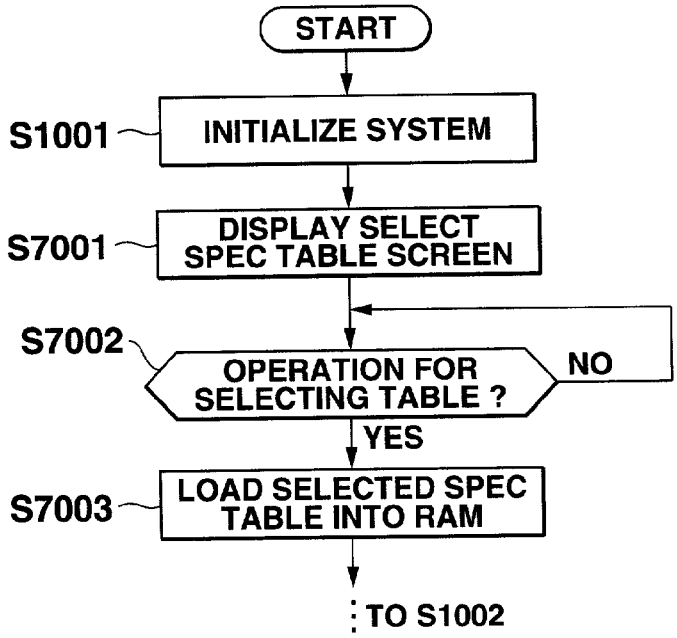
FIGS. 58A and B are flow charts of modified main routines.

In the embodiment, a single specification data table is provided in ROM 13. If desired, a plurality of specification data tables may be provided in ROM 13. To select and use a desired specification data, the main routine of FIG. 8 is modified as shown in FIG. 58A. After initializing the system (S1001), the routine executes block S7001 to display a select specification data table screen on LCD 15, thus prompting a user to select a desired specification data table. When a specification data table is selected by operation of switch 18 or the like (YES at block S7002), block S7003 loads the selected specification data from ROM 13 into RAM 14. Then, the routine goes to block S1002 in FIG. 8. Thereafter, in response to operation of an operation member, CPU 11 looks up the selected specification data table in RAM 14. In this manner, the instrument can provide the desired specification data table or desired function assignment of operation members according to preference of users.

A portable record medium, such as ROM card, floppy disk and CD-ROM, may be used as a specification data table source. A data reader may be provided in the instrument to read the data in the record medium, CPU 11 looks up the specification data by directly reading data in the record medium or indirectly reading data in RAM 14 loaded from the record medium. This arrangement has the advantage that a user can easily replace a record medium of the data reader to obtain the desired specification data table.

Figure 58B:
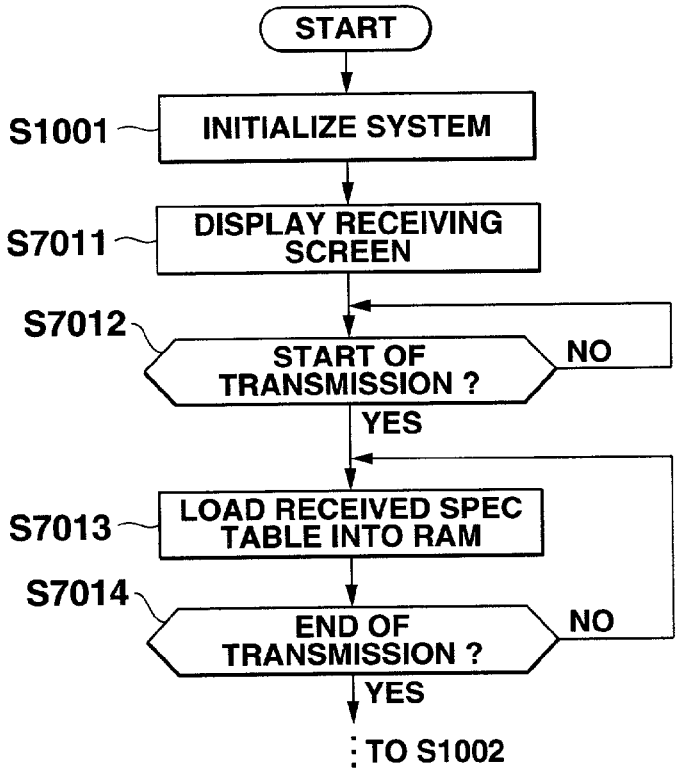

The instrument may employ a communication interface for communicating data with an external keyboard instrument or computer directly or by way of a communication network such as internet so that the instrument receives a specification data table from the keyboard instrument or computer. To this end, the main routine of FIG. 8 may be modified as shown in FIG. 58. After initializing the system (S1001), the routine executes block S7011 to display a receiving screen to prompt a user to receive a specification data table. When transmission of a specification data table starts via the interface (YES at block S7012), the routine receives the specification data table (S7013, S7014) by loading it into RAM 14. Then the routine goes to block S1002 in FIG. 8. Thereafter, in response to operation of an operation member, CPU 11 looks up the specification data table in RAM 14. This arrangement can expand functions of the instrument by using external specification data source. Since ROM 13 is implemented by a flash memory, a specification data table loaded in RAM 14 may be used to write ROM 13, updating specification data tables therein.

In the embodiment, a control routine for performing operations as a response to operation of an operation member is called based on the identification of specification data from the specification data table. In place of identifying specification data, the specification data table may be written in a table of program binary codes. In response to operation of an operation member, the system directly reads and executes program binary codes to perform required operations. With this arrangement, the system can quickly respond to operation of an operation member.

Further, the specification data table may be written in a table of source program codes. An interpreter may be provided to convert the source program codes to binary codes executable by CPU 11. CPU 11 reads the source program codes, converts them to binary codes by means of the interpreter and executes the binary codes. With this arrangement, contents of the specification data table can easily be changed at a source program level.

If desired, a user may freely change function assignment of operation members, such as switches 18*a* to 18*j*. A counter may be provided to count operation frequency of respective operation members. According to the operation frequency of respective operation members, contents of the specification data table may be changed. With this arrangement, a switch located at an easy-to-operate position may be assigned to a function having a high frequency of use so that instrument operability may be improved.

Specification data may include a data item of tone confirmation of operation of an operation member. A corresponding routine for executing the tone confirmation may be provided. When an operation member is operated, a corresponding tone is generated to confirm the operation of the operation member. Further, a flag may be used to enable or inhibit the tone confirmation routine so that a confirming tone is not generated when such a tone is not desired, for instance, in the case of performance on stage.

What is claimed is:

1. An apparatus for generating tones, comprising:

operation members which are externally operated to operate functions of the apparatus, each of said operation members being assigned applications which correspond to said functions;

storage means for storing defining information, in the form of a table concerning a relationship between operation conditions of the apparatus and applications of said operation members;

control program storing means for storing control programs to control the apparatus such that applications of said operation members are effected;

readout means for reading out the defining information stored in said storage means based on the operation member and operation condition of the apparatus in response to operation of said operation members; and control means which includes a central processing unit which executes a control program read out from said control program storing means based on the defining information read out by said readout means, said control means controlling the apparatus such that applications of said operation members in operation conditions of the apparatus are effected in response to operation of the operation members according to said defining information.

2. The apparatus of claim 1 wherein said defining information includes a plurality of defining data; and the apparatus further comprising selecting means for selecting, from said plurality of defining data, defining data according to which said control means determines contents of control.

3. The apparatus of claim 1 further comprising defining information changing means for changing said defining information stored in said storage means.

4. The apparatus of claim 1 further comprising loading means for loading said defining information supplied from an external apparatus into said storage means.

5. A method for controlling a tone generating apparatus including operation members which are externally operated to operate functions of the apparatus, each of said operation members is assigned to applications which correspond to said functions, storage means for storing defining information, in the form of a table concerning a relationship between operation conditions of the apparatus and applications of said operation members, control program storing means for storing control programs to control the apparatus in such a manner that applications of said operation members are effected and a central processing unit which executes the control program, the method comprising the steps of:

reading out the defining information stored in said storage means based on the operation member and operation condition of the apparatus in response to operation of the operation members; and controlling the apparatus in such a manner that applications of said operation members in operation conditions of the apparatus are effected in response to operation of the operation members according to said defining information.

* * * * *